United States Patent [19]

Harvey et al.

[11] Patent Number: 4,538,138

[45] Date of Patent: Aug. 27, 1985

[54] INTEGRATED SECURITY SYSTEM HAVING A MULTIPROGRAMMED CONTROLLER

[75] Inventors: Roy L. Harvey, Milton; Kevin J. Griffin, Waltham; Aaron A. Galvin, Lexington; Louis H. Auerbach, Brighton, all of Mass.

[73] Assignee: American District Telegraph Company, New York, N.Y.

[21] Appl. No.: 451,744

[22] Filed: Dec. 17, 1982

[51] Int. Cl.[3] ..... G08B 19/00; G08B 26/00

[52] U.S. Cl. ..... 340/521; 340/505; 340/506; 340/518; 340/523; 340/531; 340/825.06

[58] Field of Search ..... 340/521, 505, 506, 531, 340/533, 518, 522–525, 509, 825.06–825.18, 825.2, 825.21, 825.29, 825.04, 825.54, 825.52; 364/550

[56] References Cited

U.S. PATENT DOCUMENTS 3,516,063 6/1970 Arkin et al. ..... 340/505

*Primary Examiner*—Donnie L. Crosland

*Attorney, Agent, or Firm*—Weingarten, Schurgin Gagnebin & Hayes

[57] ABSTRACT

A security system continuously monitoring a plurality of spatially diverse events which are reportable to a central monitoring facility, the system including a controller for sequencing the performance of reporting and monitoring tasks according to the requirements of the events. The system also performs the tasks according to a predetermined priority, in particular, alarm message queuing. In addition, alarm conditions and system operation are verified by specified communication procedures and redundancies. Furthermore, system communications capabilities include keyboard entry and output display and an interrupt facility.

27 Claims, 45 Drawing Figures

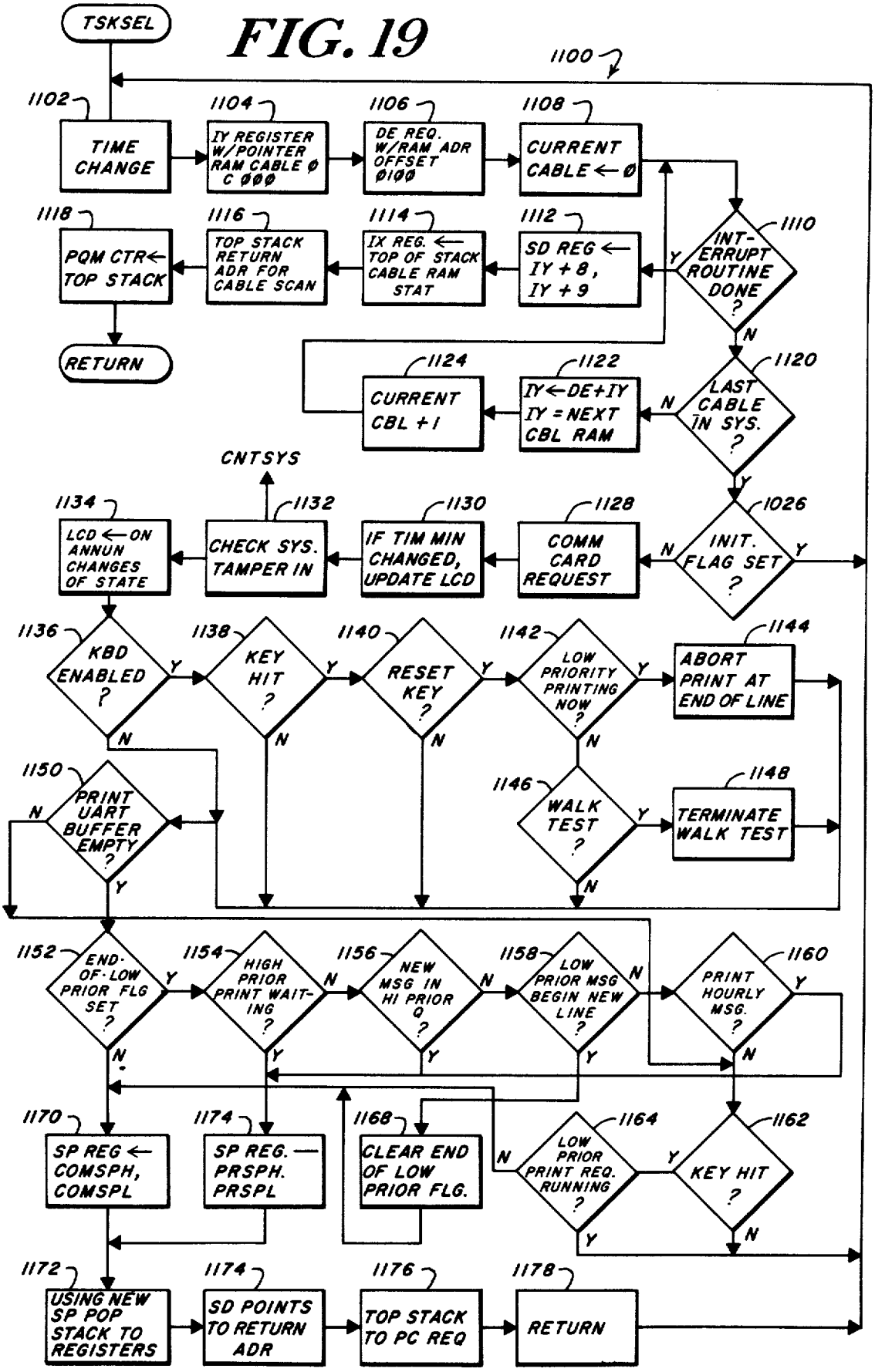
FIG. 19
TSKSEL
1100
1102
TIME CHANGE
1104
IY REGISTER W/POINTER RAM CABLE Ø C ØØØ
1106
DE REQ. W/RAM ADR OFFSET ØIØØ
1108
CURRENT CABLE ← Ø
1110
INT-ERRUPT ROUTINE DONE ?
1112
SD REG ← IY + 8, IY + 9
1114
IX REG. ← TOP OF STACK CABLE RAM STAT
1116
TOP STACK RETURN ADR FOR CABLE SCAN
1118
PQM CTR ← TOP STACK
RETURN
1120
LAST CABLE IN SYS. ?
1122
IY ← DE+IY IY = NEXT CBL RAM
1124
CURRENT CBL + 1
1026
INIT. FLAG SET ?
1128
COMM CARD REQUEST
1130
IF TIM MIN CHANGED, UPDATE LCD
1132
CHECK SYS. TAMPER IN
CNTSYS
1134
LCD ← ON ANNUN CHANGES OF STATE
1136
KBD ENABLED ?
1138
KEY HIT ?
1140
RESET KEY ?
1142
LOW PRIORITY PRINTING NOW ?
1144
ABORT PRINT AT END OF LINE
1146
WALK TEST ?
1148
TERMINATE WALK TEST
1150
PRINT UART BUFFER EMPTY ?
1152
END-OF-LOW PRIOR FLG SET ?
1154
HIGH PRIOR PRINT WAIT-ING ?
1156
NEW MSG IN HI PRIOR Q ?
1158
LOW PRIOR MSG BEGIN NEW LINE ?
1160
PRINT HOURLY MSG. ?
1162
KEY HIT ?
1164
LOW PRIOR PRINT REQ. RUNNING ?
1168
CLEAR END OF LOW PRIOR FLG.
1170
SP REG ← COMSPH, COMSPL
1174
SP REG. — PRSPH. PRSPL
1172
USING NEW SP POP STACK TO REGISTERS
1174
SD POINTS TO RETURN ADR
1176
TOP STACK TO PC REQ
1178
RETURN
Y
N

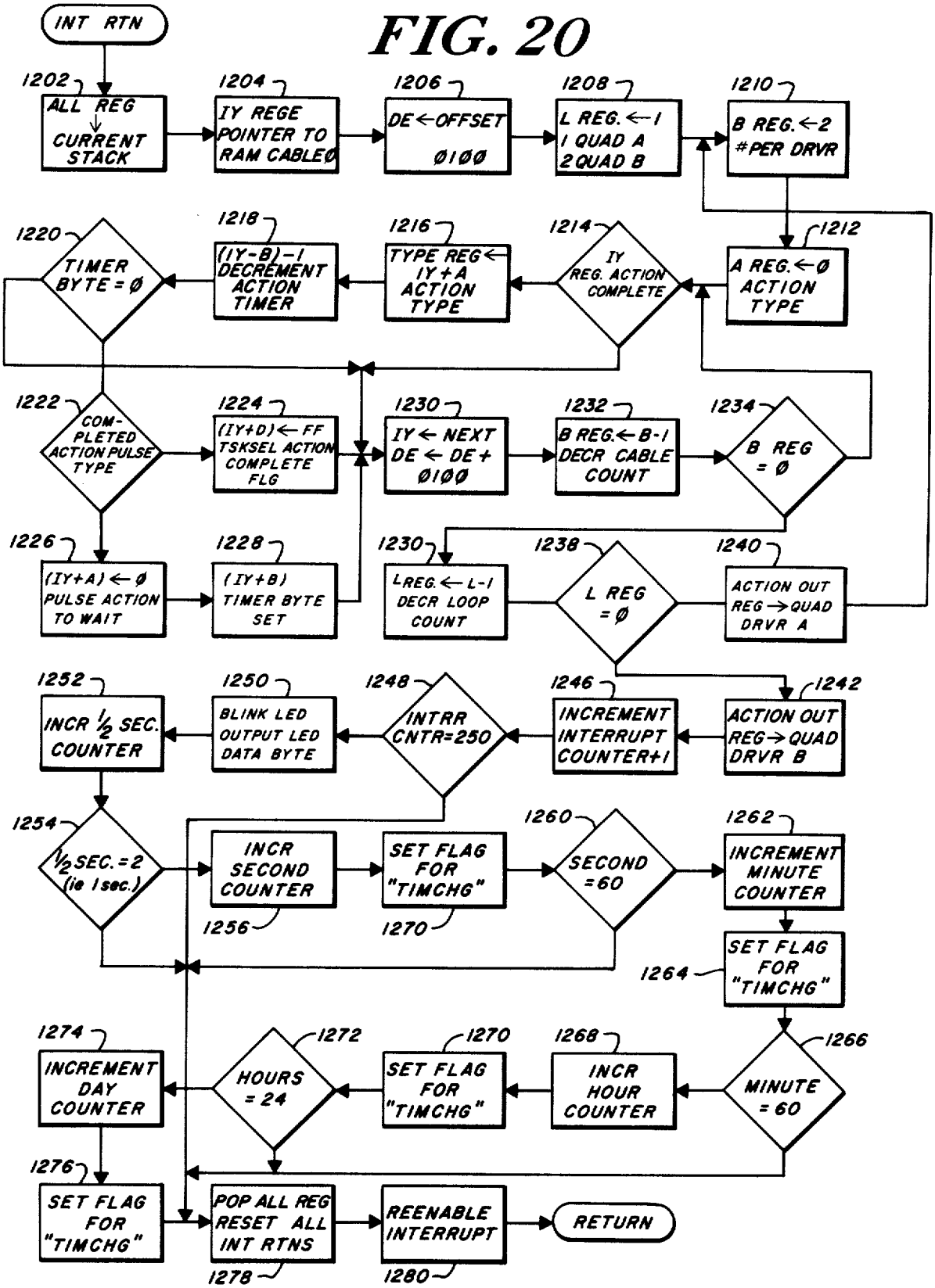
FIG. 20
INT RTN
1202
ALL REG ↓ CURRENT STACK
1204
IY REGE POINTER TO RAM CABLEØ
1206
DE←OFFSET ØIØØ
1208
L REG.←1 1 QUAD A 2 QUAD B
1210
B REG.←2 #PER DRVR
1212
A REG.←Ø ACTION TYPE
1214
IY REG. ACTION COMPLETE
1216
TYPE REG← IY+A ACTION TYPE
1218
(IY-B)-1 DECREMENT ACTION TIMER
1220
TIMER BYTE = Ø
1222
COM-PLETED ACTION PULSE TYPE
1224
(IY+D)← FF TSKSEL ACTION COMPLETE FLG
1226
(IY+A) ← Ø PULSE ACTION TO WAIT
1228
(IY+B) TIMER BYTE SET
1230
IY ← NEXT DE ← DE + ØIØØ
1232
B REG.←B-1 DECR CABLE COUNT
1234
B REG = Ø
1230
LREG.← L-1 DECR LOOP COUNT
1238
L REG = Ø
1240
ACTION OUT REG→QUAD DRVR A
1242
ACTION OUT REG→QUAD DRVR B
1246
INCREMENT INTERRUPT COUNTER+1
1248
INTRR CNTR=250
1250
BLINK LED OUTPUT LED DATA BYTE
1252
INCR ½ SEC. COUNTER
1254
½ SEC. = 2 (ie 1 sec.)
1256
INCR SECOND COUNTER
1270
SET FLAG FOR "TIMCHG"
1260
SECOND = 60
1262
INCREMENT MINUTE COUNTER
1264
SET FLAG FOR "TIMCHG"
1266
MINUTE = 60
1268
INCR HOUR COUNTER
1270
SET FLAG FOR "TIMCHG"
1272
HOURS = 24
1274
INCREMENT DAY COUNTER
1276
SET FLAG FOR "TIMCHG"
1278
POP ALL REG RESET ALL INT RTNS
1280
REENABLE INTERRUPT
RETURN

INTEGRATED SECURITY SYSTEM HAVING A MULTIPROGRAMMED CONTROLLER

FIELD OF THE INVENTION

The present invention relates to security systems, and more particularly, to security systems reporting several specific remote events to a central security system.

BACKGROUND OF THE INVENTION

Security systems for remote sensing and control of activity in security areas apart from central locations require more functions, more data, and lower costs than previous systems. Their functions include monitoring of secure areas for unauthorized use and remote control of events within the secure areas. Particular events must be specifically reported in a manner most likely to provide a timely response from the operators of the security system. To command the attention of the operators, the reported data must be ordered, reliable, specific, and clear. However, to be an economically viable system, it must also be compact, operationally flexible, easy to use, and inexpensive.

In previous systems, the attempt to combine all the above-mentioned features in a single security system has been only partially successful, sacrificing one or more of the above-mentioned requirements. For instance, the specific needs of the system constantly change according to the change in usage and size of the secured area. In wired-logic systems, this flexibility requirement can only be accommodated by appropriate changes in hardware, which often are significant, protracted, and expensive.

The security system is frequently required to perform tasks in addition to reporting fire and break-in alarms. These additional tasks include detailed prioritized visual and audible alarms, as well as a clearly readable annunciation of the alarm condition. System sophistication at this level cannot be implemented without substantial information handling capacity, typically that of a computer system.

To meet the above-mentioned requirements, the security system naturally grows in complexity. At the same time, the reliability of the system must be maintained at a high level, if not improved over the earlier, simpler systems. However, since the increased performance is generally provided only by annexing greater amounts of hardware, the reliability problem worsens.

SUMMARY OF THE INVENTION

The integrated security system according to the present invention performs a multiplicity of tasks in a single programmable controller with a reduced component count. The basic function of the integrated security system is to monitor the status of a plurality of remote locations through the scanning and control of a modularly expandable number of remote point interface devices and programmably alterable interaction with the point interface device by the system operator. The interaction includes keyboard entry of system codes and alarm message indication by visual indicator displays and printed word.

Each point in the security area zone is monitored and controlled by at least one point interface device, connected to the controller by a single four-conductor cable. Each cable can accommodate a large number of point interface devices, also, the number of cables is also expandable, typically to four cables, thus allowing one security system to accommodate several hundred point interface devices. Inherent in the operation of the system are redundant data and hardware verification checks.

Each security system also communicates with alarm annunciators including a CRT and Printer showing specific messages, a status matrix, and audible indicators to report alarm conditions.

One or more of the security systems of the present invention reports specific information regarding the alarm address and status to a central security station, as well as reporting the above-mentioned detailed messages at the system site locally.

The security system further includes a control unit arranged to perform multiple independent system tasks, at least some of which are alterable by a system operator through keyboard switch, or other control means. The control unit communicates with the remote security sensors, status indicators, and operators control means. The selection and operation of specific tasks within the control unit is performed by a task selection system which responds to periodic interrupts related in time to the actual time necessary for each task to be performed by apparatus external to the controller. The task selection system performs a first task until an external input or output (I/O) operation is required, after which a second task is initiated. The second task is performed until it too requires an external operation, at which time the second task parameters are stored, releasing the system to perform a third task, and so forth. The I/O operations include selection of a large number of remote security sensors through a relatively small number of cables connecting to the controller, a separate task being assigned to each cable. The point interface devices attached to the cables are selectively addressed by signals from the controller, and each cable receives signals sent in response from the addressed point interface devices. Upon completion of the requested I/O operations, the system again services the highest priority, or first task.

BRIEF DESCRIPTION OF THE DRAWING

The present invention is better understood by reading the following specification, taken together with the following drawings.

FIG. 19 is a flow chart of the task select (TSKSEL) subroutine;

FIG. 20 is a flow chart of the interrupt service routine (INTRTN);

DETAILED DESCRIPTION OF THE INVENTION

Figure 1:
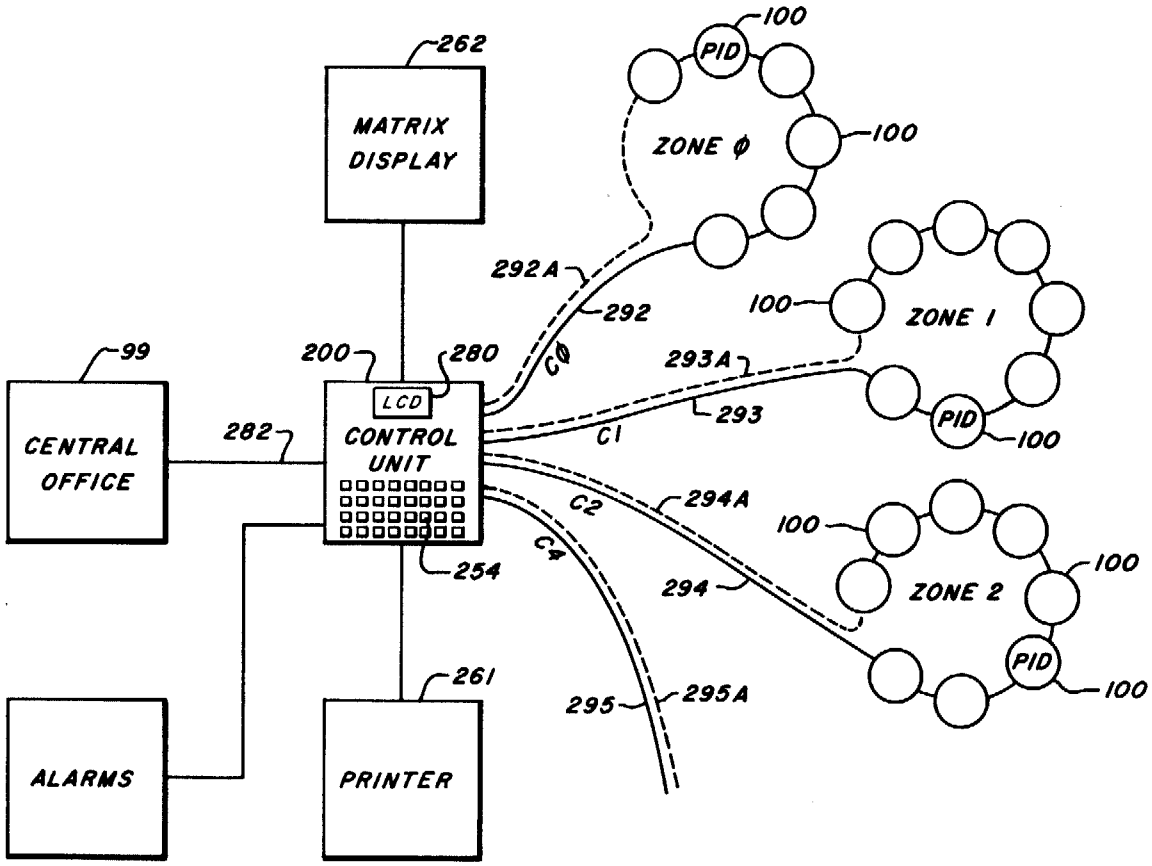
FIG. 1 is a block diagram of one embodiment of the integrated security system of the present invention.

The general diagram of the Integrated Security System (ISS) of the present invention is shown in FIG. 1. The Control Unit (CU) 200 monitors several hundred points by selectively addressing point interface devices (PID) 100 associated with each point monitored. The point interface devices 100 are connected in parallel on one of four cables 292, 293, 294, and 295 (or less for fewer PIDs). The cables are independently and simultaneously controllable from the control unit to send cable signals to selectably activate a particular PID attached to the respective cable.

The selected PID returns signals simultaneously and independently to the control unit, which simultaneously receives the return signals. The cables can be formed in a loop configuration to allow the other cable ends 292A, 293A, 294A and 295A, respectively, to be connected and energized. The control unit 200 simultaneously monitors and controls all cables, receives operator codes, and displays system operations of the Integrated Security System by a single central processor contained therein. Customized user information can be permanently stored, and altered according to keyboard 254 entries. Alarm conditions, as indicated by responses from respective point interface device 100, are indicated on the Liquid Crystal Display 280 according to a priority to which each PID 100 is assigned. The priority list comprises Fire Alarm (FA), Supervisory (Danger), Hold Up Alarm (HUA), Security Alarm (BA), Supervisory (FA/BA), Supervisory (MISC.), and Electrical/-Mechanical (EM), ordered from highest to lowest priority. The status of each point monitored is also reported on a matrix display 262, a hard-copy printer 261, and to a central office station 99 over a telephone, or other communication line 282.

HARDWARE SYSTEM IMPLEMENTATION

Figure 2:
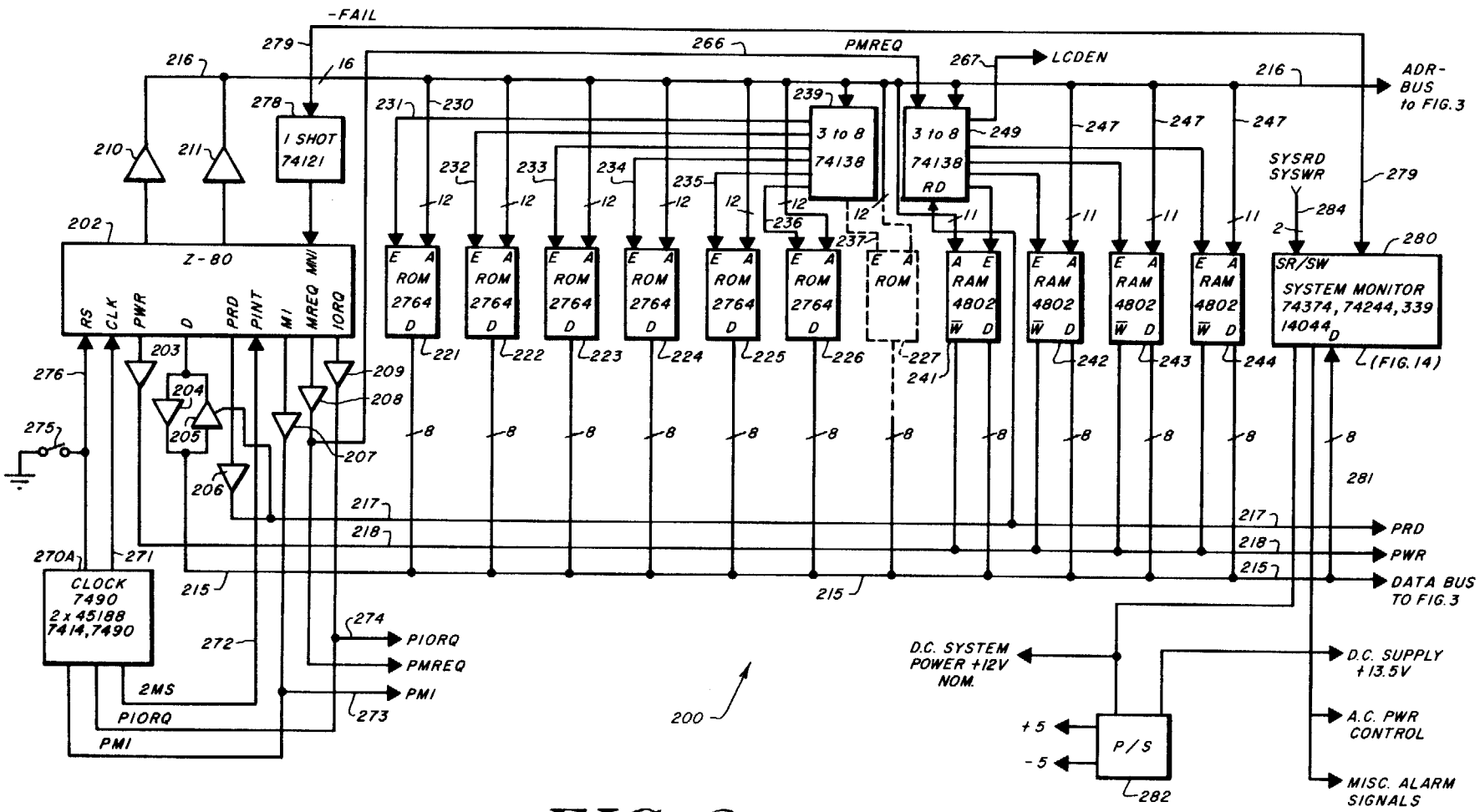
FIGS. 2 and 3 taken together comprise a diagram of the control unit system.
Figure 3:
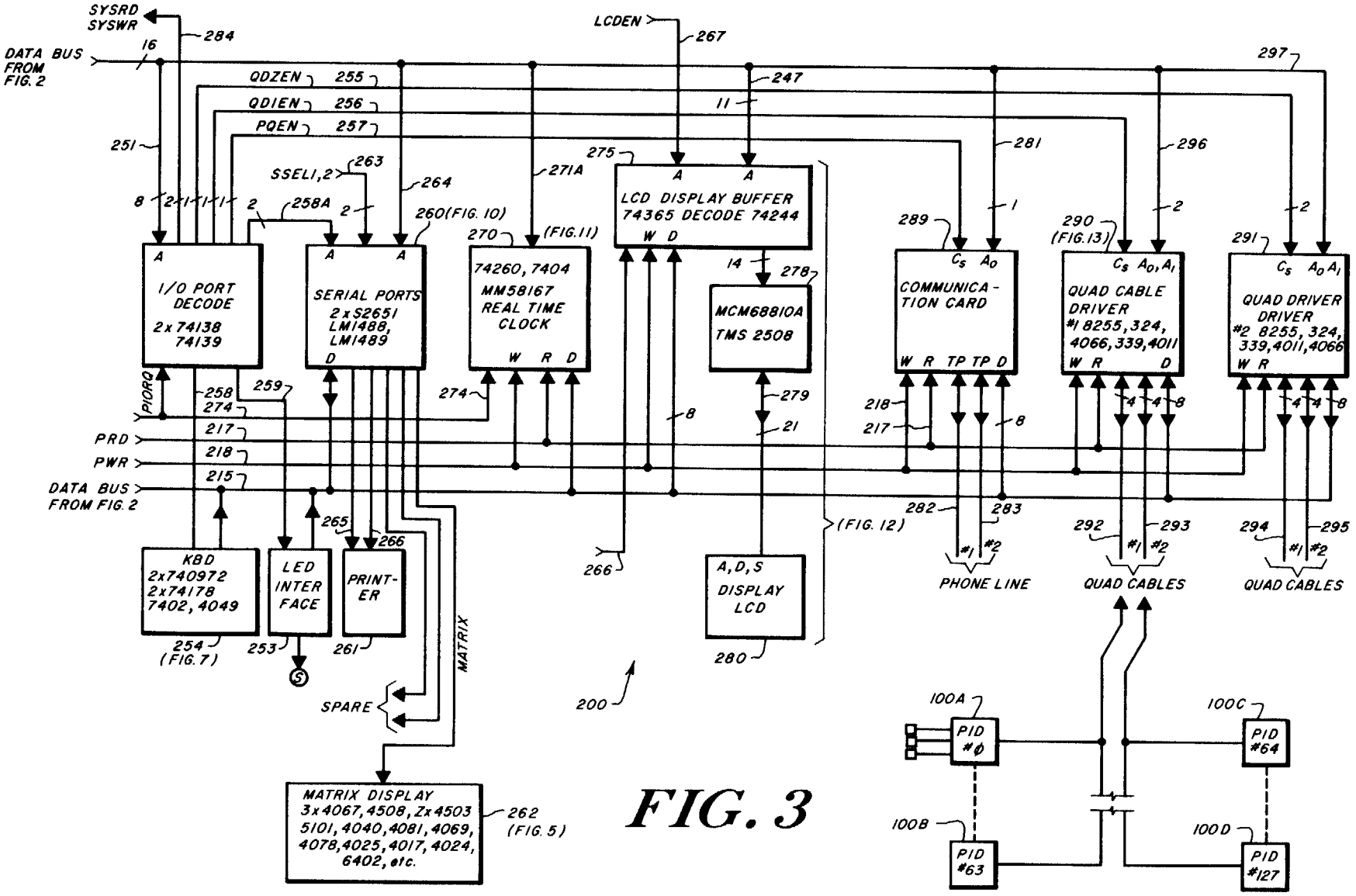

The general hardware configuration of the present invention is shown in FIGS. 2 and 3 taken together to form a whole system. The system includes a control unit (CU) 200 operative to provide data to remote sensors 2000, and to validate the data for system verification and for alarm actuation. The control unit includes a microcomputer comprising a central processing unit (CPU) 202, read only memories (ROM) 221–227 random access memories (RAM) 241–244, each coupled via a data bus 215 and an address bus 216. A clock 270A provides interrupt timing signals to the elements of the control unit and also drives a software clock (shown in FIG. 20) which provides an indication of the time of day. Devices which pass information to and from the CPU 202 include a keyboard 254, matrix indicators 262, an alphanumeric display 280, LED indicators 253, and quad cable drivers 289, 290, and 291. Also coupled to the CPU 202 are serial ports 260 to drive a local printer 261 and receive serial input if desired. Information is passed among the control unit 200 elements by a data bus 215 and an address bus 216. A power supply 282, energized from an appropriate external source, includes within block 280 a battery back-up source and provides necessary stand-by operating power for the system.

Also indicated in FIG. 2 and FIG. 3 are the respective figure numbers of specific elements of the system, which describe those particular elements in greater detail. For instance, the block 254 of FIG. 3 indicating the keyboard and the associated decoding and encoding circuits is also shown again in greater detail in FIG. 7 as marked.

The CU 200 includes a Z-80 microprocessor central processor unit (CPU) 202 manufactured by Zilog of Cupertino, Calif., whose physical and functional characteristics are specified by the Z-80 CPU Technical Manual published by Zilog, 1980, herein incorporated by reference. The external Z-80 CPU signals are buffered by a plurality of buffers labelled 203 through 211, typically comprising the logic circuits contained on the integrated circuit 74365, or similar devices. The main signal flow to and from the CPU 202 is provided by the data bus 215 and the address bus 216, the operation of which is known in computer systems design. The data bus 215 receives 8 bits of data, commonly called 1 byte, which flow either to or from the CPU 202. The address bus 216 comprises 16 signal lines, providing a maximum address space of $2^{16}$ locations, where the address space is allocated among the various devices described hereunder according to the map of FIG. 20, described below. The programs for the Z-80 CPU 202 are stored in read only memory (ROM) integrated circuits 221 through 227, consecutively, which comprise memories organized in an 8K(1K=1024)×8 bit memories, typically a part number 2764 available from various manufacturers. The ROMs 221-227 are programmed prior to system operation; therefore, the data leads 229 provide data flow from the ROMs to the CPU 202 through the data bus 215 in one direction only. The ROMs receive an address signal 230 comprising the 13 least significant bits (LSB) of the address bus 216. The selection of a particular ROM from among the 6 ROMs shown is provided by an enable signal along the lead 213-237, consecutively, from a 3-bit binary to one-of-8 decoder 239 receiving the next most significant 3 bits of the address bus 216. The decoder 239 is typically an integrated circuit logic device part #74138, or similar device. The ROMs 221-227 contain an instruction code representative of the programs shown in the flow charts of FIGS. 18-45, described below in the Software System Implementation section. While a significant part of the discussion below is concerned with the movement of data between the Z-80 CPU of the particular register configuration, shown in FIG. 4, and the RAM memory devices 241-244, other CPU or general computer hardware to process the data as described below is also envisioned according to the present invention and within the scope thereof.

Figure 4:
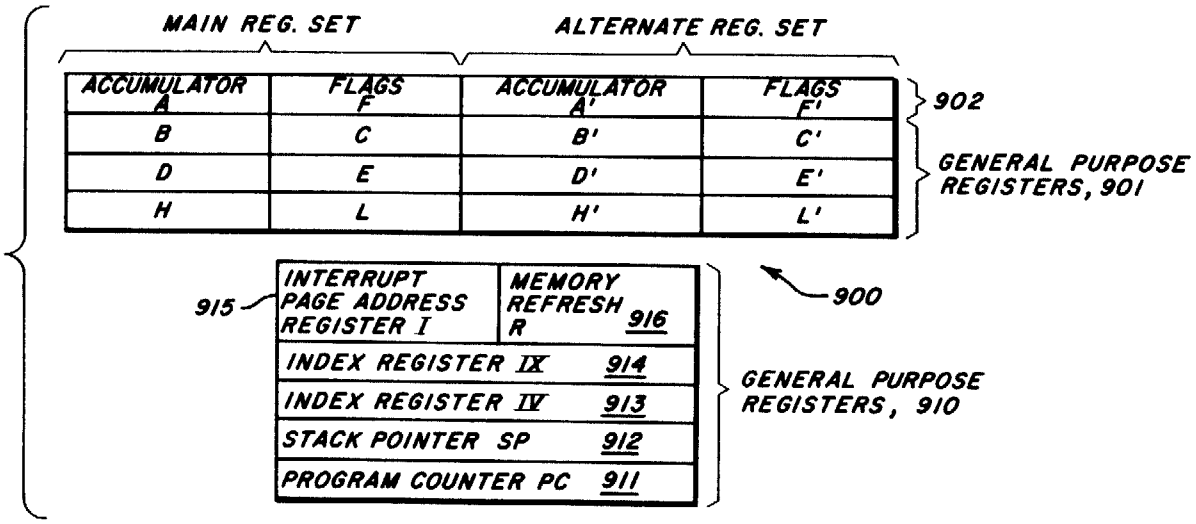
FIG. 4 is a diagram of the register set of the Z80 microprocessor.

FIG. 4 illustrates the configuration of the Z-80 CPU memory as described by the Zilog Z-80 CPU Technical Manual incorporated by reference, pages 3-5. The Z-80 CPU makes 208 bits of Read or Write (R/W) memory accessible to the programmer. These include eighteen 8-bit registers and four 16-bit registers, all of which are implemented using internal RAM. These registers include two sets of six general purpose registers 901 which may be used either individually as 8-bit registers or in pairs as 16-bit registers. There are also two sets of accumulator and flag registers 902.

There are six special purpose registers 910. The program counter (PC) register 911 holds the 16-bit of the instruction which is currently being fetched from memory. The PC is automatically incremented after its contents have been transferred to the address lines. When a program jump occurs, the new value is automatically placed in the PC, thus overriding the incrementer.

The stack pointer (SP) register 912 holds the 16-bit address of the current top of a stack located anywhere in the external system RAM memory. This external stack memory is organized as a last-in first-out (LIFO) file. The execution of PUSH or POP instructions can push data onto the stack from specific CPU registers or pop it off of the stack into specific CPU registers. The data popped from the stack is always the last data pushed onto it. The stack allows simple implementation of multiple level interrupts, unlimited subroutine nesting, and simplification of many types of data manipulation.

The two independent index registers 913 and 914 hold a 16-bit bus address that is used in indexed addressing modes. In these modes, an index register is used as a base to point to a region in memory from which data is to be stored or retrieved. An additional byte is included in indexed instructions to specify a displacement from this base. This displacement is specified as a two's-complement signed integer. This mode of addressing greatly simplifies many types of programs, especially where tables of data are used.

Since the Z-80 CPU can be operated in a mode where an indirect call to any memory location can be achieved in response to an interrupt, the Interrupt Page Address (I) Register 915 is used to store the high order 8-bits of the indirect address. The interrupting device provides the lower 8-bits of address. The interrupt feature permits interrupt routines to be dynamically located anywhere in memory with an absolute minimal access time to that routine.

The CPU includes two independent 8-bit accumulators and associated 8-bit flag registers 902. The accumulator holds the results of 8-bit arithmetic or logical operations while the flag register indicates specific conditions for 8- or 16-bit operations; for example, the flag register may indicated whether or not the result of an operation is equal to zero. The programmer may select the accumulator and flag pair with which he wishes to work with a single exchange instruction.

There are two matched sets of general purpose registers 901. Each set contains six 8-bit registers which the programmer may use either individually as 8-bit registers or in pairs as 16-bit registers. One set is called BC, DE, and HL; the complementary set is called BC', DE', and HL'. The complementary register pairs are not used in the embodiment of the present invention shown herein except to handle NMI signals for immediate power loss.

The control unit 200 CPU 202 memory space is allocated among the ROM, RAM, and specific I/O devices according to the listings of Table I, below.

TABLE I

| Title | Location |
|---|---|
| Program ROM Space | 0000-5FFFF |
| Vocabulary ROM Space | 6000-6FFF |
| (Reserved) | 7000-7FFF |
| Communication Card | A000-BFFF |
| Customization ROM Space | 8000-9FFF |
| RAM Locations | C000-DFFF |
| Liquid Crystal Diplay | |
| Memory Mapped I/O Top Row | E033-E020 |
| Bottom Row | E013-E000 |

Figure 18:
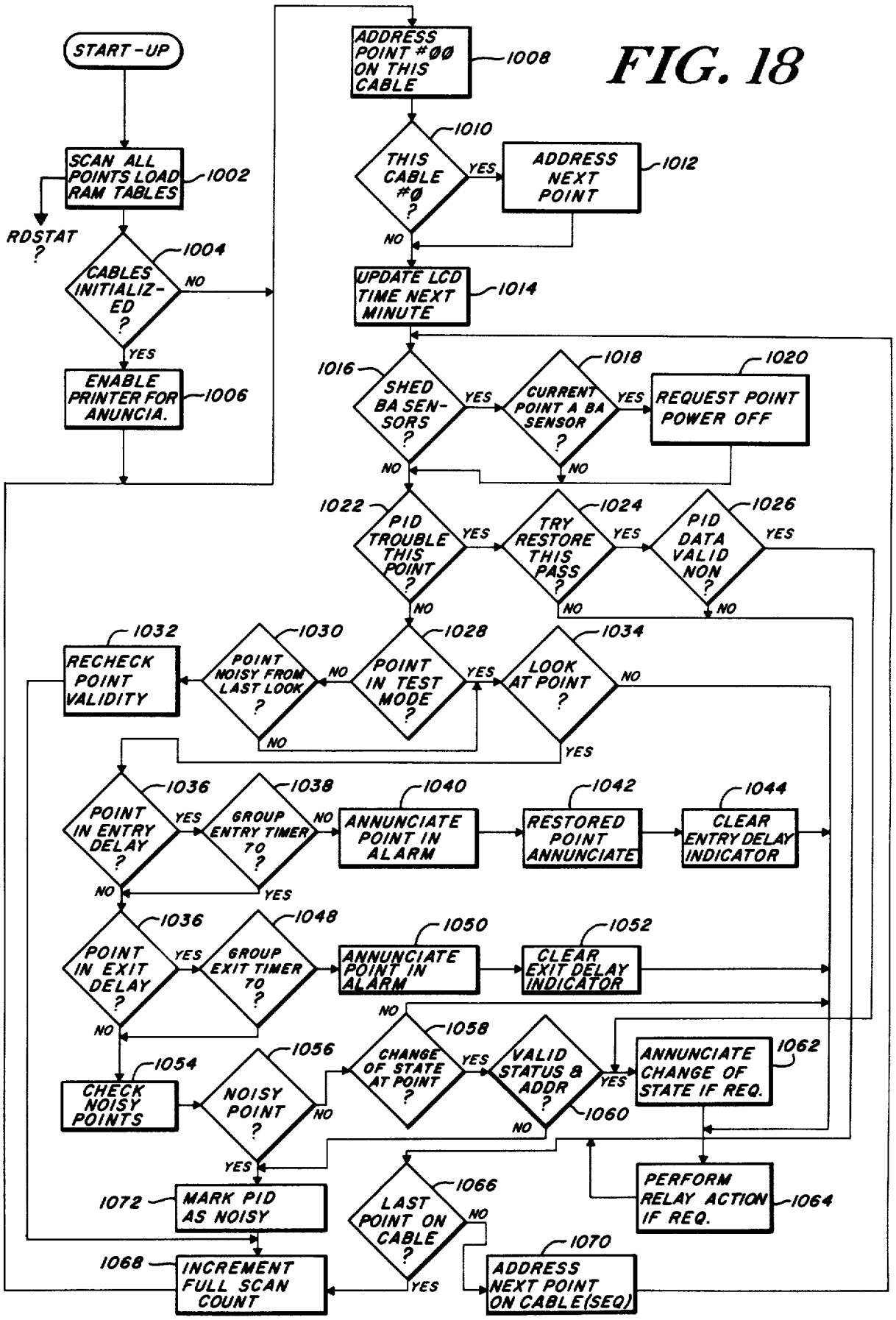
FIG. 18 is a flow chart of the main (MAIN SCAN) program.

The CPU memory space 0000 through 5FFF is allocated to the program memory, described in flow charts of FIG. 18, et. seq., and stored in ROM 221-223 in the diagram of the control unit 200 of FIG. 2. (Space 9000 through BFFF of ROMs 226, 227 are not described here.)

The CPU memory space 6000-6FFF is assigned to vocabulary ROM, which contains the appropriate ASCII codes corresponding to the alphanumeric sequence used for each LCD and printer message produced by the present invention according to the programs shown in FIGS. 18, et. seq.

The CPU memory space 8000-9FFF is allocated for system customization information stored on ROM or programmable ROM (PROM), which may be changed as the user system configuration or functional needs change.

Figure 45:
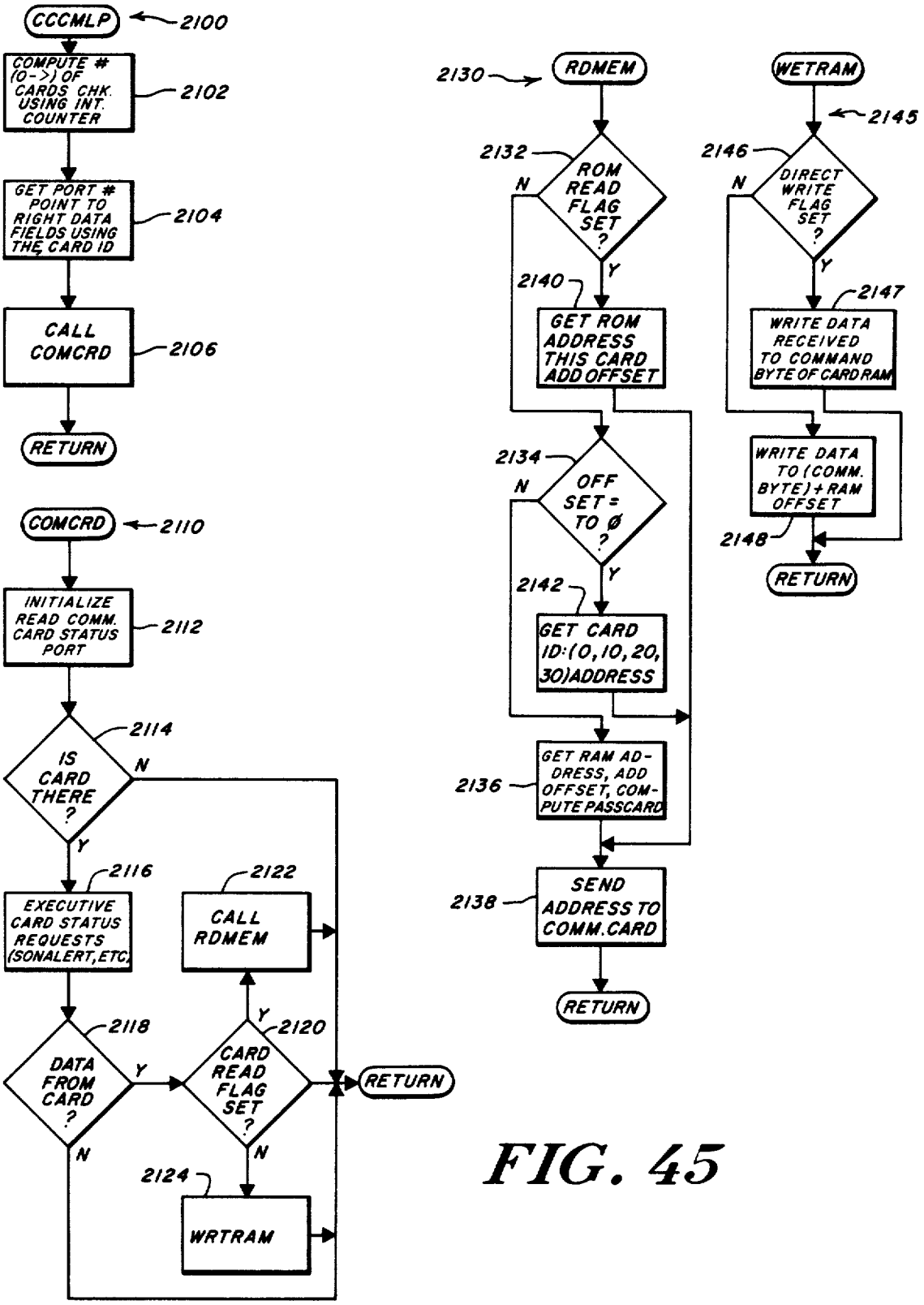
FIG. 45 is a group of flow charts of the communication card interface subroutines (COMCRD, CCCMLP, RDMEM, and WRTRAM).

The CPU memory space A000-BFFF is allocated for communication card software of FIG. 45 and energy management control programs (not shown).

The random access memories (RAM) labelled 241-244 comprise memories which may have their stored information altered upon command by the CPU 202 according to a write signal on the write lead 218, received jointly by all four RAMs on lead 245. The data bus 215 provides the data path for the RAMs which store the data present on the bus 215 when the write signal on the 245 and the address signals received on leads RAM address 247 are received by the respective RAMs, according to operations known in the art. The address signals received on leads 247 comprise the 11 least significant bits of the 16 bits comprising the address bus 216. The selection among the four RAMs is provided by a decoder 249 providing the selection signals 261—264 to the RAMs 241-244, respectively. The decoder 249 typically comprises a commercially available circuit #74138, or comparable device. The decoder 249 is enabled only when a program memory request signal is provided by the CPU 202 over the PMREQ lead 266. Additionally, the decoder 249 provides an LCDEN, or LCD display enable, signal 267 to enable the LCD display circuit 275, shown in more detail in FIG. 12.

The CPU 202 requires a periodic signal, called a clock signal. This signal is generated by a clock circuit 270A which includes an oscillator providing a high frequency signal to the CPU 202 along lead 271. In addition, the clock circuit 270A divides the clock signal so as to provide a signal which is received by the interrupt request PINT lead 272 of the CPU 202. The signal on the lead 272 comprises a periodic pulse and is generated by the divided clock frequency. The signal pulse asserts a latched interrupt signal to the CPU 202. The coincidence of a low signal on the PM1 lead 273 in a logical NOR with a low signal on the PIORQ lead 274 from the CPU 202 acknowledges the interrupt signal. For proper system CPU start-up sequences, the CPU 202 is reset by the switch 250, a reset signal appears on lead 276, connected to the reset pin of the CPU 202 and to the clock circuit 270A. A non-maskable interrupt signal NMI on lead 277 is generated by a monostable multivibrator 278 when a FAIL signal is received on lead 279 from the system monitor circuit 280. The system monitor circuit 280, also discussed in detail in FIG. 14, controls and monitors the elements connected to the system, including the power supplies. The information relating to system monitoring and system control passes on the data leads 281 from the bidirectional data bus 215. Additional system monitor control signals are provided by a system read SYSRD and a system write SYSWR signal on leads 284 from the I/O port decoder circuit 252, shown in more detail in FIG. 9.

Figure 7:
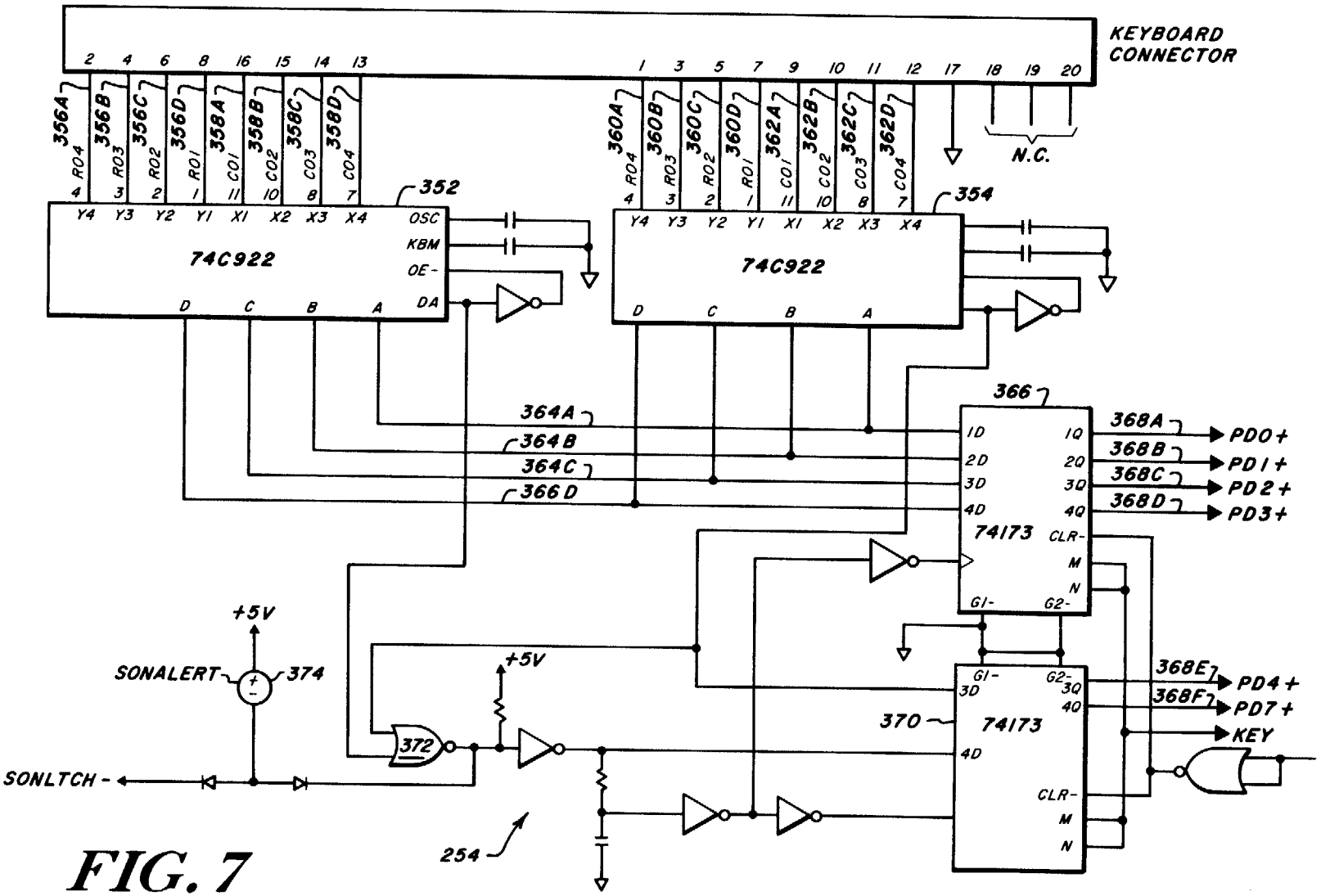
FIG. 7 is a schematic diagram of the keyboard encoder.

The keyboard 254 including the associated decode and encode circuitry, also shown in more detail in FIG. 7, is connected to the data bus 215 and the enable lead 258 from the I/O port decoder 252 so as to provide the proper signal format from the depressed keys on the keyboard to the system data bus 215. Similarly, the light emitting diode (LED) interface 253 is also connected to the data bus so as to receive data therefrom upon the proper signal on the control lead 259 from the I/O port decoder 252.

Figure 9:
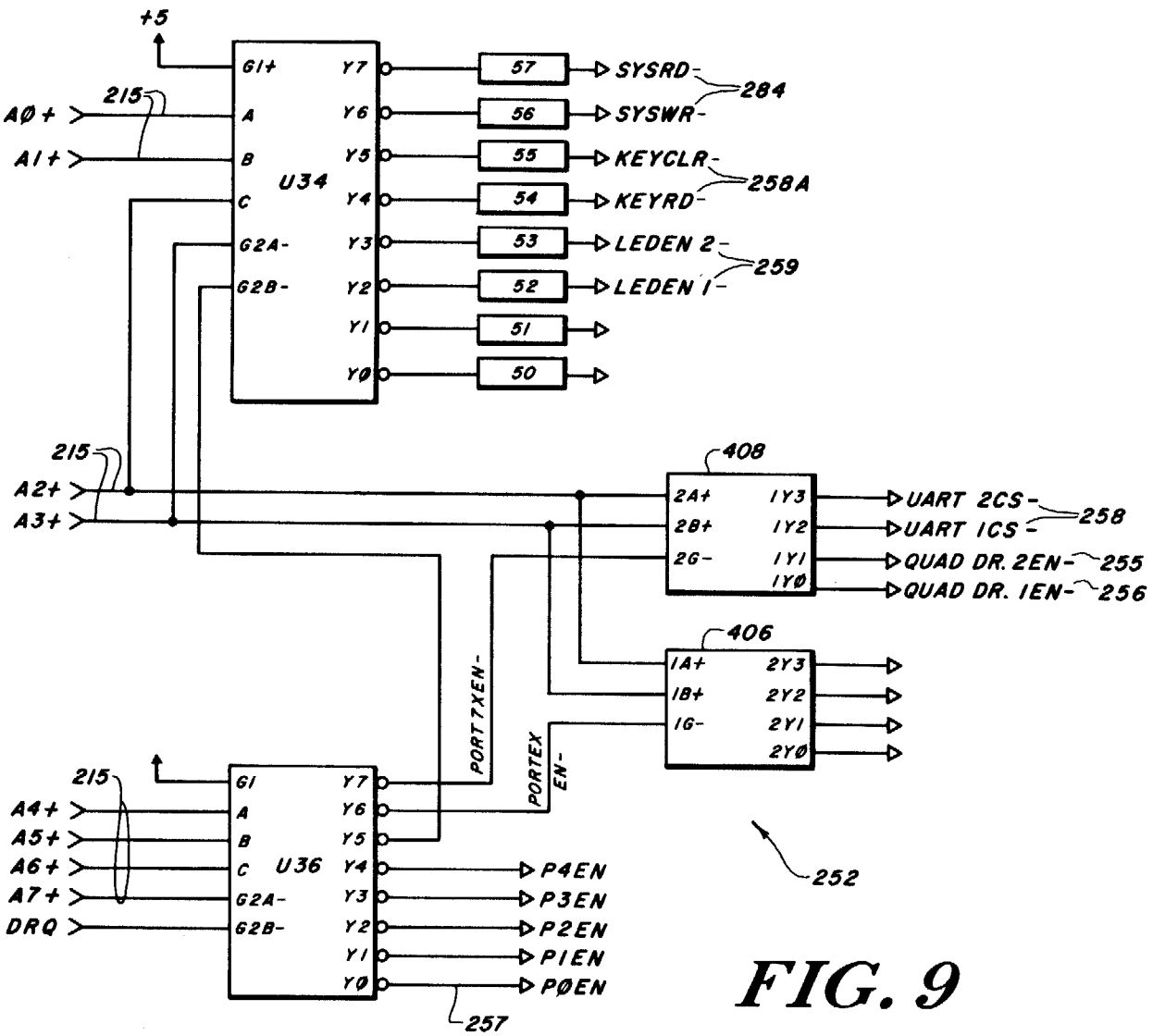
FIG. 9 is the schematic of the I/O port decoder circuit.

The I/O decoder 252, shown in more detail in FIG. 9, receives both the least significant 8-bit address signal on leads 251 from the address bus 216, and the PIORQ signal 274 from the CPU 202 through the buffer 209, as discussed above. Upon the occurrence of the PIORQ signal and PMI complement signal, corresponding to the input/output request state of the CPU 202, the I/O port decoder 252 produces, among others, the system read/write signal on leads 284, the QD2EN signal on lead 255, the QD1EN signal on lead 256, the P0EN signal on lead 257, and the serial port enable signal 258, which is received by the quad cable drivers 290 and 291, the communications card 289, and the serial ports 260. Additional control signals on lead 258 and 259 are received by the keyboard 252 and the LED interface 253, respectively.

Figure 5:
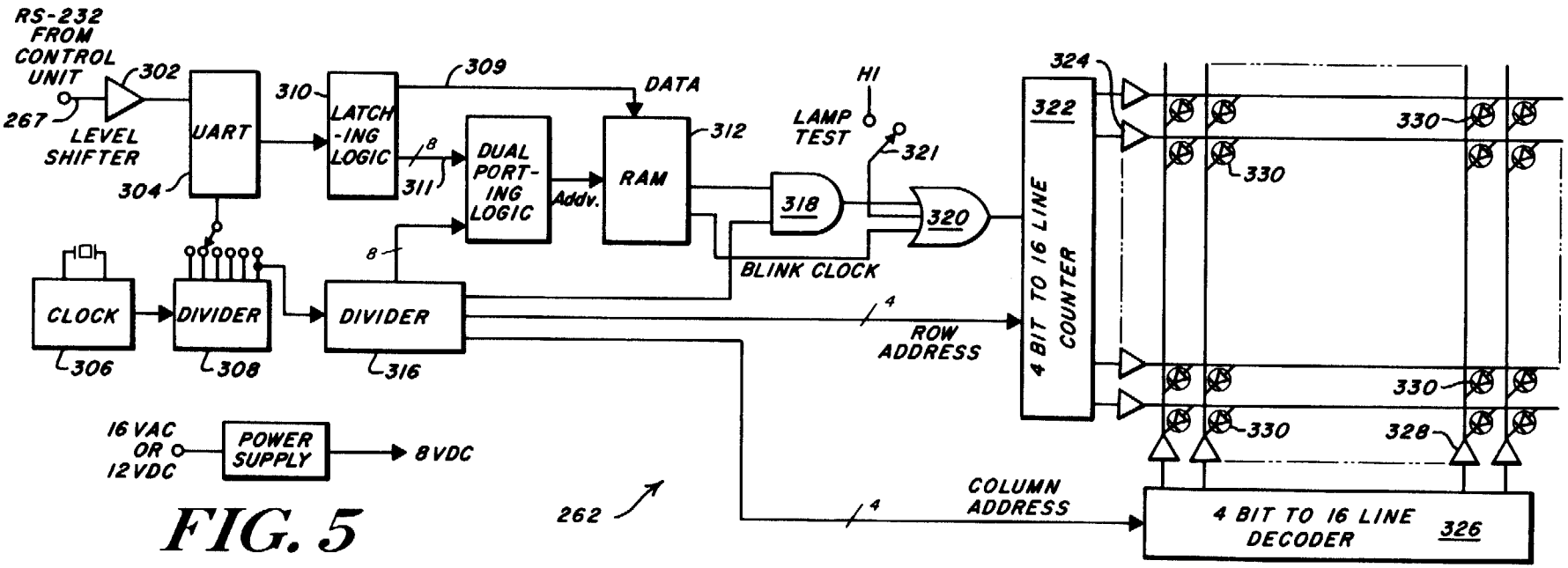
FIG. 5 is a diagram of the matrix display.

The serial port card 260 receives and provides information to the data bus 215 upon the occurrence of the enable signal 258 and the SSEL signals 263 from the system monitor 280. The selection between the printer 261 or the matrix display 262 is determined by the least significant 2 bits on lead from 264 of the address bus 216. The printer 261 is connected to the serial port circuit 260 by serial data leads 265 and 266, corresponding to incoming and outgoing data. Similarly, the matrix display 262, also shown in FIG. 5, is connected to the serial port 260 by leads 267.

Figure 11:
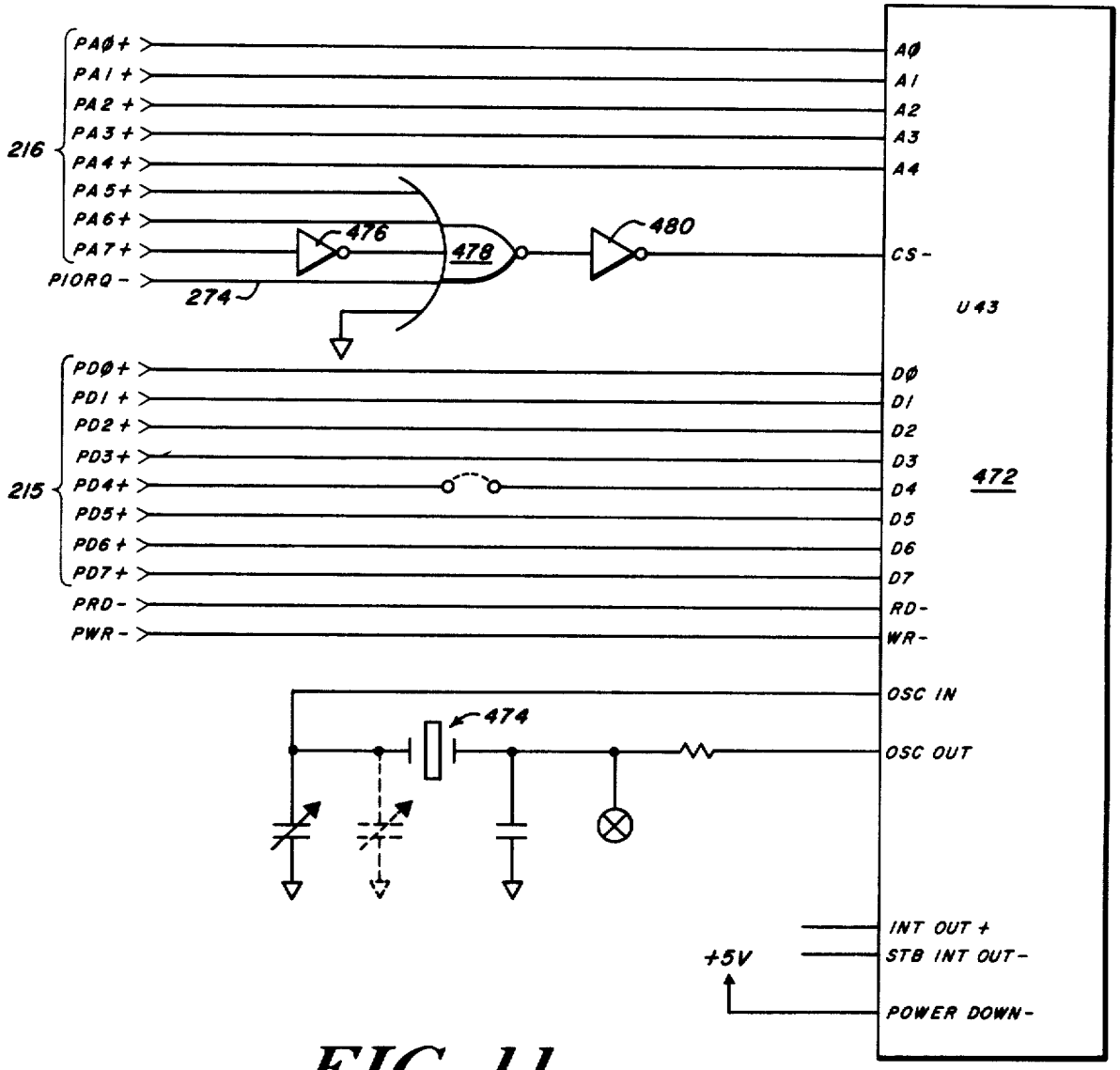
FIG. 11 is a schematic diagram of the real-time clock circuit.

A real-time clock, 270, also shown in detail in FIG. 11, provides the system with a convenient form of encoded standard time intervals over the data bus 215 according to the least significant 8 bits 271A of the data bus 216, and the receipt of the signal PIORQ on the lead 274. The real-time clock 270 also receives the write and read signals on leads 217 and 218, respectively, to allow the CPU 202 to "set" the clock, and thereafter read the present time. The time data provided by the real-time clock is connected to the data bus 215.

The LCD display buffer 275 provides the LCD display 280 with the appropriate signals over leads 279 and is controlled by the LCD enable signal on lead 267 and the 11 least significant bits on leads 276 from the address bus 216. Display data signals are received over the data bus 215 and decoded through the read-only memory 278 before receipt on display 280, coincident with the write signal over lead 218 and the PMREQ signal 266, discussed above. The LCD display buffer 275, the character generator ROMs 278, and the LCD display 280 are discussed in greater detail in FIG. 12.

The system of the present invention communicates to a central station, remote equipment, or external devices (not shown) through the dialer communication card 289, according to a mutually accepted format. Communication cards also considered within the scope of the present invention include standard communications formats other than those on the public telephone signaling system. The communication card 289 receives the data to be transmitted from the data bus 215 and is enabled to read or write according to the coincidence of the read signal on lead 217 or the write signal on lead 218, respectively, with the enabling of the card select line P0EN, from the I/O port decoder 252, discussed above. Additional communication cards (not shown) are connected to the data bus and enabled by additional card select signals on leads P1EN, P2EN, . . . not shown) formed in a manner similar to P0EN, except that different I/O port signals (see Table II) control. The telephone leads 282 and 283 are connected to the appropriate telephone communication terminating unit, as known in the art, or other appropriate communication paths.

The system according to the present invention provides an arrangement of four cables having point interface devices (PIDs) 100A, 100B, . . . per cable, accommodating a total of several hundred PIDs. Each quad cable driver card 290 and 291, accommodates two quad cables, or 128 PIDS per driver card. The quad driver card is also shown in greater detail in FIG. 14, discussed below. The quad cables 292, 293, 294, and 295 comprise four leads each, which include the power and signaling leads, as discussed below. The selection among each of the two quad cables per cable driver is determined according to the least significant two bits on leads 296 and 297 connected to the address bus 216 of the system. Each quad cable driver card 290 and 291 is enabled by the QD1EN signal on lead 256 and the QD2EN signal on lead 255, respectively. The data received or transmitted thereto is provided by the data bus 215.

The external point interface devices (PID) are connected in parallel in plural groups per quad cable, in a configuration as shown in FIG. 3. The first PID 100A is numbered 0, and increases numerically in sequence until the last PID 100B. Subsequent PIDs such as 100C, through 100D, are connected to a second quad cable, 293. The subsequent PIDs are arranged in groups in sequence to the subsequent quad cables 294 and 295.

The matrix display of FIG. 2 is shownnow in greater detail in FIG. 5. The input lead 267 from the serial port circuit 260 receives a signal serial bit stream in the standard RS 232 format, known in the art. The signal is then shifted by a level shifter 302 to a suitable TTL signal level to be received by the universal asychronous receive/transmit (UART) device 304, which provides a parallel 8-bit output corresponding to the serial bit stream input at lead 267. The UART is clocked at a rate corresponding to the serial input at lead 267, such rate provided by a clock 306 whose frequency has been reduced to a submultiple frequency by a divide chain 308. The parallel output from the UART 304 is received and stored by latching logic 310 in anticipation of storage in the data RAM 312. The display signals received on lead 267 includes display data and RAM address signals, and is formatted so that the signals may be separated by latching logic 310. After separation, the signal on lead 309 contains matrix display data, and the 8-bit RAM address signal is on lead 311. The address on lead 311 is received by dual porting logic 314, which, when data is being received through the latching logic 310, is received by the data RAM 312 as the address signal. Thereafter, the data signal received over lead 309 by the RAM is stored therein for subsequent read-out and display on the display matrix. This method allows each particular light emitting diode (LED) 330 comprising the matrix display to be independently and randomly controlled by the CPU 202 through the serial port control 260, discussed below in FIG. 10. To display the information stored within the data RAM 312, the periodic signal from the divider 308 is further divided by a second divider 316, wherein the 8 least significant bits of the divider chain form a sequential address scan to be received by the dual port logic 314. The dual port logic 314 in turn transfers this sequential address scan to the RAM 312, the data output of which is received by a logic gate 318 to combine with a most significant bit of the divider 316 to alternately enable or disable the signal provided by the data RAM 312 to provide a blinking of the LEDs in the matrix. The signal from the logic gate 318 is then combined with the signal from switch 321 by an OR gate 320, wherein the switch 321 provides a lamp test function by forcing all of the LED indicators to be illuminated. The data input and output from the RAM 312 is a single bit (serial) time division multiplexed signal, whose values correspond by position to the 16 rows and 16 columns forming the 256 indicator matrix. The display of the appropriate data bit within the indicator matrix is accomplished by decoding the sequential serial output from the OR gate 320 so that each of the 16 rows receives 16 sequential signal pulses. This decoding is accomplished by a 4 bit to 16 line decoder 322, whose 4 bit input control bits correspond to the least significant 4 bits of the divider 316 output signal. These provide the sequential scan (through buffers 324) of the LED indicators 330 from the topmost to the lowermost row as the data RAM 312 is sequentially accessed to the first 16 data locations and multiples thereof. The columns are decoded by a similar 4 bit to 16 line decoder 326 whose 4 input bits correspond to the next 4 least significant bits above the 4 bits received by the decoder 322. This provides an incremental step from each column after each complete scan through the 16 rows by the decoder 322 by incrementing the 16 column decoder 326 increments after every 16 row sequence of the decoder 322, until all 16 rows and 16 columns are sequentially addressed; thereafter, the cycle repeats. The decoder 322 and the buffers 324 include a circuit to provide a high logic level upon the occurrence of the data level corresponding to an illuminated LED as received from the RAM through the logic gates 318 and 320, coincident with the 4 row addresses provided by the divider 316. The buffers 328 and the decoder 326 provide the opposite, or low logic level corresponding to the respective decoder 16 possible states of the 4 column address bits received by the input of the decoder 326. A matrix is formed from the outputs of buffers 324 and 326 and the LED indicators connected thereto.

Figure 6:
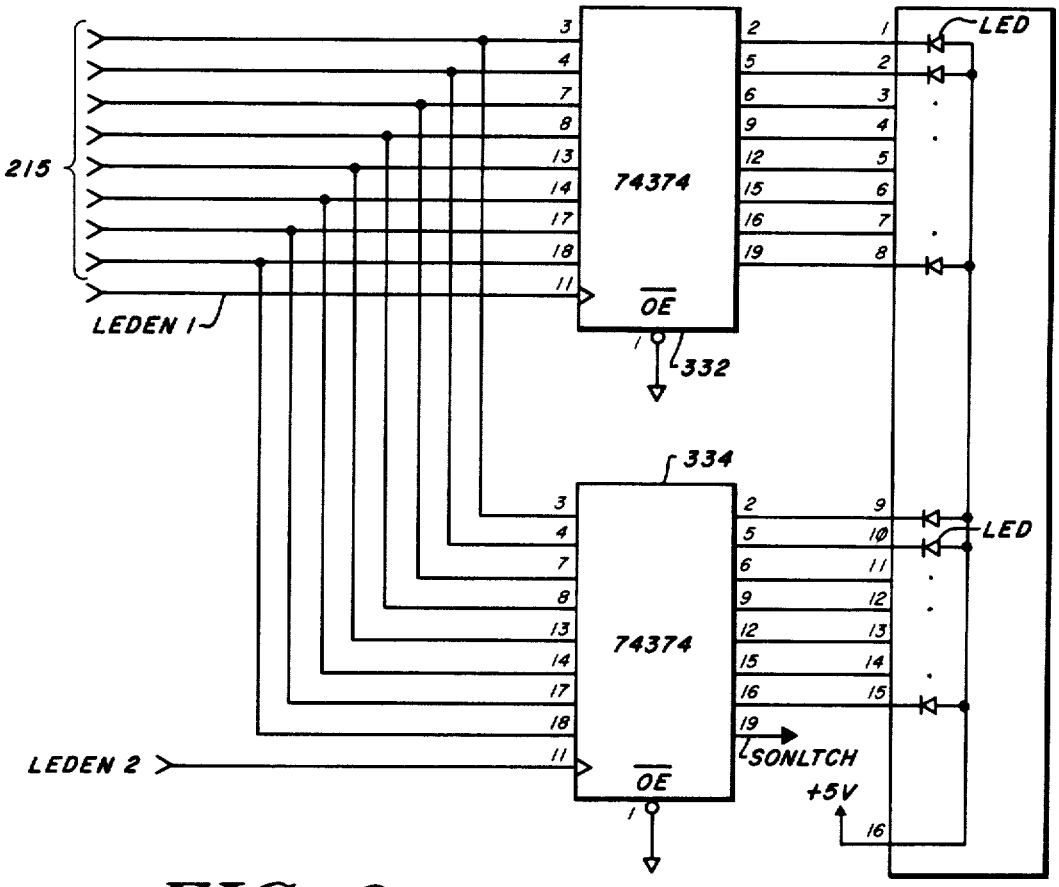
FIG. 6 is a schematic diagram of the front panel status LED decoder.

The status LEDs on the front panel (of FIG. 8) are driven by registers 332 and 334 shown in FIG. 6. The registers 332 and 334 receive data from the 8-bit data bus 215, which is stored in the respective register by the LEDEN1 and the LEDEN2 enable signals, which are generated in the I/O port decoder of FIG. 9.

The keyboard shown graphically in FIG. 7 is arranged to provide two 4×4 matrices of points. Each matrix is received by a matrix driver encoder 352 and 354, respectively. Each display driver encoder 352 and 354 includes two sets of coordinate inputs 356*a* through 356*d*, 358*a* through 358*d*, and 360*a* through 360*d*, 362*a* through 362*d*. These inputs comprise a row and column input to the encoder drivers 352 and 354, respectively. A single front panel keyboard switch (not shown) corresponds to a switch causing one of the row leads to be connected to one of the column leads. A key switch closure between a row lead and a column lead results in a particular unique (binary) signal code at the four output leads of each encoder driver connected together to form leads 364a, 364b, 364c, and 364d. The signals on the output leads are received by a buffer latch 366 which provides a tri-state output on the four output leads connected to the least significant four bits of the data bus 215 of FIGS. 2 and 3. Each decoder driver 352 and 354 also provides a data available (DA) signal indicating when a signal is currently on the output leads 364a through 364d. These two DA signals are received by a register latch 370 which in turn provides a tri-state output connected to the data bus 215 of FIGS. 2 and 3. A NOR gate 372 is connected to provide a signal corresponding to the occurrence of a data available (DA) signal on either 4×4 matrices and is connected to an audible indicator (Sonalert) 374, manufactured by Mallory, Inc., and other manufacturers, providing audible indication thereof. Similarly, the Sonalert is also driven by a particular address location from the LED display discussed in FIG. 6. It is therefore part of the system's operation to indicate an audible alarm by indexing a particular location among the LED display indicator panel.

Figure 8:
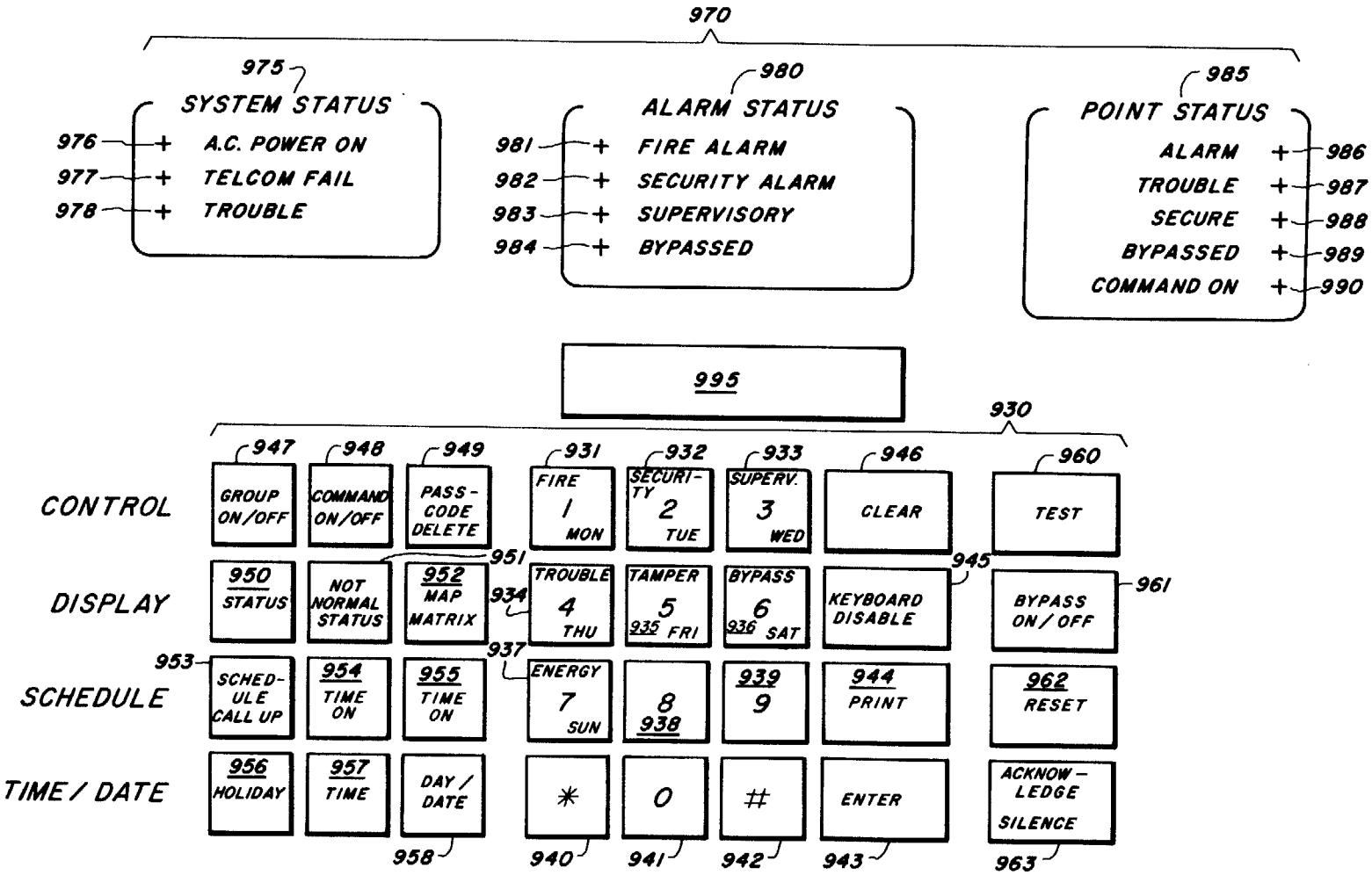
FIG. 8 is a diagram of the front panel of the security system.

FIG. 8 represents the keyboard unit 920. The keyboard unit 920 contains a group of 32 keys 930 used to input passcodes, commands, and status commands. Twelve LEDs 970 and an alphanumeric LCD display 995 show the system status to the keyboard operator.

The keyboard 930 includes keys 931–942 which are used primarily for data input. Keys 943–946 control the keyboard input. Keys 947–949 are Control keys and are used for general control functions. Keys 950–952, the Display keys, are used when the operator desires to see the status of various alarm units. The Schedule keys 953–955 are used by the operator in controlling and confirming the system alarm schedule. The Time/Date keys 956–958 are also used to control the alarm schedules. Keys 960–963 are command keys used by the operator for testing and in responding to alarm signals.

The data input control keys 943–946 are used whenever data is being entered. The Clear key 946 is used when a data entry is wrong. The Keyboard Disable key 956 tells the microprocessor to ignore keyboard commands until a passcode is entered. The Print key 944 has whatever is currently displayed on display 995 printed onto the printer. Enter key 943 is used after each complete data entry.

To alter or examine the alarm schedule, the operator must first enter the system by the appropriate use of the command keys 947–949, in conjunction with data input keys 931–942. If the operator makes an error in the passcode, the entry may be deleted by a Clear key 946. When the correct code is keyed in, the operator would depress the Enter key 943. Thereafter, the operator controls what is displayed on display 995 by using Schedule Call Up key 953 in conjunction with the code of the particular alarm unit he is concerned with. The schedule may be altered by the appropriate use of Time and Date Control keys 954–958. The Day may be entered using the appropriate keys 931–937, each of which represents one day of the week.

The status of any particular alarm unit may be displayed by using keys 950–952 in conjunction with the code of that alarm station being checked.

When the operator calls up via his command keys a particular point, its status is shown on Point Status Board 985. If all is secure, the Secure LED 988 will be on. If the point is not in use, the Bypassed LED 989 will be on. If the command output is activated, the Command On LED 990 will be on. If there is a problem at the point, Alarm and/or Trouble LEDs 986, 987 will turn on, as will the appropriate LED on Alarm Status board 980.

When a change of state occurs at any of the alarms or sensors, the operator must send an acknowledgement of this state change. He accomplishes this by using Acknowledge key 963 in conjunction with the appropriate key 931–937, each of which corresponds to one particular type of alarm or sensor.

The I/O port and decoder 252 of FIG. 3 is shown in greater detail in FIG. 9. The control unit 200 I/O ports are allocated according to Table II, below:

TABLE II

Figure 10:
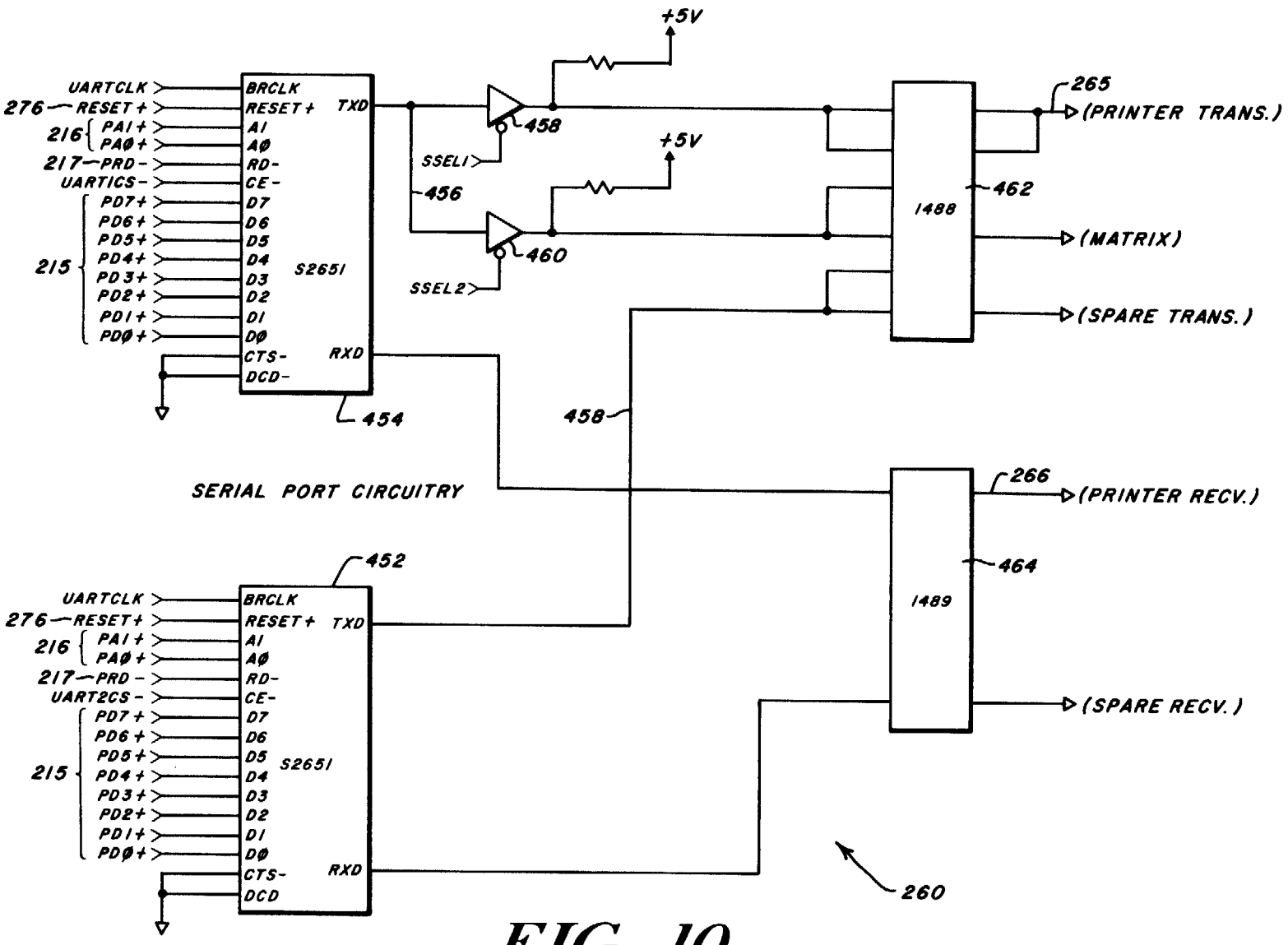
FIG. 10 is a schematic diagram of the serial port circuit.
Figure 13:
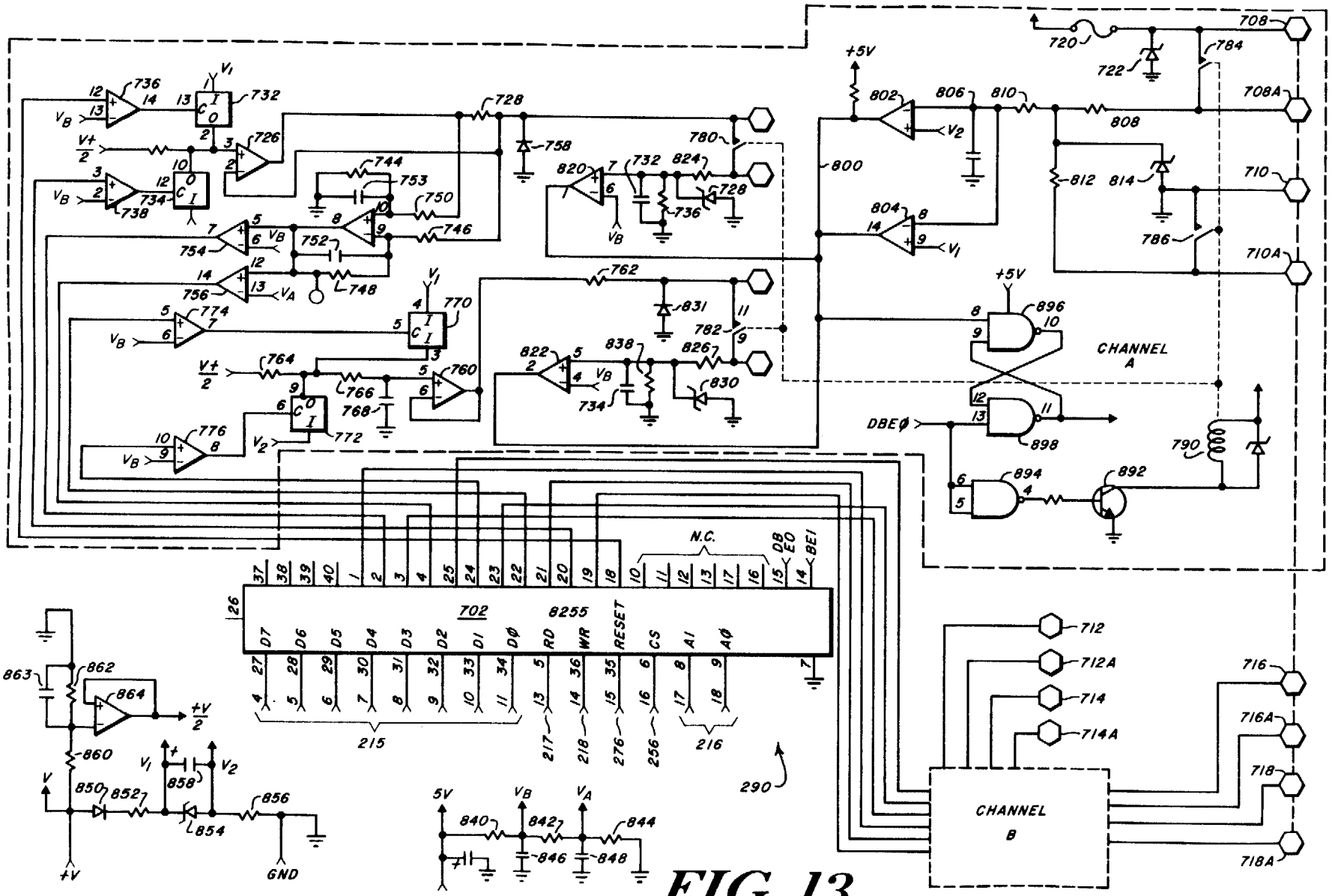
FIG. 13 is a schematic diagram of the quad cable driver circuit.
Figure 14:
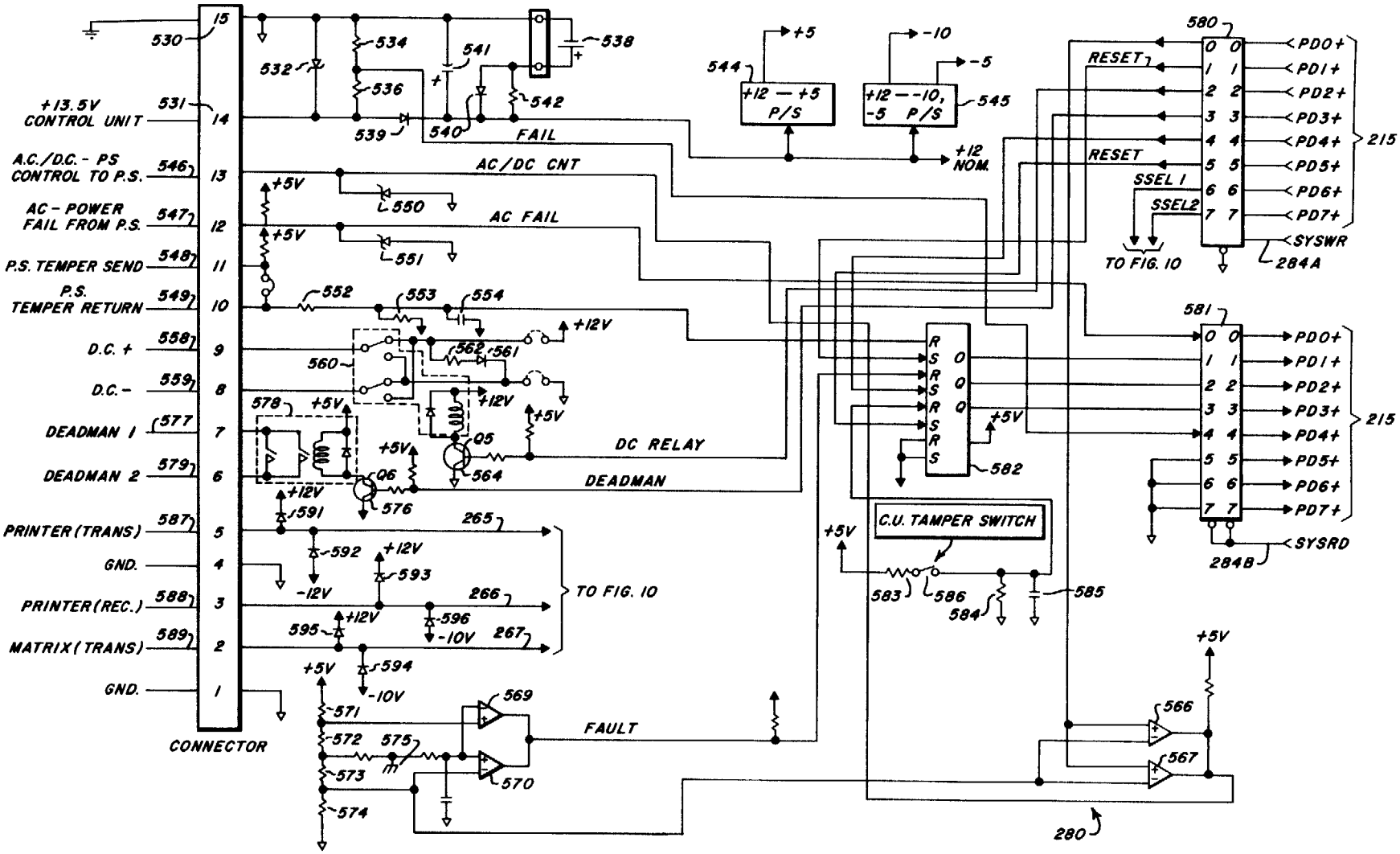
FIG. 14 is a schematic diagram of the power supply and system monitor circuits.

| Port # | Description | FIG. of Corresponding Circuit |
|---|---|---|
| | SYSTEM I/O PORTS | |
| 52 | Point Status LED's | FIG. 6 |
| 53 | System Status LED's | " |
| 54 | Keyboard Input Character/Status | FIG. 7 |
| 55 | Keboard Reset (Clear) | " |
| 56 | System Output to Latches | FIG. 14 |
| 57 | System Input | " |
| | UART | |
| 60 | Read Receive Buffer | FIG. 10 |
| 61 | Read Status Register | " |
| 62 | Read Mode Register #1 | " |
| 62 | Read Mode Register #2 | " |
| 63 | Read Control Regisler | " |
| 64 | Write Transmit Buffer | " |
| 65 | Write Status Register | " |
| 66 | Write Mode Register #1 | " |
| 66 | Write Mode Register #2 | " |
| 67 | Write Control Register | " |
| | Quad Cable Driver A (Cables 0 & 1) | |
| 70 | Data From Quad Driver | FIG. 13 |
| 71 | Data To Quad Driver | " |
| 72 | Data To Quad Driver | " |
| 73 | Quad Driver Control Word to Parallel Chip) | " |
| | Quad Cable Driver B (Cables 2 & 3) | |
| 74 | Data From Quad Driver | FIG. 13 |
| 75 | Data To Quad Driver | " |
| 76 | Data to Quad Driver | " |
| 77 | Quad Driver Conrtol Word | " |
| | Hardware Clock | |
| 82 | Second | FIG. 11 |
| 83 | Minutes | " |
| 84 | Hours | " |
| 85 | Day of Week | " |
| 86 | Date in Month | " |
| 87 | Month | " |
| 95 | Clock Go Signal | " |

The address leads 215 and the PIORQ lead 274 are received by 3-bit to 8-line decoders 402 and 404, respectively. Decoder 404 provides the following enable signals: SYSRD, SYSWR, KEYCLR, KEYRD, LEDEN2, and LEDEN1. Decoder 402 provides the enable signals PORT 0X EN, PORT 1X EN, PORT 2X EN, PORT 3X EN, to be received by the communication cards, as well as the PORT 4X EN and the 5X EN signal received by decoder 404. Additionally, PORT 6X EN and PORT 7X EN are received by 2-bits to 4-line decoders 406 and 408, respectively. These decoders, when enabled by the enable lines provided from decoder 402, generate the following enable signals: UART 2CS, UART 1CS, QUAD DR 2EN, and QUAD DR1EN.

The serial port circuitry 260 of FIGS. 2 and 3 is seen in greater detail in FIG. 10. The data bus leads 215, the PRD lead 217, the UART 1CS and the UART 2CS leads 268 are all received by universal asynchronous receiver transmitters (UARTs) 252 and 254. The UART 252 and 254 each provide a transmit signal 456 and 458, respectively. The transmit signal 456 is switched between the printer 261 or the matrix display 262 by the selection of the buffers 458 and 460 according to the SSEL1 and the SSEL2 signals generated by the system monitor 280 logic, shown in FIG. 14. The signals resulting from the buffers 458 and 460 are received by transmitter 462 which provides the required RS 232 voltage swing. The resulting output signal on lead 265 is received by the printer. The printer input at lead 266 is received by a RS 232 buffer 464, which in turn produces the appropriate digital level receive signal which is received by the receive input of the UART 454. The serial signals produced by the transmit side and received by the input receive side of the UART 454 are processed according to the UART operation, generally known in the art. Similarly, the UART 252 also provides the serial output signal on leads 458 as buffered by the RS 232 drivers 462, providing an auxiliary transmit output signal. The auxiliary receive input signals is received by the serial buffer 464 which produces a digital level appropriate to be received by the receive input of the UART 452. The auxiliary UART input and output signals are used for additional area controls, such as for energy management system controls (not shown). The UART devices are typically achieved by a single integrated circuit, in the present embodiment, a part number S2651 provided by either National Semiconductor or Signetics. The transmit driver 462 is typically a part number 1488; the serial receiver 464 is a part number 1489. Both the number 1488 and number 1489 are provided by several sources and commonly available and serve to translate the signal from (or to) a TTL to (or from) an RS 232 format.

In FIG. 11, the real time clock 270 of FIG. 3 is shown in greater detail. The real-time clock 472 comprises a single integrated circuit device generating a time base from a single crystal 474. The real-time clock also receives as inputs the least significant 8 bits of the address bus 216, the 8-bit data bus 215, the system read signal lead 217, the system write signal lead 218, and the PIORQ lead 474, to receive a time "set" signal to initialize the clock 270, and to provide the appropriate time signals on the data lead as requested according to the address signals received by the real time clock 472. The gates 476, 478, and 480 form a logical combination to provide a chip select enable signal to the real time clock device 472 by a combination of the 6th, 7th, and 8th least significant address bits and the PIORQ signal 274 provided therein. The real time clock device 472 is a part number MM58167A made by National Semiconductor of Santa Clara, Calif., and provides a plurality of time and day indication signals according to the address signals derived from the system address signals derived from the system address bus 216. However, other discrete or software program generated real-time clock apparatus are also within the scope of the present invention.

Figure 12:
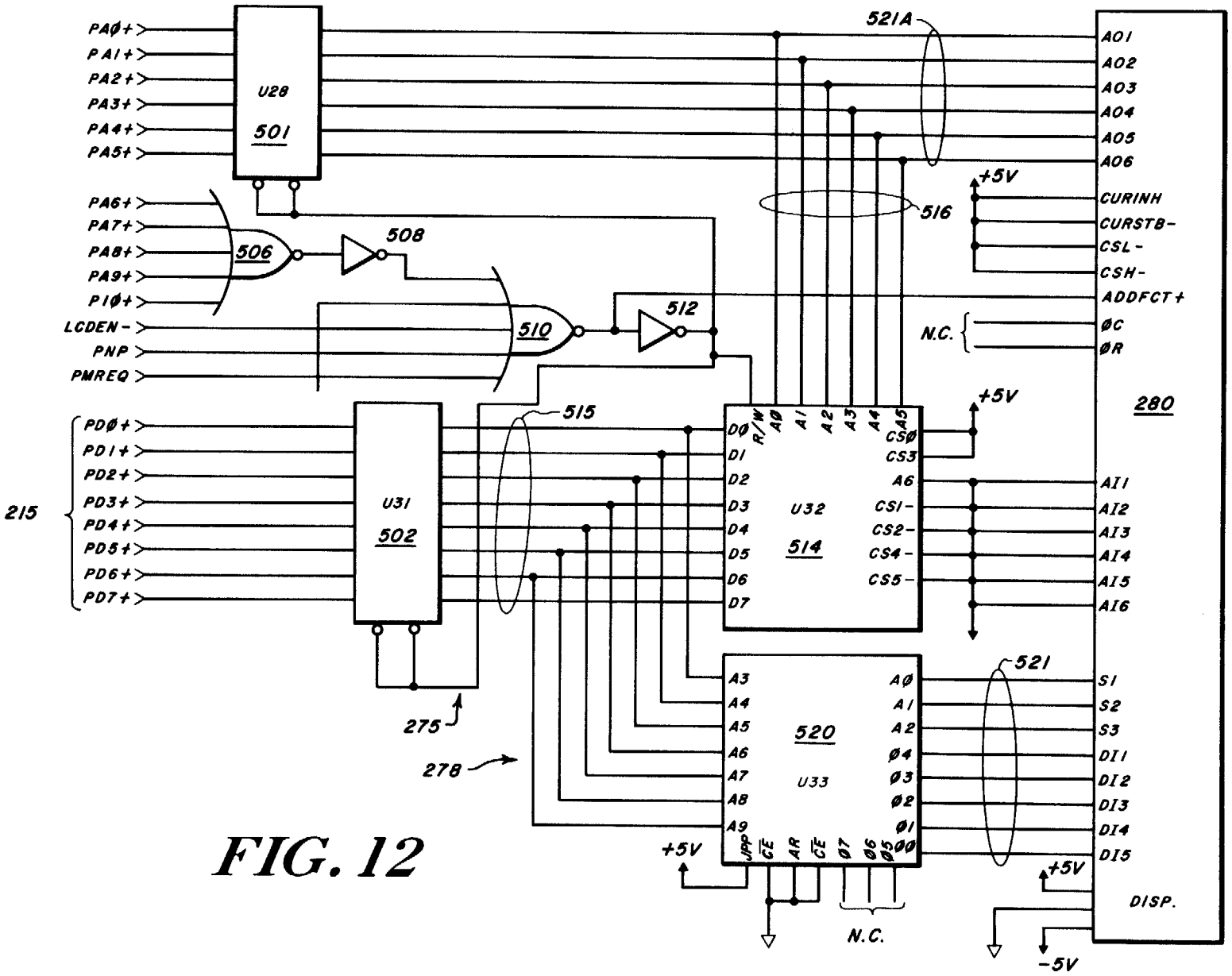
FIG. 12 is a schematic diagram of the liquid crystal display (LCD) circuit.

The LCD display buffer 275, the encoder memories 278, and the LCD display 280 is shown in greater detail in FIG. 12. Buffers 504 and 502 receive the address signals and the data signals from the address and data buses 216 and 215, respectively. Furthermore, gates 506, 508, 510 and 512 logically combine the 7th through 11th least significant bits of the address bus 216 with the LCDEN signal on lead 267, the system write signal PWR 218, and the PMREQ signal on lead 266 to form an enable signal on lead 525 to be received by both of the tri-state buffers 504 and 502. The signals received through the buffers 502 and 504 are temporarily stored in the scratchpad RAM 514 which is used in a configuration of $128 \times 8$ bits. The 8-bit (parallel) data signal is received by the RAM 514 along data input/output leads 515 from the buffer 502. The 6-bit address signal is received by RAM 514 on leads 516 from the buffer 504, and the data signals stored in the RAM 514 are subsequently received from the system of FIGS. 2 and 3 and loaded into the RAM 514. Thereafter, the information stored is sequentially read through a decoder ROM 520 which converts the 8-bit wide stored information from ASCII code to the 7 segment display code received by the display 280 on leads 521. The scanning of the orthogonal display coordinates on leads 516 simultaneously with incrementing of the address of the scratchpad RAM 514 aligns the message data with the appropriate display position. Therefore, the information stored within RAM 514 is read out synchronously with the selection of the appropriate display numeral position. The LCD display comprises an LCD module 280 made by EPSON America, of Torrance, Calif. The module provides tri-state address output lines 521A, received by RAM 514. The RAM 514 provides the message data on leads 515 which are received by ROM 520 to convert the data from ASCII to [positionally] inverted 7-segment LCD, as received by LCD module 280 on leads 521. Other display fonts are envisioned and may be used with an appropriate decoder ROM 520.

The communication card 289 of FIG. 3 in the general system receives information through a programmable interface circuit having internal data transfer determined according to the interface circuit hardware and internally programmed software (not shown).

The dual quad driver card 700 shown in FIG. 13 contains two channels, channel A and channel B, wherein each of the channels provides the sufficient driving and receiving circuitry for one quad cable. The quad cables are in turn connected to a plurality of PID devices. The operation of channel A and channel B are substantially identical, differing only in the address of their signal data path from the processor described in FIG. 3. The transfer of data between channels A and B and the processor system of FIGS. 2 and 3 is accomplished by way of a programmable peripheral interface 702, wherein the signals received from the channels and transmitted thereto are temporarily stored in internal memory locations until the data and addressing sequences provided by the processor system require the addressing and service of those memory locations. The operation of the programmable peripheral interface 702 is typically included within a single integrated circuit, such as a part number 8255 circuit manufactured by Intel and other manufacturers. The four leads on the quad cable, the signal (S), command (C), power (D), and ground (G) leads, are connected at one end to terminals 704, 706, 708, and 710, respectively. The opposite end, when the cable is configured in a loop to provide a redundant connection, is connected to connections 704*a*, 706*a*, 708*a*, and 710*a*, respectively. Analogous connections of the quad cable to the channel B driver of the quad cable driver card 700 are made to terminals 712 through 718 and 712*a* through 718*a*, respectively. Power for the cables is provided from a positive power supply voltage through a 2 amp fuse 720 and then to the terminal 708. The power supply voltage is bypassed by a transient suppressor 722. The cable ground at terminal 710 is connected to the card ground. The signal lead of the quad cable, as connected to terminal 704, is driven by the amplifier 726 through a series resistor 728 through which the cable current is measurable. The inverting input of the amplifier 726 is connected to the cable side of the resistor 728 so that the voltage on the cable may be maintained at the desired voltage, established by the non-inverting input of the amplifier 726. The nominal amplifier 726 input voltage is the reference V/2 voltage received through a series resistor 730. The voltage excursion of the S-lead to a positive (H) or a negative (L) voltage (relative to V/2) V1 and V2, is made through controllable switches 732 and 734, respectively. The switches are controlled by amplifiers 736 and 738 which operate as comparators having a reference voltage of VB volts at their inverting inputs. The non-inverting inputs of the amplifiers 736 and 738 receive digital signals from the programmable peripheral interface 702, which operate as signal level translators to translate the signal voltage swing from a 0 to +5 volt range to a 0 to +V voltage range, as required by the switches 732 and 734, control inputs. The switches 732 and 734, according to this implementation, are CMOS bilateral switches, typically a part number CD4066 manufactured by RCA of Somerville, N.J., and other manufacturers. The amplifier 740 is connected in a differential amplifier configuration to measure the voltage developed across resistor 728, being responsive to the current variations through the signal (S) lead connected to the signal terminal 704 according to the current variation signals transmitted by each PID 100. The resistors 742, 744, 746, and 748 are connected to form a differential amplifier, according to techniques known in the art. Capacitors 750 and 752 give the differential amplifier a low-pass characteristic so as to suppress conducted EMI transient noise voltages across resistor 728. Also, due to the delay of several microseconds of the PID circuits in returning a signal, the filter provided by capacitors 750 and 752 also delays the derived current signal formed from the amplifier 740 so that false signal pulses produced by the PID before the logic circuits therein settle, are ignored. The output of amplifier 740 is monitored by amplifiers 754 and 756 whose inverting inputs are connected to reference voltages of VB and VA, respectively. The output of amplifier 756 indicates that the differential amplifier 740 output has a signal in excess of VA, as generally formed when a single PID device properly returning a signal on the signal lead connected to terminal 704. However, when additional PID devices are reporting simultaneously, as would occur when their address selectors are improperly set, or when the signal (S) is bypassed by a device not conforming to the PID signal format the amplifier 754 output indicates that the signal of the amplifier 740 has crossed a threshold of VB, corresponding to an excessively high return signal current on the signal(s) lead from the PID devices. The signals from the amplifier 754 and 756 are in turn received by the programmable peripheral interface 702, for transmission back to the control unit 200 of FIGS. 2 and 3. The terminal 704 is also bypassed by a transient suppressor 758 for transient suppression thereupon.

The quad cable C-lead connected to terminal 706 is driven by amplifier 760 through resistor 762 which limits the maximum current produced on the lead connected to terminal 706 and matches the cable impedance. The amplifier 760 is connected as a voltage follower and receives a nominal voltage of V/2 through resistors 764 and 766, and bypassed by capacitor 768 to ground. A C-lead voltage swing about V/2 of plus or minus several volts is provided by switches 770 and 772, respectively. These switches are controlled by amplifiers 774 and 776, whose inverting inputs are referenced to a VB volt supply, derived below. The noninverting inputs of the amplifiers 774 and 776 are connected to the programmable peripheral interface 702 wherein they receive data from the processor system of FIGS. 2 and 3. The amplifiers 774 and 776 act as signal voltage translators which translate a TTL signal of 0 to +5 volts to a voltage range of 0 to +V, +V typically being between 12 to 16 volts. The switches 770 and 772 are typically CMOS switches, part number CD4066, as mentioned above. The amplifiers herein described thus far are typically standard operational amplifiers, part number LM324 by National Semiconductor Corp. of Santa Clara, Calif., and other manufacturers.

The terminals 704, 706, 708, and 710 are connected to terminals **704*a*, 706*a*, 708*a*, and 710*a* through relay terminals 780, 782, 784, and 786, respectively, upon closure by energizing the relay coil 790. The coil that causes both ends of the cable to be driven is energized by driver transistor 792 and gate 794 with signals derived from the system through the programmable peripheral interface 702. The system 200 can determine whether or not a cable break has occurred by the no-cable-break signal derived from a bistable flip-flop formed from NAND gates 796 and 798. The no-cable-break signal is a high condition on the lead 800 which provides a wired-OR path of several comparator outputs, which determine the continuity of the individual cable leads connected thereto. A voltage relating the continuity of the D and G-leads is formed on lead 806 by resistors 808, 810, and 812, and a Zener diode 814 such that the continuity of both the cable at terminals 708 to 708*a*, and the ground leads of terminals 710 and 710*a*, must be maintained to provide a signal (at 806) between the voltage window limits of V1 and V2. The comparators 802 and 804 are connected to detect the existence of a threshold voltage within a particular window defined between voltage V1 and V2. The threshold voltage is received on lead 806 of the amplifiers 804 and 802. If either the ground cable (G) or the power cable (D) develops an open circuit, one of the comparators 802 and 804 will pull the voltage on lead 802 to a low state, indicating a defective cable, and triggering the flip-flop formed by gates 796 and 798. Then, the no-cable-break signal will be in the false state. The comparators 820 and 822 are connected to appropriate circuitry to monitor the cables 704*a* and 706*a* wherein the circuitry and the amplifier provides a true signal whenever voltage levels exist within the signaling range of V1 to V2. If a cable were broken, there would be no active signaling on the cables 704*s* and 706*s*, and the circuitry associated with amplifiers 820 and 822 would detect the lack of signaling thereupon. Specifically, the signal from terminal 704*a* is received by the comparator 820 through resistor 824, where the signal voltage developed is limited by Zener diode 828. The resulting signal voltage developed across resistor 824 is temporarily stored in capacitor 732 which is subsequently discharged slowly over time by resistor 736. Therefore, if the signal on lead terminal 704*a* ceases, the resistor 736 will discharge the capacitor 732, causing the non-inverting input voltage of the comparator 820 to fall below the VB reference voltage, causing the comparator output voltage to fall to a false level. The signaling on terminal 706***a* is similarly monitored through resistor 826 by the non-inverting input of the comparator 822. The capacitor 834 is charged by the voltage developed through resistor 826 as limited by Zener diode 830. When the signaling on 706*a* stops when the cable is broken, the voltage developed across capacitor 834 is discharged by resistor 838, causing the non-inverting input to fall below the VB volt reference level. Thereafter, the output of the comparator 822 will fall to a false state, as above in comparator 820, causing the flip-flop formed by gates 796 and 798 to change the no-cable-break signal to the false state. The comparators discussed herein are typically a part number LM339 available from National Semiconductor and other sources.

The VB and VA references are developed by a voltage divider between the +5 V to ground voltage by resistor 840, 842, 844, and bypass to ground by capacitors 846 and 848. The voltages V1 (H) and V2 (L) are developed by a voltage divider formed across the +V volt source, the divider comprising a diode 850 in series with resistors 852 and 856 with Zener diode 854 connected to ground. Diode 850 matches the reverse voltage blocking diodes used in the point interface devices, described below. The Zener diode 854 provides a difference between V1 and V2 of several volts. The voltage divider is bypassed by capacitor 858 across the junctions forming V1 and V2. The +V/2 voltage is provided by a voltage divider comprising resistors 860 and 862 in parallel with capacitor 864; the voltage resulting is buffered by amplifier 864 to provide a low impedance reference voltage of +V/2.

The system monitoring circuit and battery stand-by circuit 280, shown in greater detail in FIG. 14, also includes connection to the power supply 282 of FIG. 2. The integrated security system of the present invention receives 13.8 volts of power at terminals 530 and 531 which are in turn connected to internal power distribution circuitry, and are bypassed by a transient suppression diode 532. The power leads are then shunted by two resistors 534 and 536 connected in series at their junction, and forming a voltage divider which creates a +5 volt signal when the power is supplied. This signal is received by a tri-state buffer 581, discussed further below. When the applied external power is removed while the system is in operation, the circuitry described herein automatically connects a stand-by battery 538 to the power supply distribution systems within the processor; the indicator signal formed at the junction of resistors 534 and 536 indicates the lack of voltage applied to the unit at terminals 530 and 531, and the system maintains operation to report the loss of power through the audible and visual displays discussed above. The cut-over of power from the external source of the internal battery is provided by diodes 539 and 540 connected to form a current path which enables either source to supply power to the system. When the external power is applied, resistor 542 bypasses diode 540 to provide a charging current to the battery 538. The resulting nominal +12 volt power supply is bypassed by capacitor 541. The power supplies indicated as 282 in FIG. 2 comprise two separate power converters operating from the derived +12 volt nominal signal discussed above. The first of these comprises a switching power supply 544 providing a high efficiency regulated +5 volts from the +12 volt input voltage. The second of the power supplies comprises a switching power supply 545 providing a −10 volt output and a regulated −5 volt output to be used by the systems described above. Switching power supplies are preferred because of their high efficiency and low heat dissipation. However, other power supplies or power sources may be used as desired and are considered within the scope of the invention. The 13.8 volt power received by terminals 14 and 15 is provided externally by a power supply (not shown), where the external power supply produces external alarm signals on leads received by the system monitoring circuit 280. These external alarm signals include the power supply control signal on lead 546, the AC power fail signal on lead 547, the power supply tamper on lead pair 548 and 549. The leads 546 and 547 are bypassed by transient absorbers 550 and 551, which have a sharp V-I knee and fast response time, and are typically diodes such as General Semiconductor Industries part number 1.5 KE 18. The signal on lead 547 is received by the tri-state buffer 581. The signal on lead 549 is received by a network comprising resistors 552 and 553 and capacitor 554, forming a low-pass noise filter, and then stored in a set/reset flip-flop 582. A 12 volt power source is provided at terminals 558 and 559 through a relay at 560 which comprises a pair of double pole/double throw contacts connected to provide a reversible polarity at the terminals 558 and 559. The relay is connected to the +12 volt supply, and its coil is bypassed by a diode 561 through resistor 562 for transient suppression. The relay polarity change is determined according to the signal received by the driver transistor 564. The signal is provided through tri-state buffer 580, discussed below. The power supply control signal on lead 546 is derived from comparators 566 and 567 connected in parallel to act as signal level translators. The comparators receive at their non-inverting inputs an AC/DC control signal from the tri-state buffer 580. The inverting inputs of the comparators 566 and 567 are connected to about +1 volt from a voltage divider between the +5 volt power supply formed by resistors 571, 572, 573, and 574. The voltage divider nodes between its constituent resistors are connected to comparators 569 and 570 so as to determine whether the chassis ground 575 has a voltage within the range of roughly 1 volt to 4 volts, as determined by the values of the voltage divider resistors 571 through 574. When the chassis ground exceeds the range of 1 to 4 volts, the comparators 569 and 570 outputs indicate a fault condition, which is received by a flip-flop storage element 582. Normally, chassis (earth) ground is floating relative to signal (system) ground; however, a 2.5 volt bias is imposed on it by the voltage divider described above. If one of the quad cable conductors is shorted to chassis ground, the 2.5 volt signal is overridden, forcing the fault alarm when the cable bias goes outside of the 1 to 4 volt range provided. A deadman signal is provided by the system of the present invention when an alarm is annunciated and is not responded to by the operator within a specified time. The deadman signal, as provided by the tri-state buffer 580, is received by a driver transistor 576 which in turn drives a relay 578 to provide a contact closure on terminals 577 and 579. The contact closures may be used to annunciate to a distant station the failure of the operator to respond within a certain time. The printer leads 265 and 266, and the matrix lead 267 from the serial port circuitry of FIG. 10, are bypassed by diodes 591, 592, 593, 594, 595, and 596 to the +12 volt and −10 volt supplies to limit the excursion of the signals present on those leads to be maintained within the power supply range of the control unit, preventing external signals to be induced on the leads to cause failure of the components of this present system. A control unit tamper signal is generated by a switch 586 connected to a network comprising resistors 583 and 584 between the +5 volt and ground signals, and bypassed by capacitor 585 for noise suppressing. The resulting tamper signal is received by the latch 582. The signals received by the latch 582 may be transient signals very short in duration; therefore, the latch 582, operating in a set/reset mode, is necessary to maintain the indication of the trouble condition by storing the transient signals until they are placed on the data bus 215 by the operation of the tri-state buffer 581; subsequently, the latch 582 is reset, clearing the trouble signals. The buffer 581 is enabled by the SYSRD signal 284 from FIG. 9, the I/O port decoding circuit, to place the latch 582 output signal on the data bus 215. Similarly, the data received from the data bus 215 is received by tri-state latch 580. These signals comprise the AC/DC control signal, the power supply tamper reset signal, the DC relay control signal, the deadman signal, the fault reset signal, and the control unit tamper reset signal; the select signals SSEL1 and SSEL2 also generated in the system monitor and control circuit 280, are received by the circuit in FIG. 10, which directs the outgoing transmitted serial data from the UART 454 shown in FIG. 10 to either the matrix 262 or the printer 261.

The point interface device (PID) 100 is physically located on the premises of the remote communication area. The PID signals the status of several indicators over the connecting cable trunks which are initiated from the control unit. The PID monitors status of several signals and turns sensors or mechanical devices on or off. Typical of the point status signals are alarm, trouble, tamper, PID trouble, bypass, secure and relay output signals. The point status signals are connected to several separate pins of the PID circuit from external circuitry. The status information signals are stored and transmitted to the central unit.

Figure 17:
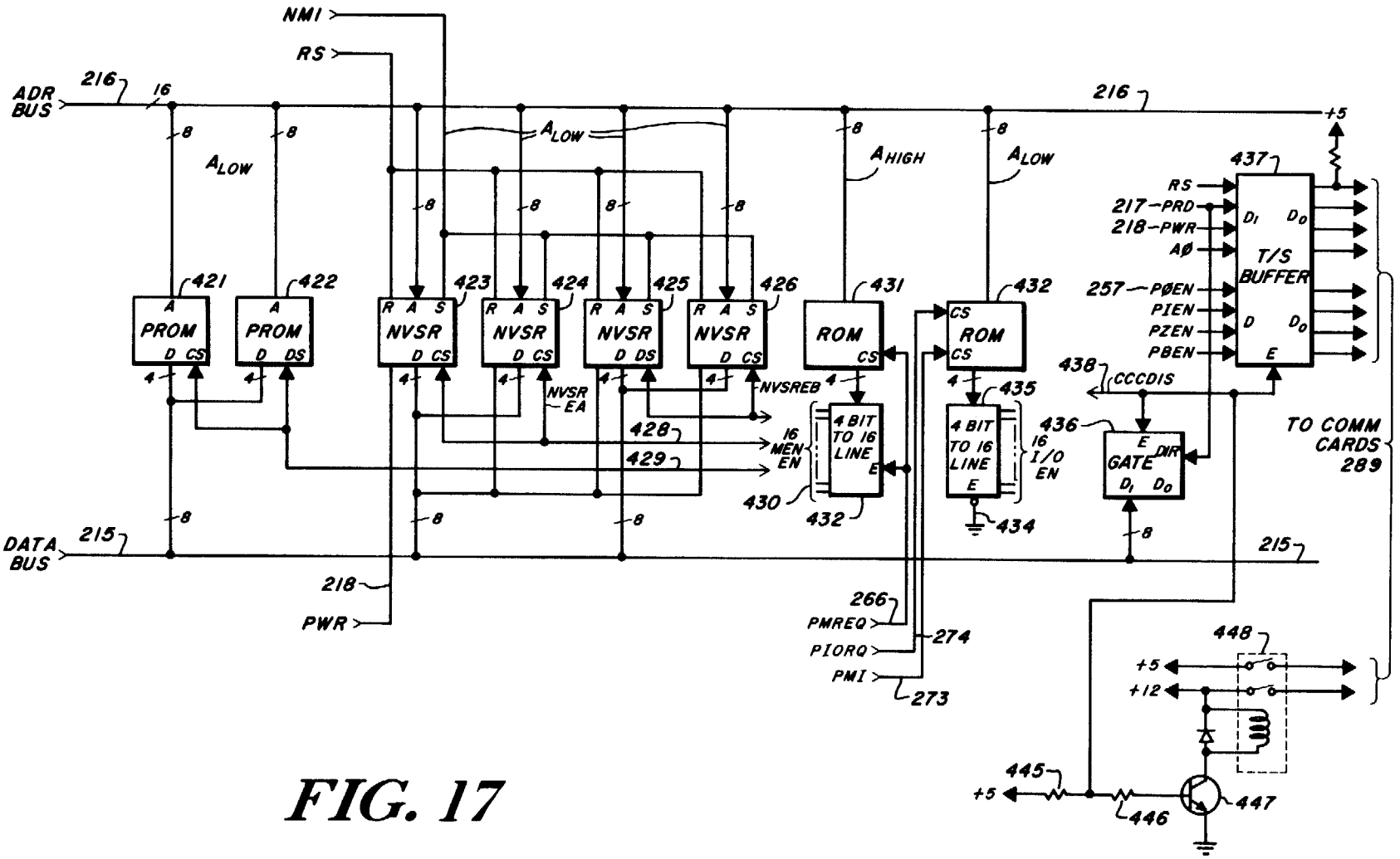
FIG. 17 is a schematic diagram of additional and optional elements of the control unit of FIG. 2 and FIG. 3.

Additional elements and alternate embodiments of the control unit 200 are shown in FIG. 17. It is within the scope of the current invention to store operator passcodes in two PROMs, 421 and 422, each comprising 256×4 bits. A suitable type of PROM is the 74S287 made by Texas Instruments of Dallas, Tex. The two PROMs are paired for interfacing to the 8-bit data bus 215, and the address bus 216. The PROMs receive an enable signal from the memory selector, discussed earlier on lead 429, or from the alternate memory enable selector device 432, discussed below.

Nonvolatile static RAMs (NVSR) are used to store temporary information during a power failure. The NVSR 423, 424, 425, and 426 are connected to the data bus 215 and the address bus 216, as are the memory devices discussed above. In addition, the NVSRs receive the write signal on lead 218, the reset signal on lead 276, and the nonmaskable interrupt signal on lead 277 from the control unit of FIG. 2. These signals cause the data to be written into the NVSRs, to be reset, and to be stored upon power failure according to the operations known to the nonvolatile RAMs. A suitable type of NVSR is the part number XD2212, a 256×4 bit device made by Xicor of Sunnyvale, Calif. Four NVSR devices 423, 424, 425, and 426 are arranged in a 2×2 matrix resulting in a 512×8 bit array. The NVSRs are selected according to a signal on the NVSREA lead 428 and the NVSREB lead 427 connected to the memory selection devices discussed above, or to the alternate selection device 432 discussed below. Each device contains a volatile RAM which is written into and read from in normal operations, and a nonvolatile store which holds the data for several years.

Alternate memory selection decoding is shown comprising a programmable read-only memory 431 as a look-up table which receives an 8-bit address from the address bus 216 to decode that to a 4-bit control line 441. The 4-bit control line 441 is received by a 4-bit to 16-line decoder 432 providing a selection among 16 output leads 430 directed to specific memory devices, such as RAMs, ROMs, PROMs, and NVSRs, as discussed above. The element 431 and 432 are enabled according to the memory request signal on lead 266, supplied from the control unit of FIG. 2. An alternate I/O device selection element is shown comprising a PROM 433 functioning as a look-up table to receive an 8-bit address from the address bus 216 and provide a 4-bit output code 442 which is in turn received by a 4-bit to 16-line decoder 435. The decoder 435 produces a singular selection among 16 leads connected to respective I/O devices, such as provided by the system of FIGS. 2 and 3 above. The decoding devices suggested here comprise an alternate approach to the earlier described method using a direct decoding of the address schemes using integrated circuits such as a 74138 or 74139. Suitable PROMs 431 and 433 include devices such as 74S287; a suitable 4-bit to 16-line decoder is the part number 74154.

It is desirable to add or remove communication cards to the system without disruption of the function thereof. Therefore, a communication card disable interface is formed by circuits 436 and 437 which selectively enable the necessary control, data and power leads to the respective communication cards. The communication card disable interface is controlled by a disable signal on lead 438, derived from the I/O selector, discussed above. When in the active state, the disable signal 438 causes the tri-state 437 and gate 436 to interrupt the flow of signals on the leads connected to the communication cards. The CPU 202 will monitor the cover tamper switch discussed in FIG. 14 so that when the cover is open, the communication cards are disabled by the action of the disable lead 438. Upon detecting that the cover has been closed after servicing, the disable lead 438 changes state to re-enable the communication cards.

Software System Implementation

The control unit and associated system hardware described above operate under the control of two main software programs. The first program shown in FIG. 18, which includes the subroutine shown in FIG. 19, selects among and performs several independent operations or tasks of the system. The second program is the interrupt service program, shown in FIG. 20, wherein the operations of the hardware system receiving external data and transmitting external data and control signals are synchronized according to a hardware interrupt. Since there is only a single central processor unit 202, the hardware interrupt takes precedence over the other system programs when it occurs; however, during the intervening interrupt time period, the general system program services all internal (to the control unit) system operational needs. The combination of the first and second program according to the present invention further provides independent control and monitoring of the following tasks according to a predetermined task priority. The highest priority task is the monitoring and control of the four cables, wherein the lowest numbered cable has the highest priority among the four cables. At the next level of priority, the system provides the keyboard data entry and the message printout functions as additional independent functions which generally occur after the cables are properly serviced by the program. Furthermore, system self-monitoring and other general system functions are maintained at a still lower priority level. The software system implementation as described below interleaves the above-mentioned functions in the appropriate priority, as well as provides for the execution of particular I/O operations on the respective signal leads of the control unit hardware of FIGS. 2 and 3 at integral units of the hardware interrupt time period.

As the PIDs are scanned, according to the programs described in FIG. 18, et. seq., the specific information relative to each PID necessary to determine the system operation is read from the (P)ROM devices containing the system customization space, including memory locations 7000–8FFF hex. The memory space is allocated according to the Table III, shown below:

TABLE III

| BYTES (decimal) | NAME | CUSTOMIZATION ROM SPACE |
|---|---|---|
| 0001–4096 | ZNNMWD | 16-character name descriptor for each point (PID) in security system |
| 4097–4099 | SENINF | 3 bytes of information on each PID:<br>(1) SENSOR priority (1 bit set per PID)<br>BIT: Ø - Fire alarm<br>1 - Superviser/Danger<br>2 - Hold Up Alarm (HUA)<br>3 - Security-Break in Alarm (BA)<br>4 - Supv. BA/FA<br>5 - Supv. Miscellaneous<br>6 - Electrical/Mechanical (EM)<br>7 - Command Output point<br>(2) BIT: Ø - 24-hour (fixed) alarm<br>1 - Exit delay<br>2 - Entry delay<br>3 - Redundant sensor<br>4 - Command Output point<br>5 - Daytime Annunciation sensor<br>6 - Latching sensor<br>7 - Keyswitch<br>(3) Area number containing this point - for group actions |
| 4100–4379 | PDLSTB | List of points distributed to each of 8 possible security groups. The PDLSTB is a table of 8 addresses (16 bits) which indicate the point number of the first sensor in the group. Additional sensors in the group will follow in sequential memory bytes. The end of each of the 8 list is marked by a repetition of the last point number in the list. A group containing no points (a non-exiting group) is indicated by a list containing only the number 255D. |
| 4380–4387 | GRPROM | Information about each BA group with 1 byte per group:<br>BIT: Ø - Schedule exits for group<br>1 - Group has keyswitch<br>2 - (Not used)<br>3 - Multiple exits allowed from group<br>4 - Bypass never allowed in group<br>5 - No bypass allowed when this group is secured<br>6 - Multiple accesses allowed in group during one scheduled access period<br>7 - group exists |
| 4388–4395 | GPRDLS | One byte per group indicating with which groups this security group is redundant. All groups are redundant with themselves. The (n-1) bit is set to indicate a group is redundant with group #n. |
| 4396–4587 | OKPSCD | Passcodes valid for this installation. 5 digit passcode followed by 1 digit indicating to what group that passcode has access. This 6th digit is a number from 1–9, 1–8 being a specific group #, 9 means a passcode has access to all security groups. These passcodes are ordered user #1 to user #32. User #1 is the janitor passcode, users #30, 31, and 32 are service personnel. The other 28 passcodes are subscriber passcodes. |
| 4588–4971 | PRMSCD | Security group schedules, each of 8 BA groups, can have an 8-day schedule 3 on time 3 off times per day. See Appendix A for Schedule table description. |
| 4972–5227 | TAGTBL | One byte for each point to indicate a relay # to activate when sensor point alarms. A Ø in the TAGTBL [table] means no relay is activated by alarms at point. |
| 5228–5235 | GPONRL | One byte for each security group, indicating relay # to activate when corresponding group is secured. |
| 5236–5243 | FA1REL | One byte for each possible FA group which contains relay # to activate (if any) when alarm occurs in this group. |
| 5244–5251 | SD1REL | One byte for each possible Supervisory danger group for relay # for alarms in this group. |
| 5252–5259 | HUA1RL | One byte for each possible Hold Up group for relay # upon alarms in each group. |
| 5260–5267 | BA1REL | One byte for each security group for relay # activated upon alarms in group. |
| 5268–5275 | FABARL | One byte for each FA/BA Supervisory group for relay # activated upon alarms in group. |
| 5276–5283 | SUPARL | One byte for each Supervisory Misc. group for relay # activated upon alarms in group. |
| 5284–5289 | EMA1RL | One byte for each Electrical/Mechanical group for relay # activated upon alarms in group. |
| 5290–5297 | TYPREL | One byte for each priority type to contain relay # (if any) to be activated any time a sensor of that priority type alarms. |
| 5298 | RDWIN1 | First redundant time window, length of time (0–255 minutes) system waits after first redundant sensor alarms for verification by 2nd redundant sensor. |
| 5299 | RDWIN2 | 2nd redundant time window, length of time (0–255 minutes) following a successful redundant verification during which subsequent redundant alarms require no verification. |
| 5300 | EX1DLY | Exit delay length (1–255 seconds) during which exit alarms are not transmitted to allow exit from building at night. |
| 5301 | FNTDLY | Entry delay period (1–255 seconds) length of time entry sensor alarms are held to allow subscriber to access alarm |

TABLE III-continued

| BYTES (decimal) | NAME | CUSTOMIZATION ROM SPACE |
|---|---|---|
| | | system upon opening. |
| 5302 | MAXCBL | The number of quad cables used in the ISS4 system. The 4 possible cables are numbered Ø to 3. |
| 5303 | CBØ MAX | Maximum point address on quad cable Ø |
| 5304 | CB1MAX | Maximum point address on quad cable 1 |
| 5305 | CB2MAX | Maximum point address on quad cable 2 |
| 5306 | CB3MAX | Maximum point address on quad cable 3 |
| 5307 | PCDLOK | Not Ø if subscriber can delete passcodes |
| 5308 | ACBELL | Not Ø = Audible alert desired on loss of AC power |
| 5309 | BASHOP | Not Ø = Security sensors shed on low battery |
| 5340 | DMTMOP | Not Ø = 60 seconds without acknowledgement of LCD message throws deadman relay on ISS4 control unit |
| 5341 | ISKYBO | Not Ø = keyboard timeout option in effect |
| 5342 | SPRCOP | Relay # to activate when first redundant sensor (the supressed one) trips |
| 5343 | HOSTCD | Single digit preceeding valid passcode which cases hostage message transmit to Central Station. |
| 5344 | TSCHFG | Not Ø = Temporary BA schedule changes are erased at midnight following day in which they are used. |

The ON/OFF time schedules for the BA Groups (Ø–7) are in PROM. This schedule is transferred into RAM to allow temporary changes to be programmed. The table's format will be 2 bytes for each ON/OFF combination, with up to 3 combinations per day in an 8-day sequence, ordered MTWTFSSH, where H is the Holiday schedule. Since only 15-minute time increments are allowed in the schedule, the format for storing each time will be:

BIT 0–4 : number of hours (hex)

BIT 6–7 : number of 15-minute increments (hex)

A value of ØFFH in a time location will indicate no schedule exists for that period. The time schedule table will have 6 bytes per day per Group. For 8 days, there are 48 bytes per Group; therefore, 8 Groups require 384 bytes for the entire BA schedule, as shown by Table IV, below:

TABLE V

| | | | | | | |
|---|---|---|---|---|---|---|
| Group Ø: | MON1OFF, | MON1ON, | MON2OFF, | MON2ON, | MON3OFF, | MON3ON |
| | TUE1OFF, | TUE1ON, | TUE2OFF, | TUE2ON, | TUE3OFF, | TUE3ON |
| | WED1OFF, | WED1ON, | WED2OFF, | WED2ON, | WED3OFF, | WED3ON |
| | THU1OFF, | THU1ON, | THU2OFF, | THU2ON, | THU3OFF, | THU3ON |
| | FRI1OFF, | FRI1ON, | FRI2OFF, | FRI2ON, | FRI3OFF, | FRI3ON |
| | SAT1OFF, | SAT1ON, | SAT2OFF, | SAT2ON, | SAT3OFF, | SAT3ON |
| | SUN1OFF, | SUN1ON, | SUN2OFF, | SUN2ON, | SUN3OFF, | SUN3ON |
| | HOL1OFF, | HOL1ON, | HOL2OFF, | HOL2ON, | HOL3OFF, | HOL3ON |
| Group 1: | MON1OFF, | MON1ON, | MON2OFF, | MON2ON, | MON3OFF, | MON3ON |
| | TUE1OFF, | TUE1ON, | TUE2OFF, | TUE2ON, | TUE3OFF, | TUE3ON |
| | WED1OFF, | WED1ON, | WED2OFF, | WED2ON, | WED3OFF, | WED3ON |
| | THU1OFF, | THU1ON, | THU2OFF, | THU2ON, | THU3OFF, | THU3ON |
| | FRI1OFF, | FRI1ON, | FRI2OFF, | FRI2ON, | FRI3OFF, | FRI3ON |
| | SAT1OFF, | SAT1ON, | SAT2OFF, | SAT2ON, | SAT3OFF, | SAT3ON |
| | SUN1OFF, | SUN1ON, | SUN2OFF, | SUN2ON, | SUN3OFF, | SUN3ON |
| | HOL1OFF, | HOL1ON, | HOL2OFF, | HOL2ON, | HOL3OFF, | HOL3ON |
| Group 2: | Same as above | | | | | |
| Group 3: | : | | | | | |
| Group 4: | : | | | | | |
| Group 5: | : | | | | | |
| Group 6: | : | | | | | |
| Group 7: | : | | | | | |
| Group 8: | Same as above | | | | | |

Figure 15:
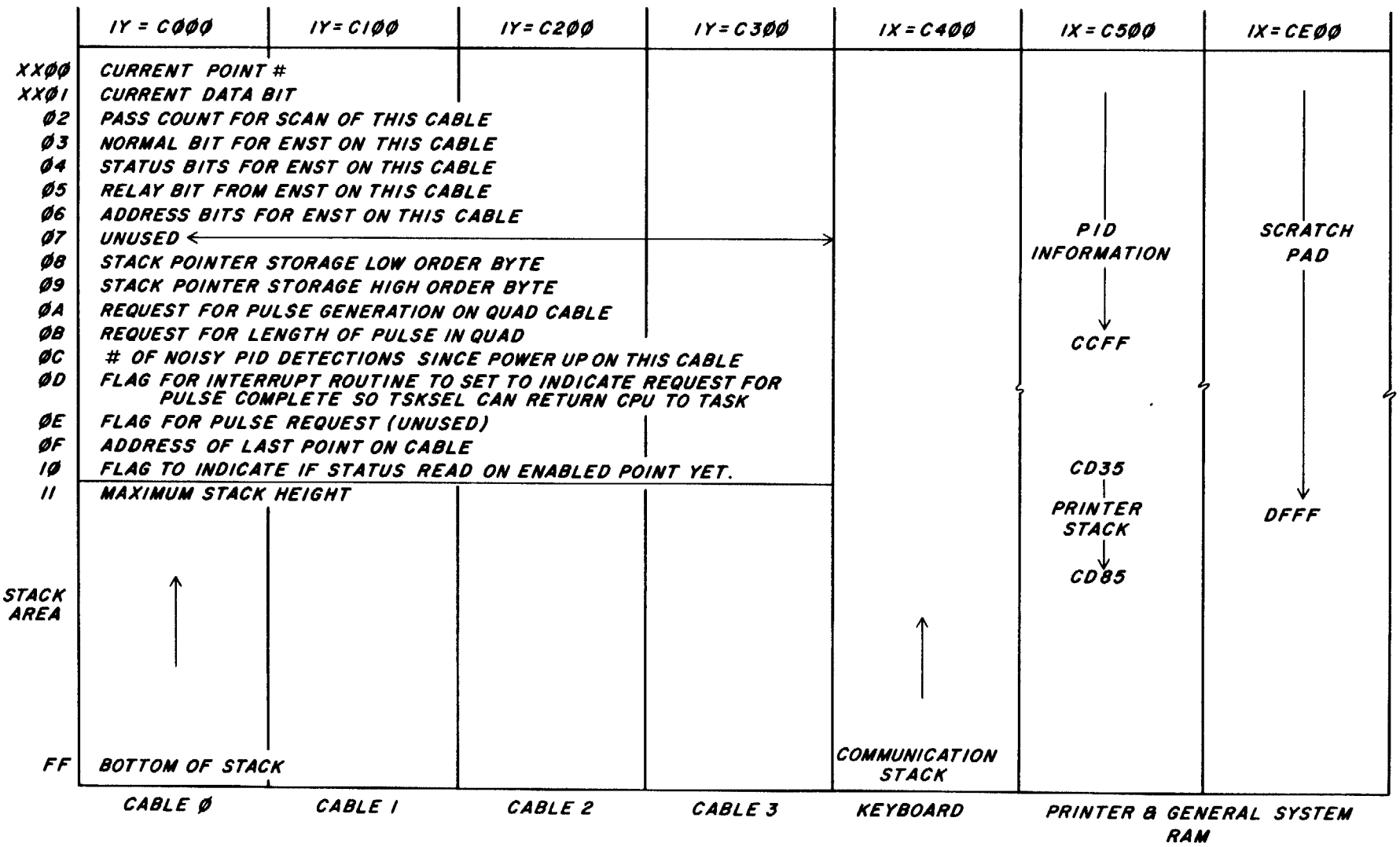
FIG. 15 is a memory space map of the random access memory (RAM) stack allocations for information transfer according to the multiprocessing function.
Figure 16:
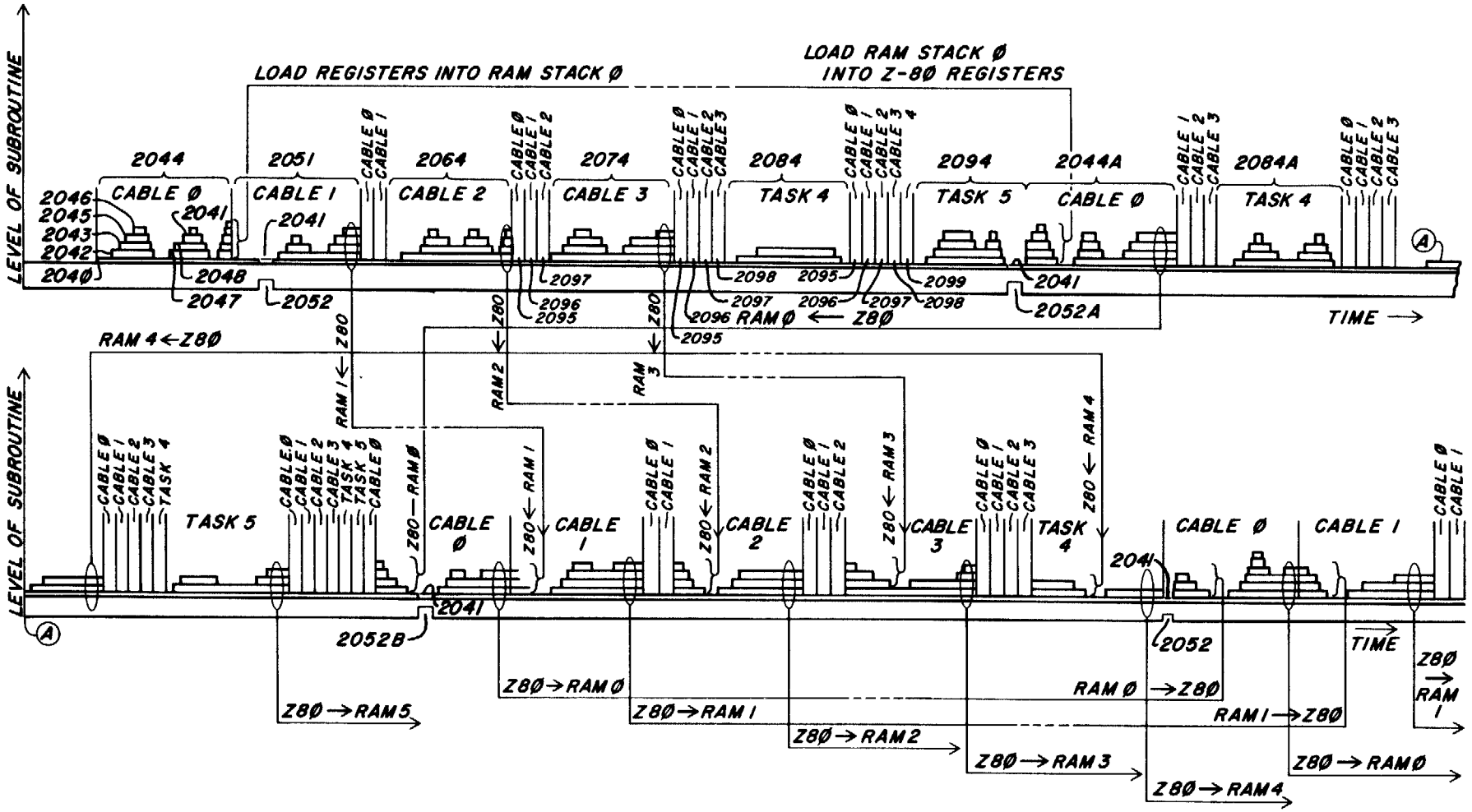
FIG. 16 is a function timing diagram of the multiprocessing and task selection process of the present invention.

The priority determining the correct sequential operation of seven separate tasks through one hardware CPU 202 is shown in FIGS. 16 and 18. FIG. 15 shows the RAM memory space mapping of the data associated with each of the seven separate tasks, in separate sections of the RAMs 241–244 shown in FIG. 2 of the control unit hardware configuration. The information stored in the RAMs is retrieved by providing to the CPU 202 (Z-80) processor IX registers the addresses corresponding to the desired data, as shown in the register drawing FIG. 4, discussed above. Although the particular embodiment of the present invention uses a Z-80 microprocessor as the CPU 202, the use of similar microprocessors or computer equipment with analogous register organization is envisioned and within the scope of the present invention. Each portion of the RAM space dedicated to a particular task function spans an address increment of 100 hexidecimal (hex) address locations, beginning at an address of C000 hex for the first location of the first task (cable 0). The last memory location for the first task is C0FF hex; the first position of the next task (cable 1) is then C100 hex with a last location of C1FF hex, and so forth. Within each task memory space, the memory addresses having the least significant digits in the numeric sequence from 11 hex to FF hex comprise a memory area known as the memory stacks. The memory stacks receive the content of the CPU 202 registers, including starting addresses and return addresses of subroutines called whenever the particular subroutine or program currently operating requests an external input/output (I/O) operation, as discussed below. The memory space locations 00 hex through 10 hex retain the necessary information as required by the particular subroutines in operation according to the information in the task stack between locations 11 hex through FF hex. The locations 00 hex through 10 hex, are identical in nature for each of the first four tasks, and are shown along the left-hand margin of FIG. 15 as address locations XX00 through XX10; the value XX corresponds to C0, C1, . . . , C4 for each of the seven tasks performed by the system of the current invention.

Specifically, the RAM relative locations 00 and 01, corresponding to the current point (PID) number and the current data bit number (within each PID), are used by the MAIN SCAN program, discussed in FIG. 18 below. The RAM location 02 corresponds to the pass count for the scan of this current cable, as used in the SCAN8 subroutine of FIG. 33. The normal bit data on location 03 hex is used in the RDNOR subroutine of FIG. 28. The status bits of location 04 hex correspond to the information used in FIG. 27 of subroutine RDSTAT. The relay bit stored in location 05 hex corresponds to the information shown in subroutine RDREL of FIG. 29. The location 06 hex contains the address bits of the RDADDR subroutine of FIG. 31. Location 07 is reserved for future development. Locations 08 hex and 09 hex correspond to the low-order and high-order byte of the stack pointer storage as used by the task selection executive (TSKSEL) subroutine of FIG. 19. The location 0A hex stores the request for quad cable pulse generation and is used by the PLSGEN subroutine of FIG. 26. The length of the pulse is stored in location 0B hex, and is also used by the PLSGEN subroutine. The SCAN8 subroutine determines the number of PID devices declared to be noisy (and therefore unreliable), the number being stored in RAM location 0C hex. A flag indicating the completion of the pulse (I/O operative requested) is stored in location 0D hex, as used in the interrupt subroutine INTRTN 1200 of FIG. 20. A position 0E hex is reserved for a flag for pulse request, and is currently unused. The address of the last PID on the cable currently being serviced, and a flag indicating if the status of the current point has been read, correspond to the RAM locations 0F and 10 hex. The stack location 11 hex corresponds to the highest stack address, whereas the location FF hex, while being the last location within the cable RAM space, corresponds to the first, or bottom, cable stack address. As particular to the Z-80 microprocessor, this arrangement permits the cable information to be sequentially pushed into a stack configuration from the bottom, or highest numeric, location upwards, to a lower numeric value.

When the system begins operation on one of the seven tasks designated, the register information on the stacks, previously located in RAM location 11 hex through FF hex, is first moved into the Z-80 main registers of FIG. 4 (alternate registers not used in the present embodiment). The system information operation of a prior task is removed from the CPU 202 registers and stored in the particular RAM stack location corresponding to the task then operating according to the RAM memory space map of FIG. 15. The information of the current task is transferred from current task RAM memory space to the CPU 202 registers 900.

Information unique to each PID will be kept in the RAM at location C500 to approximately CCFF; the general system RAM area also includes a scratch pad area at the address beginning approximately CE00 to DFFF. The printer stack corresponding to the printer task, extending for approximately 50 bytes, is located at the approximate location CD35 to CD85. Within the RAM status table, there are 8 consecutive bytes of information for each PID. The IX register will be used to point to the information byte Ø for the currently enabled PID. An address increment pulse will add 8 to the IX register. An address reset pulse will reset the IX register to point to the information byte Ø for the PID number 00 on the currently addressed cable. Therefore, 8 bytes per PID times 256 PIDs equals 2K bytes of RAM data. The IX register will always point to the Ø byte of information for the currently enabled PID on the currently scanned cable.

TABLE V

| NAME | LOCATION | | |
|---|---|---|---|
| STATUS | (IX+Ø) | BIT: Ø - | Normal bit |
| | | 1 - | Tamper bit |
| | | 2 - | Trouble bit |
| | | 3 - | Alarm bit |
| | | 4 - | Relay-on bit |
| | | 5 - | Relay-on next scan bit |
| | | 6 - | Relay-off next scan bit |
| | | 7 - | Relay-on pulse has been sent |
| DATA | (IX+1) | BIT: Ø - | Disabled |
| | | 1 - | Noisy |
| | | 2 - | Exit delay period |
| | | 3 - | Entry delay period |
| | | 4 - | Redundant save flag |
| | | 5 - | Access flag |
| | | 6 - | (Reserved) |
| | | 7 - | PID communication failure flag |
| LINK | (IX+2) | BIT: Ø-7 | Will store address of next sensor in LCD annunciation queue after current address is annunciated. |
| Condition Byte | (IX+3) | BIT: Ø - | Alarm |
| | | 1 - | Trouble |
| | | 2 - | Tamper |
| | | 3 - | Communication trouble |
| | | 4 - | Restored alarm |
| | | 5 - | Restored trouble |
| | | 6 - | Restored tamper |
| | | 7 - | Restored communication trouble |
| LCD and Acknowledged Byte | (IX+4) | BIT: Ø - | Alarm acknowledged |
| | | 1 - | Trouble acknowledged |
| | | 2 - | Tamper acknowledged |
| | | 3 - | communication trouble acknowledged |
| | | 4 - | Restored alarm acknowledged |
| | | 5 - | Restored trouble acknowledged |
| | | 6 - | Restored tamper acknowledged |
| | | 7 - | Restored communcation trouble acknowledged |
| Printed Byte: | (IX+5) | BIT: Ø - | Alarm printed |
| | | 1 - | Trouble printed |
| | | 2 - | Tamper printed |
| | | 3 - | Communication trouble printed |

TABLE V-continued

| NAME | LOCATION | | |
|---|---|---|---|
| | | 4 - | Alarm restoration printed |
| | | 5 - | Trouble restoration printed |
| | | 6 - | Tamper restoration printed |
| | | 7 - | Commication trouble restoration printed |
| Print Link Byte | (IX+6) | BIT: Ø-7 | Will store PID number of next sensor in print queue after current PID address is annunciated. |
| Tests & Power Byte | (IX+7) | BIT: Ø - | Power off requested |
| | | 1 - | Power on requested |
| | | 2 - | Power off sent |
| | | 3 - | Power on sent |
| | | 4 - | Point in walk-test mode |
| | | 5 - | Suppressed message recorded |
| | | 6 - | Test alarm occurred |
| | | 7 - | Test restoration occurred |
| PRSTAT I/O Status Byte | | | (A 1 indicates an I/O condition) |
| | | BIT: Ø - | Waiting for serial transmit buffer to clear to output high priority message (alarm annunciation) |
| | | 1 - | Waiting for serial transmit buffer to clear to output low priorty message (keyboard I/O) |
| | | 2 - | Waiting for keyboard input |
| | | 3 - | Keyboard disabled - only passcode digits allowed for input |
| | | 4 - | No printing allowed bit (used for initialization) |
| | | 5 - | Passcode being entered - no LCD readout |
| | | 6 - | Keyboard function (low priorty) currently being executed |
| | | 7 - | High priority print task now executing |
| BELLFG Status Byte | | | (A bit = 1 indicates the control unit bell is on) |
| | | BIT: Ø - | Exit warning |
| | | 1 - | Entry warning |
| | | 2 - | Schedule secure warning/ bad group secure/ bad group access |
| | | 3 - | Ring back |
| | | 4 - | Keystroke |
| | | 5 - | Alarm annunciation |
| | | 6 - | Redundant alarm |
| SYSRDP System Read Byte SYSRDM | | | (Contents of this RAM byte are result of port [SYSRDP]read) |
| | | BIT: Ø - | A/C fail (Ø=failure; 1=okay) |
| | | 1 - | Power supply tamper |
| | | 2 - | Ground fault |
| | | 3 - | Control unit tamper |
| | | 4 - | DC power to unit verified for NMI |
| | | 5 - | Low battery |
| | | 6 - | (Unused) |
| | | 7 - | (Unused) |
| SYSWRP System Write Byte 0564 SYSWRM | | | (For latches bits 1,4,5: A Ø to bit resets latch; a 1 to bit puts it in normal sensing state. Contents of SYSWPM RAM byte is data last written to System Write Port (SYSWRP) |
| | | BIT: Ø - | State of A/C control |
| | | 1 - | PS tamper switch reset |
| | | 2 - | Direct connect relay Ø=on; 1=off |
| | | 3 - | Deadman relay Ø=on; 1=off |
| | | 4 - | Ground fault latch |
| | | 5 - | Control unit tamper latch |
| | | 6 - | printer select for serial output Ø=yes |
| | | 7 - | Matrix select for serial output Ø=yes |

Figure 21:
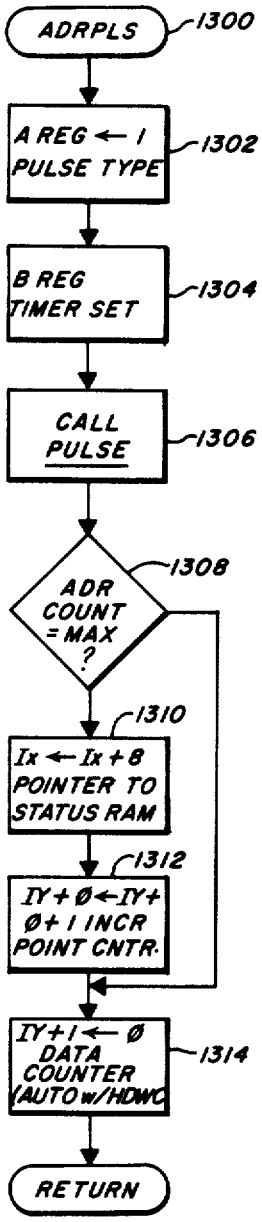
FIG. 21 is a flow chart of the address pulse (ADRPLS) subroutine.
Figure 22:
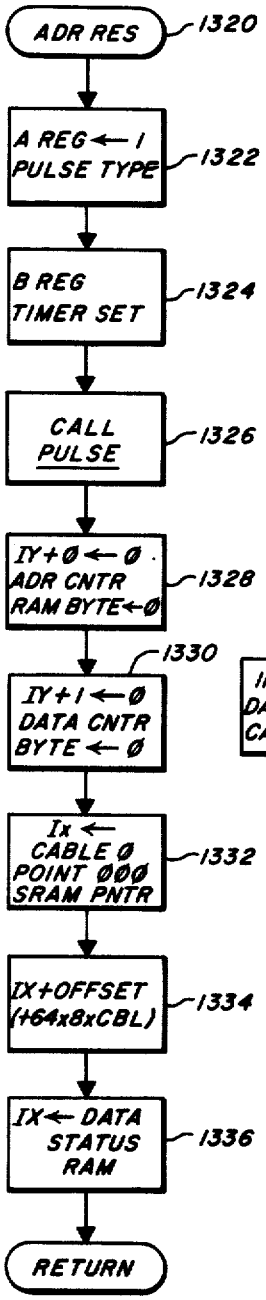
FIG. 22 is a flow chart of the address reset subroutine (ADRRES)

The general operations of the control unit 200 which implement the transfer of register 900 data corresponding to the various tasks among the CPU 202, the RAMs 241-244, and the remaining control unit 200 I/O hardware are shown in FIG. 17. The system operation of FIG. 16 shows the interaction of the MAIN SCAN 1000 and task selection TSKSEL 1100 program and the hardware interrupt service subroutine INTRTN 1200 is shown. Briefly, FIG. 16 is a plot of the software operation of the system according to the levels of subroutines, shown along the vertical axis, invoked during a particular interval of time, shown along the horizontal axis, while security system operations are in progress. A hardware interrupt signal, represented by a pulse 2052, occurs at a regular interval. It is to be noted that the two levels of the chart comprise a single process operating through time, wherein the break "A" of the first or top row continues on the left hand side of the second row. Above the horizontal time plot of the hardware interrupt signal pulse 2052, the particular sequence of time intervals (corresponding to the four cable servicing tasks, the keyboard tasks, and the print handling tasks), are indicated by the intervals 2044, 2054, 2064, 2074, 2084, and 2094. The intervals correspond to programs for the cable 0, cable 1, cable 2, cable 3, the keyboard, and the printer. These time intervals vary in duration according to the operations of the task service subroutines, discussed below. Within each cable time interval, the graph of FIG. 16 shows several horizontal "bar graph" indicators, each of which correspond to a subroutine in operation. In the typical operation of the programs and subroutines shown below, subroutines are called by various other programs to perform a special, redundant operation; after completion, the subroutines return to the program that called them. This subroutine calling and return sequence corresponds directly to the apparent stacking of one horizontal bar upon the other, sequentially in time as one subroutine calls another; thereafter, the topmost or last called subroutine is completed before the underlying subroutine bar indicates that that subroutine has been completed. A typical example of the sequential operation of the subroutine shown in FIG. 16 includes the operation of the MAIN SCAN 1000 program at 2040. Otherwise, the operation of the first cable task and the MAIN SCAN program 1000 of FIG. 18 first calls as a subroutine the task select program TSKSEL 1100, shown as 2042, at the onset of the cable 0 task time interval 2044. Upon completion of the TSKSEL subroutine, if no subsequent subroutines are therein called, the program counter then returns to the MAIN SCAN program 2040. The TSKSEL subroutine is shown in FIG. 16 as a single horizontal bar. After a brief time period during which the MAIN SCAN program continues to operate, the program ADRPLS 1300 of FIG. 21 is called by the MAIN SCAN program 1000, as shown at 2043. The program ADRPLS 1300 in turn calls the program PULSE 1780 of FIG. 25, indicated here as 2045. In turn, the PULSE program 1780 calls the PLSGEN subroutine 1790 of FIG. 25, here shown as 2046. Upon completion of the PLSGEN program 1790, the program returns to the calling program, the PULSE program 1780, and is thus indicated by the horizontal termination of bar 2046. Thereafter, the PULSE program 1780 is completed and the corresponding bar 2045 terminated. Similarly, when the ADRPLS program 1300 is completed, the bar 2043 is also terminated. The MAIN SCAN program 1000 then resumes operation for a short duration. Although a pulse for an I/O operation has been requested, according to the PLSGEN subroutine 1740 of FIG. 26 discussed below, the signal will not issue until the occurrence of the interrupt pulse 2052 invokes the interrupt routine, shown as 2041. In this manner, several tasks may subsequently be processed, and their I/O hardware control operations aggregated, until the occurrence of the hardware interrupt pulse 2052. Moreover, an economy and efficiency of control unit 200 operation is achieved with a minimal number of separate time consuming hardware I/O operations reduced. The MAIN SCAN 1000 program continues throughout the duration of all of the system tasks in operation, except at the occurrence of the hardware interrupt pulse 2052. When the interrupt pulse 2052 occurs, the interrupt program of FIG. 20 is called, as shown at 2041.

Figure 23:
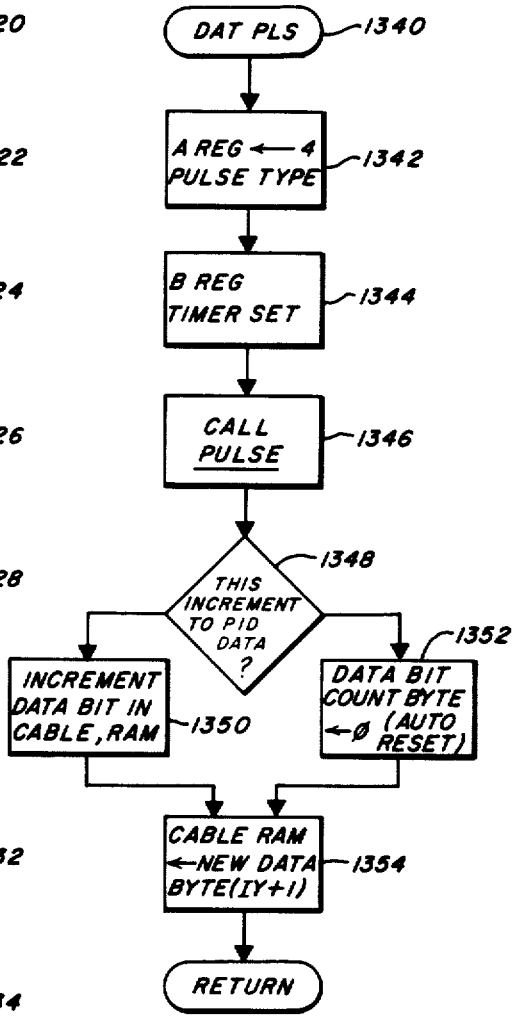
FIG. 23 is a flow chart of the data pulse (DATPLS) subroutine.
Figure 27:
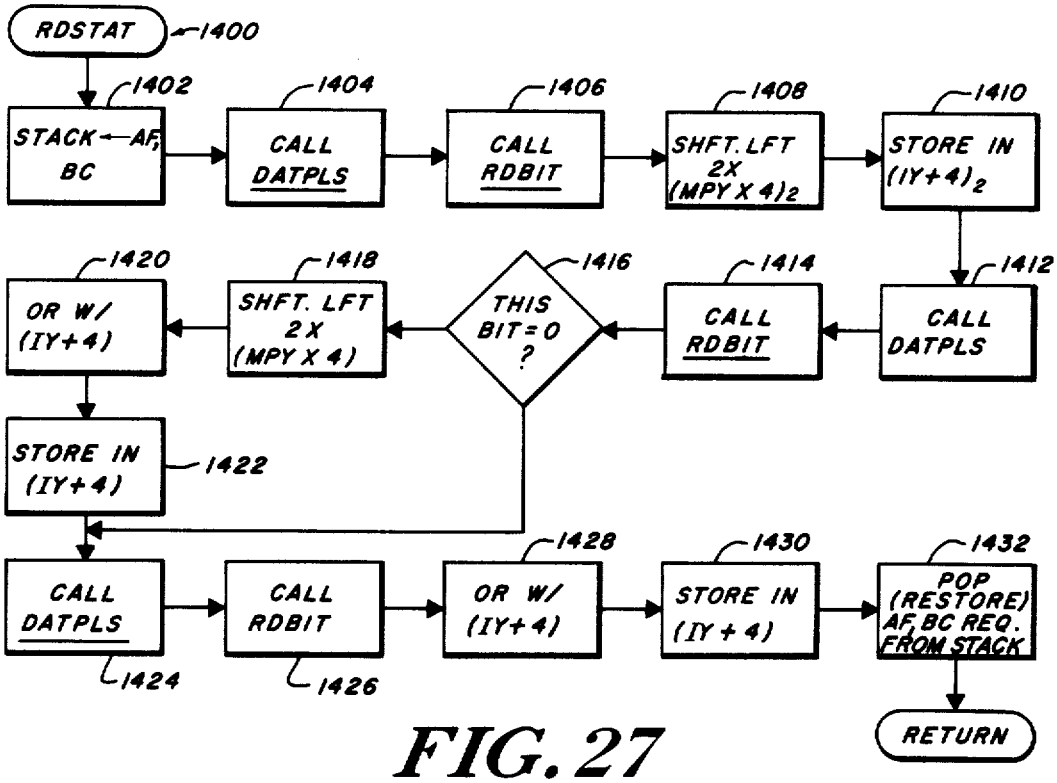
FIG. 27 is a flow chart of the status reading subroutine (RDSTAT)
Figure 30:
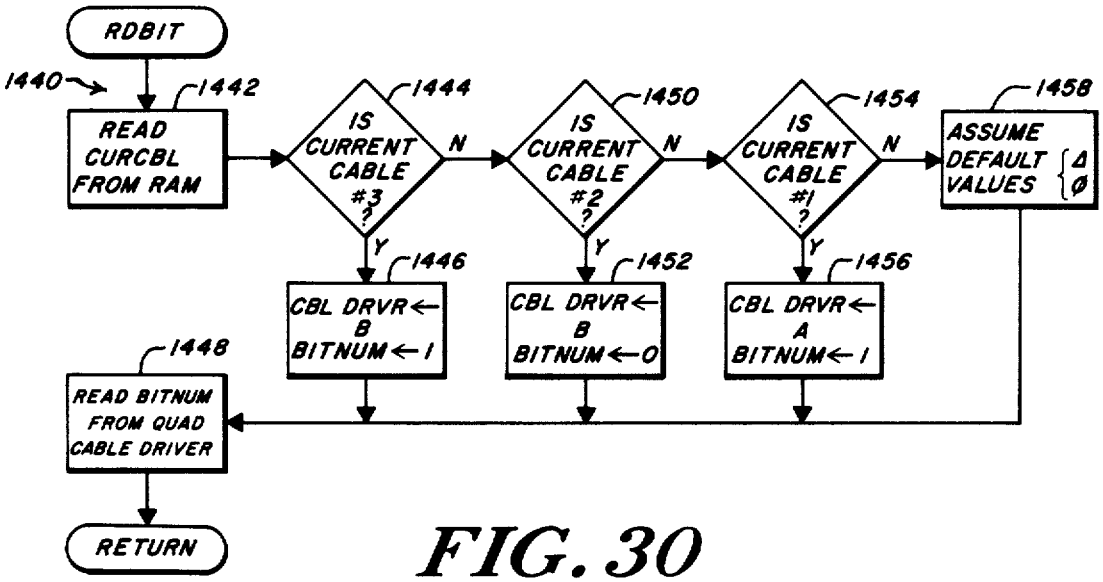
FIG. 30 is a flow chart of the read bit (RDBIT) subroutine.

Continuing with the interval 2044 corresponding to the task of cable 0, the next subroutine invoked is the RDSTAT subroutine of FIG. 27, shown here as 2047, which checks the status of the addressed PID. Subsequently, the DATPLS subroutine of FIG. 23 is called at 2048, which in turn calls the programs PULSE 2045, and then the PLSGEN 2046. As the subroutines PLSGEN, PULSE, and RDSTAT are completed, the subroutine RDBIT of FIG. 30 is subsequently called. The subroutine calling sequence continues until the scan program of FIG. 18 again calls on the task select program of FIG. 19. A request of a hardware I/O operation ends the sequence, at which time the contents of the main registers 900 associated with the program or subroutine currently operational within the CPU 202 (as represented as horizontal bars at the end of the period interval 2044) are stored in the RAM stack corresponding to locations C011 through C0FF (in FIG. 15). Only the subroutine(s) in progress at the end of the period 2044 will have their respective addresses and corresponding register data stored in the RAM stack between the locations 11 hex and FF hex; the memory space remaining will continue remain unused until needed in subsequent RAM stack transfers which may have a greater number of stacked or nested subroutines.

In the time interval 2054 allocated to service the next cable, cable 1, a similar execution sequence follows, except that the occurrence of the pulse 2052 temporarily invokes the interrupt service routine 2041. Similarly, at the end of the time interval 2054, the subroutine addresses and register information residing in the CPU 202 processor registers 900 at the end of the period 2054 will be loaded into the RAM memory space C111 through C1FF (of FIG. 15), corresponding to the cable 1 RAM space.

After the cable 1 service routine is completed, the subroutine MAIN SCAN of FIG. 18 will determine whether the 0, or first, cable has completed its requested I/O operation, so that further system activity concerning cable 0 may proceed. If the I/O operation has been completed, the MAINSCAN program returns to service cable 0 through a sequence analogus to 2044, discussed above. If the cable 0 still awaits hardware action, the software then advances to the next task, which is to check if the I/O operation of cable 1 is complete so that the cable 1 task can proceed with a subsequent task. If not complete, the MAIN SCAN program 1000 advances to service cable 2 at time interval 2064. At the completion of the time interval 2064, when a hardware I/O operation is requested, the contents of the registers are stored and the software MAIN SCAN program 1000 then returns to check cables 0, 1, and 2, at time intervals 2095, 2096, and 2097, respectively. In the example shown in FIG. 16, assume the time interval marked 2097 shows that cable 2 is still awaiting a hardware operation. The MAIN SCAN program 1000 will then advance to cable 3 interval 2074. At the end of the period 2074, the registers 900 are stored in the memory locations C311 to C3FF, and the MAIN SCAN program thereafter will proceed to check cables 0 through 3 during time intervals 2095 through 2098. In this instance, all four cables are awaiting completion of their I/O operation. Thus, a fifth priority task (or the keyboard program KEYSIN 860 of FIG. 40), is processed during the interval 2084. If the keyboard processing subroutine, or more generally, any task subroutine, is completed without requesting an I/O operation, no registers are stored in the register space of the RAM, and the program returns to check the cables 0 through 3 and the keyboard, at time intervals 2095 through 2099. While the lower five priority levels are awaiting hardware I/O operation, the sixth priority, the print subroutine PRNHDL, is called during time interval 2094. However, another interrupt pulse 2052 occurs during that period which temporarily stops the execution of the print service program to allow operation of the interrupt routine 2041. Thereafter, the print subroutines are reactivated until an output of a character on the printer is requested during the interval 2094, and the check of completed I/O operations for higher priority groups is repeated.

In the embodiment shown of the present invention, the many I/O operations, such as quad cable S-lead signaling, require a second I/O operation (after a second interrupt time interval) to be completed. Therefore, the occurrence of the next interrupt pulse 2052A may correspond to the completion of the requested hardware operations, such as a single pulse operation initiated during the prior pulse 2052, as discussed below in the flow charts below. Assuming that to be the case, the MAIN SCAN program 1000 returns to service cable 0 during the interval marked 2044A. The values in the registers used by the microprocessor at the onset of the interval 2044A are retrieved from the random access memory locations C011 through C0FF and are loaded into the registers shown in FIG. 4. Upon the completion of the interval 2044A, the data in the registers is once again moved to the location C011 through C0FF, as discussed above, and the MAIN SCAN program 1000 proceeds to check whether cables 0, 1, or 2 have completed their requested hardware I/O operations. In this example, and at this point in the time sequence, the cables 1 through 3 await the completion of the hardware I/O operation which was initiated only after the second pulse 2052A. Thereafter, the remaining priority task (the keyboard operation) is initiated during interval 2084A. The system then continues to service all cables and tasks in the priority sequence discribed.

Upon power-up or restart of the integrated security system of the present invention, the software system is initialized by the following steps:

First, the microprocessor interrupt mode is set to mode 1 (particular to the Z-80). This is to allow an immediate execution of the interrupt service routine, which begins at the address Read-Only Memory (ROM) 03 hex, when a hardware generated interrupt occurs, as discussed in the hardware interrupt routine of FIG. 20.

Second, all memory locations of RAM are set to 0. A test of the random access memory may be inserted here to provide a self-diagnostic routine to determine the condition of the active memory.

Third, the initialization bit 4 in the I/O status byte is set to a condition that marks that the initialization is currently in process in the system, and that all annunciation messages from the communication cards are to be suppressed. The initialization bit is cleared when all four cables have been scanned and the states of all points in the system have been stored in the random access memory (RAM).

Fourth, the CPU 202 stack pointer (SP) register 912 is loaded with the address of the bottom of the stack (XXFF hex) for the execution of the cable 0's scan task.

Fifth, the starting address for the cable scanning program, MAIN SCAN 1000 of FIG. 18, is pushed into the cable 0 stack. This is the stack now pointed to by the SP, or stack pointer, register 912. The stored value of the location pointed to by the SP in the stack is the first address that will be executed for processing the information from the point interface (PID) on this cable.

Sixth, the start address of the status RAM (in the general system RAM space) is calculated for the first point on this cable. This first point will have an address equal to the cable number times 64. There are eight bytes of consecutive RAM locations STATBL, C5ØØ for the storage of the status of each point in the security system herein described. For example, if there are 64 possible PID devices on each cable, the points are numbered from 00 through 63 decimal. A single table of $256\times8$ bytes of RAM's allocated for the PID status storage. The symbolic name for the start of this table is STATBL. The status RAM for the first point on the cable is therefore STATBL$+(8\times64)$ cable number.

Seventh, the calculated address (step 7) is placed into the IX index register 914 of the CPU 202, which will be used throughout the software described below to point to the status RAM bytes for the point interface device that is currently being interrogated or commanded.

Eighth, the IX register 914 contents are pushed onto the RAM stack at a location currently defined by the value of the stack pointer (SP) register 912. This means that 2 values are stored on the stack for the current cable. The first and lower value on the stack is the address at which to begin execution of the scan software. The second or higher value of the stack is the address in memory of the status RAM for the first PID on the cable to be examined (or the currently enabled PID). This value is at the "top" of the RAM stack. Note, as mentioned above, each push decrements the stack pointer (SP) register 912 by a value of 2, so that the current content of the stack pointer register is the initial value loaded into the stack pointer, or the bottom of the stack, minus 4.

Ninth, the initialization for a single cable stack in memory is now complete. The current value for the stack pointer is stored in RAM so that the other five stacks discussed above of the present invention can be also initialized; hereafter, the top of this stack can be retrieved at any time by reloading the stack pointer with the stored value. The current value of the stack pointer is stored in two consecutive 8-bit memory locations in the part of the RAM (XX08 and XX09) solely for use for the cable scan software.

Tenth, the stack pointer register is loaded with the value of the bottom of the RAM stack area (C011–C0FF hex) set aside for the storage of the register data corresponding to the execution of cable 1 scan task. Loading the stack pointer register with the bottom of the RAM stack will cause the previous contents of the stack pointer register area to be obliterated, but is of no concern, since the previous value was saved in the above step 9.

Eleventh, the steps 5 through 9 are repeated for the initialization of cable 1. Substitute #1 as the cable number wherever appropriate.

Twelfth, the stack pointer (SP) register 912 is loaded with the value of the bottom of the stack or the scan task of cable 2. This SP register value will be in the part of the RAM set aside for this task, as discussed above.

Thirteenth, steps 5 through 9 are repeated with initialization of the stack for the cable 2. Substitute cable 2 wherever appropriate.

Fourteenth, the stack pointer is loaded with the bottom of the stack to be used for the cable 3 scan task.

Fifteenth, steps 5 through 9 are repeated for the initialization of cable 3. Substitute #3 as the cable number where appropriate. This sequence completes the initialization of the first four stacks which are analogous, except for the different calculated IX status RAM addresses at the top of each stack, those being C000 through C300.

Sixteenth, the last two stacks are initialized by loading the stack pointer with the bottom address of the stack to be used for the keyboard handler routine. This is referred to as the communication task.

Seventeenth, the start address of the keyboard handler subroutine is pushed onto the initially empty stack, KEYSIN 1860 of FIG. 40, discussed below, to be executed when the user first enters a keystroke on the front panel.

Eighteenth, the RAM stack is pushed onto the currently empty main registers AF, BC, DE, HL, and IX, 902. By storing the data of all registers on the communication stack each time the software leaves the current stack, the CPU 202 register 900 environment can be recreated when the processor returns to the communication task.

Nineteenth, with the environment of the CPU register stored on the communication, or COM, stack, the current top-of-the-stack value (what the stack pointer now contains) in the location $COMSP_H$ and $COMSP_L$ is saved. By reloading the stack pointer from these locations, the environment of the CP registers can be restored by popping the previously pushed (i.e., saved) values of the register off the stack pointed to by the new, reloaded stack pointer (SP) register.

Figure 39:
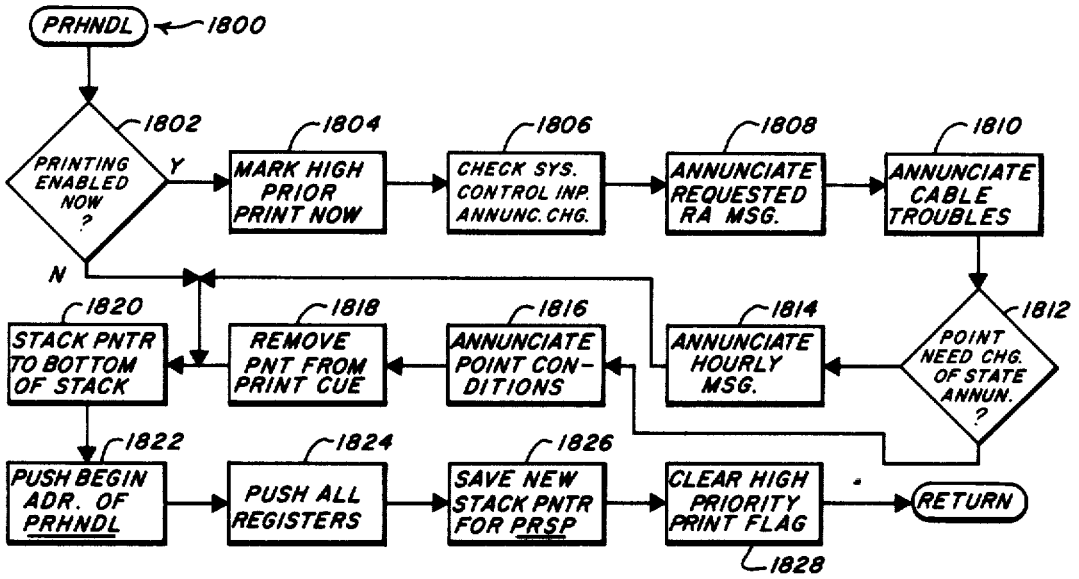
FIG. 39 is a flow chart of the print message subroutine (PRHNDL)

Twentieth, the stack pointer is loaded with the bottom address of the stack to be used by the print annunciation handler PRHNDL program 1800 of FIG. 39, discussed below. This bottom address is uniquely assigned in memory to the printout task (i.e., from the sixth part of the RAM as detailed in step 2).

Twenty-first, the start address of the PRHNDL subroutine is pushed onto this initially empty stack which will be executed from change-of-state in the security system when it is to be printed.

Twenty-second, the values of the AF, BC, DE, HL, and IX registers 902 are pushed onto the stack. When the task selection process occurs, it is expected that the microprocessor register environment of the last print annunciation action will be restored from the stack of the print task. Initially, these values are probably 0's, which are meaningless as long as there is some value on the stack to be "popped" off by the task selection (TSKSEL) process, described below.

Twenty-third, the initial top of the stack is saved for the print task in locations caled $PRSP_H$ and $PRSP_L$. This is where the TSKSEL subroutine 1100 of FIG. 22 goes to get the value of the stack pointer (SP) register 912, which is necessary to restore the print task to the CPU 202 registers 900 environment. At this point, all six stacks and stored stack pointer values have been initialized. The seventh task, the LCD handler, does not need a separate task.

Twenty-fourth, the task selection TSKSEL subroutine 1100 shown in FIG. 19 below, begins operation of the unit by assigning the CPU 202 to a task until that task requests an I/O operation (which requires a time period to be waited out) or, for the communication and print-out tasks, when the function terminates. The four tasks which scan each of the four cables cyclically poll the points (PIDs) on each cable from point 00 to the particular maximum used. Whenever the scan is reinitialized, the cable 00 is the first scanned; cable 03 is not scanned unless the previous cables have been serviced. The above-described initialization procedure corresponds to the initial step 1002 of the MAIN SCAN program 1000 shown in FIG. 18.

The MAIN SCAN program 1000 of FIG. 18 begins when the hardware is initially powered or manually reset by reset switch 250 of FIG. 2. The point interface devices (PIDs) are scanned at function block 1002 for status indication; the received information is loaded into a random access memory (RAM) 241-244 of FIG. 2 to form a reference table used in the operation described according to the initialization process described above. Next, the system checks to see if the cable RAMs and the PIDs are initialized (PIDs scanned and status stored) at step 1004. If the cables are initialized, the printer is enabled for annunciation according to function step 1006. Thereafter, or in the condition of step 1004 wherein the cables have not been initialized, the PID address #00 is placed on the cable currently addressed by not incrementally pulsing the PID address counter. The address pulse operation is performed according to the step of block 1008, which causes the system to transfer control to the task select executive subroutine 1100 shown in FIG. 19, referred to by the mnemonic TSKSEL. After the task selection routine has been executed, the program returns to the function block 1008 to check at block 1010 to see if the cable was #0. If it was the first, or #0 cable, the next address point is addressed at step 1012, which calls both the interrupt routine shown in FIG. 20, and the address pulse routine, as shown in FIG. 21, discussed below. Upon completion, the program resumes the operation of block 1012. If the cable number selected is not equal to the cable 0 as tested in step 1010, and after the return from the block 1012, the real-time clock 270 (of FIG. 11) is read at step 1014 which also reads and confirms the internal registers which include another time indicating information source as generated within the interrupt routine of FIG. 20, discussed below. If the system is being operated on battery power and if the battery power is almost depleted, sensed by a low battery system input, a decision is made at step 1016 whether or not the system should shed or disconnect certain burglar alarm (BA) sensors, so as to lighten the system energy draw. If the burglar alarm sensors are to be disconnected, the system first determines whether or not the current point is a burglar alarm sensor at step 1018; if the system should shed the BA sensors, the system requests that the point power be turned off at step 1020. Thereafter, or if the current pulse is not a BA sensor according to the determination of step 1018, or if the BA sensors are not to be disconnected according to the determination of block 1016, the system determines whether or not the PID is erratic at that particular point, at 1022. If there appears to be trouble at the PID, the system evaluates whether or not the PID data should be restored during this subroutine pass, block 1024. If the system attempts to restore the PID data information, the system then checks whether the PID data is valid now, step 1026. If the system is not to restore the information according to the decision at block 1024, or if the data is not now valid, block 1026, the program moves to the subsequent test at block 1066 wherein data contained within the RAM address XXOF is compared to the current PID address; an equality between the RAM data and the PID address indicates that the current point is the last point on the cable, as discussed further below. If it is determined that the PID does not indicate trouble, block 1022, it is next determined if the point (PID) is in test mode, block 1028. If the PID is not in test mode, the system looks at the previous call to that point to determine if the PID was previously noisy, at block 1030. If the PID was previously noisy, the PID is rechecked to determine the validity of information produced by that PID, block 1032. The validity check, block 1032, incorporates a call to the read stat RDSTAT subroutine 1400 and the read address RDADDR subroutine 1460, shown in FIGS. 27 and 31, respectively, and discussed below. Since the previous access to the PID currently addressed resulted in a noisy condition according to the decision of block 1030, the PID scan address is then incremented one full count, block 1068, so as to reserve reading of that PID subsequent to a point validity check, block 1032, showing the PID to be non-noisy. If the PID was not noisy from the prior access, block 1030, or if the point was in test mode, block 1028, a determination at 1034 is made as to whether the PID should be interrogated. If the point should not be interrogated, the program then examines the RAM data ($IX+\phi$) to determine if relay action, according to the C-lead signaling, is to be performed, block 1064. If the PID shall be interrogated, decision block 1034, it is first determined whether or not there is an entry delay, block 1036; if so, a group (pulses 2052 of FIG. 16) entry timer is engaged wherein a predetermined number of hardware interrupts elapses before the alarm is annunciated. If the group entry timer is greater than a value of 70 (or a user-selectable software delay), the PID number is annunciated in the alarm at block 1040; also, another subroutine for the system redundancy, entry, exit delay check on new alarms 1500 is called REDNAL, shown in FIG. 32 below. After the REDNAL subroutine is completed, the current program will then annunciate the restored point, block 1042, before clearing the entry delay indicator, block 1044; thereafter, the program determines if relay action is necessary, block 1064. If there is no point entry and delay according to the determination at 1036, of if the group timer value is greater than zero at step 1038, the sequence then determines whether or not there is a point exit delay at block 1046. If there is an exit delay engaged, the group timer value is compared to 70 at block 1048. If the value of the time is greater than the selected delay (e.g., 70) the PID number is annunciated as an alarm, block 1050; the annunciation, block 1050, engages the REDNAL subroutine; thereafter, the exit delay indicator is cleared, block 1052; the program 1000 thereafter checks for required relay action, block 1064. If the point does not have an exit delay, block 1046, or if the group timer is equal to zero, block 1048, the PID is checked for a noisy condition, block 1054; this operation engages the SCAN8 subroutine 1600 shown in FIG. 33. If it is determined that the PID is noisy, block 1056, the PID is indicated as such, block 1072; thereafter, the PID scan count is incremented, block 1068. If the PID is not noisy, determination block 1056, the system then checks for a change of state at the PID, block 1058. If there is no change of state, the system now determines if relay action is required, block 1064. If there is a change of state at the particular PID, determination block 1058, the status and address is checked, block 1060; if the address is not valid, the PID is marked "noisy", block 1072, and the subsequent action follows as described above. If the status and address are valid, determination block 1060, and if the PID data is valid now, block 1026, a change of state is annunciated if required, block 1062. The execution of this block 1062 invokes the subroutines shown in FIGS. 32, 34, and 35, discussed below. If front panel keyswitch is in the access/secure position, the KEY ACC (FIG. 34) and the KEY SEC (FIG. 42) are called. If the PID is a BA point and has a delay time, and is redundant, then the REDNAL (FIG. 32) subroutine is called. Upon return from the appropriate subroutine, the present program then checks for a required change of state of the relay according to a signal on the C-lead of the PID as discussed above, block 1064. The relay activation subroutines in turn call additional subroutines ONPLS 1760 and OFFPLS 1770 of FIG. 35 and FIG. 37, corresponding to the ON or OFF pulse sequence of the respective relay. After the appropriate relay action is performed, block 1064, or after the PID data is shown to be unusable, blocks 1024 and 1026, it is determined whether or not the point is the last point on cable, decision block 1066. This determination is derived from the information stored on a location XXOF within each RAM stack in the discussion of FIG. 6. If it is not the last point on the cable, the next point is addressed, block 1070; this sequence invokes the task select routine shown in FIG. 19, discussed below. Thereafter, the MAIN SCAN program 1000 reenters an earlier block 1016, wherein the battery condition determines the appropriate number of BA sensors to be connected. If it is determined that the last point on the cable has been addressed, block 1066, the cable is incremented one full scan count, as in the case if the point does not show a valid status, block 1032, or the PID is marked as "noisy", block 1072. After the scan count is incremented, the program loops to the address point 0 command, block 1008, calling task select TSKSEL, 1100 subroutine of FIG. 19. Thereafter, the entire operation described in regard to the MAIN SCAN program 1000 of FIG. 18 is repeated. This operation is a high priority operation, only to be interrupted by the interrupt routine shown in FIG. 20 discussed below.

The present invention performs a plurality of seemingly independent operations (tasks) using a single hardware microprocessor system. The management of these routines are provided by a task selection executive subroutine (TSKSEL) 1100 shown in detail in FIG. 21. Briefly, the routines comprise (1) servicing each of the four cables, (2) queuing of the liquid crystal display (LCD) messages, (3) queuing of the printed messages on the printer, and (4) monitoring miscellaneous keyboard entry and system. Since there is a single CPU 202, only one task may be performed at any given time. The tasks therefore share the hardware according to the sequence and priority established within the TSKSEL program.

Except for the brief interrupt service subroutine 1200 shown in FIG. 20, the TSKSEL program 1100 maintains control of the allocation of the use of the CPU 202 and will process a particular task until that particular task requests a time-consuming input/output (I/O) action. For instance, when the task is driving one of the cables, the I/O operation comprises pulsing on the signal and carrier lines. For the LCD messages task, the I/O operation comprises waiting for an acknowledge key to be struck; for the print messages task, the I/O operation comprises waiting for the universal asynchronous receiver and transmitter (UART) transmit buffer to empty and allowing the next character to be transmitted. And for the keyboard input task, the I/O action would include either waiting for a keyboard input or for the UART transmit buffer to empty during the printout. Once one of the above-mentioned tasks requests an I/O action, the task returns the CPU control to the task selector program presently described, which loops sequentially through each of the seven tasks, giving higher priority to task #1 and continuing through to task #7 until it finds a task whose previous I/O action (one that previously caused the return of the control to the processor) has been completed. When one of the I/O actions has been completed, the task selector subroutine 1100 restores the information within the computer registers for the particular task completed which was then resident in the CPU 202 registers 900 at the time that particular task had requested an I/O action, to resume processing where that particular task left off. The transfer of register and RAM data, corresponding to the data of each of the seven tasks, occurs when a transition from one task execution to another occurs, as is described above in reference to FIG. 16.

The task select TSKSEL program 1100 is called by the MAIN SCAN program 1000 (shown in FIG. 18 at block 1008 and block 1070). The task select routine first reads the hardware real-time clock 270 of FIG. 11, block 1102, and compares the time value with the program implemented clock register values as incremented by the interrupt subroutine INTRTN of FIG. 20. The CPU 202 includes several registers 900 as shown in FIG. 4, a pair of which being labelled the IT register are loaded with the pointer for the address within the RAM memory of the address of cable 0, specifically C000, block 1104. Next, in step 1106, the register pair DE is loaded with the RAM address offset number, 0100 hex, which corresponds to the difference in relative address within the RAM for each stack corresponding to each of the separate tasks. Next, the current cable count variable within the process is set to 0, block 1108. After the cable number is set to the first cable, 0, the program checks to see if the I/O action is complete, the SP register pair is loaded with the IY+8 and the IY+9 address information relating to the stack pointer storage low order byte to the high order byte, as shown in FIG. 15, discussed above. Next, the IX register receives the top value on the particular stack as shown in FIG. 15 as a stack pointer to the RAM status bytes for the currently enabled point on the particular cable address, block 1114. The top stack value is the return address to which the task select program returns, block 1116. The program counter receives the top stack value and thereafter returns to that address, block 1118, continuing the MAIN SCAN program 1000 shown in FIG. 18. If the interrupt subroutine 1200 is not complete, block 1110, the system determines whether the current cable is the last cable in the system at block 1120 by comparing the cable counter variable to a preset value stored in the system RAM at locations XXOF hex. If the present cable is not the last cable, the IY register is incremented by the offset value 0100 (as stored in the DE register pair) to provide the IY register with the stack address in RAM of the next cable according to block 1122. In block 1124 the current cable is incremented by one, and the program returns to the test of block 1110 which determines the status of the interrupt routine.

If, at block 1120, it is determined that the last cable in the system has been addressed by the above process, the block 1126 next determines whether or not the initialization flag (bit 4 in PRSTAT) has been set. If it has been set, the program 1100 returns to the time change step, block 1102. If the initialization flag has been set, the status of the communication card is evaluated, block 1128, subroutine CCCMLP (shown in FIG. 45) is called. At block 1130, the time indication on the LCD is changed if the update is required. The system then polls its own internal tamper sensors, block 1132. The block 1134, the LCD will annunciate a change of state if input status has changed state by invoking a call to the LCD handler routine LCDHDL 1830 of FIG. 38, discussed below. Looking for user acknowledgment, the system next determines if the keyboard has been enabled, block 1136. IF the keyboard has been enabled, the system determines whether or not a key has been struck, block 1138. If a key has been struck, the system checks to see if it has been a reset key, decision block 1140. If the reset key has been struck, a determination is made whether or not the printer is currently printing a low priority message, block 1142. If the result is affirmative, the print is aborted immediately, block 1144. If a low priority message is not being printed, the system next determines whether or not a walk-test (an on-site inspection of the system's sensors, which may trigger the particular alarm) is in progress, block 1146. If a walk-test is in progress, the walk-test is terminated, block 1148. Under conditions where the keyboard has not been enabled, a key has not been hit, or if a key has been hit, and that key is not the reset key, or after the low priority message is aborted, or at the end of the terminated walk-test, blocks 1136 to 1148, the system next checks the printer UART buffer for a value (any contents). If the buffer is not empty, decision block 1150, the end-of-low-priority flag is checked in step 1152, so that a low priority message can only be interrupted by a high priority message at the end of a line of printed messages. If the end-of-low-priority flag has been set, the system checks to see if a high priority print message is waiting to be printed, block 1154. If no high priority message is currently waiting to be printed, the decision of block 1156 determines whether a new message is in the high priority queue, according to the print handle subroutine PRNHDL 1800 of FIG. 39, discussed below. If there is no message in the high priority message queue, the system now determines if there is a low priority message line to be begun, block 1158. If no low priority message is to be printed, the system determines whether or not an hourly message is printed, block 1160. If there is no hourly message to be printed, the system next determines whether or not a key from the keyboard has been struck, block 1162. If, in fact, a key has been struck, the system next determines whether or not a low priority print request is currently running, block 1164. If there is currently a low priority print request running, or if no key has been struck, decision blocks 1164 and 1162, respectively, the system then returns to the beginning of the task select program, block 1102. If the low priority print request is not running, decision block 1164, or if the end-of-low-priority flag is not set, block 1152, the system then loads the stack point register (SP) 912 with the $COMSP_H$ and the $COMSP_L$ signals at CD8 hex and CD90 hex; thereafter, the KEYSIN subroutine 1860 shown in FIG. 40 is called, discussed below. If there is a low priority message to be begun, decision block 1158, the system then clears the end-of-low-priority flag, block 1168; thereafter, the SP register is loaded with the $COMSP_H$ and $COMSP_L$ address words, block 1170. When there is a high priority message waiting to be printed, or a new message in the high priority message queue, or an hourly message to be printed, decision blocks 1154, 1156, and 1160, respectively, the TSKSEL program 1200 loads the SP registers with the $PRSP_H$ and the $PRSP_L$ values, and calls the print handling PRNHDL rubroutine 1800 block 1166. After the SP register 912 is loaded with the subroutine call addresses, blocks 1170 and 1166 discussed above, the present program loads the present RAM stack into the appropriate CPU 202 registers 900, block 1172. Thereafter, the stack pointer (SP) register points to the return address, block 1174. The top of the RAM stack is loaded into the program counter (PC) register, block 1176, whereupon the TAKSEL program 1200 then returns to either the KEYSIN 1860 or the PRNHDL 1800 subroutine according to the respective addresses loaded, as discussed above, block 1178.

The interrupt subroutine INTRTN, 1200 is driven by the PINT interrupt signal 272 input of the CPU 202 originating from the hardware interrupt from the clock circuit 270A shown in FIG. 2. When each particular interrupt pulse occurs at the PINT input, the INTRTN routine temporarily stores all registers in the current stack location of the RAM memory area, block 1202. Next, the IY registers are loaded with the pointer to the RAM cable 0 value, block 1204. The DE register pair is loaded with the offset value 0100, corresponding to the relative offset of each particular task stack location within the RAM memory, block 1206. In the block 1208, the L register (or 8 bits of HL register pair) is loaded with a value of 1, where 1 corresponds to the quad cable driver A card 290 (a value of Ø corresponds to the quad cable driver B 291); each of the quad A and quad B cable driver cards provides interface with two quad cables, as discussed above in reference to the quad cable driver 290 and 291 of FIG. 13, the PID devices 100 and the general system 200 structure shown in FIG. 3. The particular number within each quad cable driver is determined by a value loaded into the B register at step 1210. Thereafter, the A register is loaded with a value of 0, indicating that no action is to be taken, block 1212. Next, the system determines whether the task pointed to by the value in the IY register has been completed, block 1214. Next, the action type register is loaded with the byte equal to the contents of the IY register plus the A register, thus specifying the action type, block 1216. In the next block 1218, the IY+B byte, serving as the cable action timer, number is decremented by 1. The timer byte, block 1218, is tested for a value of 0, block 1220. If the timer byte is not equal to 0, or if the action pointed to by the IY register contents, block 1214, has been completed, the next cable number point is set to the value in the IY register, causing the system to properly address the RAM data bit by adding the offset value, stored in the DE register (0100), the the IY register value, block 1230. If the timer byte, block 1220 is equal to 0, indicating the completion of a timer interval, it is determined whether the type of the action just completed was a WAIT pulse, block 1222. If the action type is not a WAIT pulse, the byte corresponding to the IY register plus the DE register pair is loaded with all 1's, corresponding to a hexdecimal number FF hex, block 1224, which sets the cable action complete flag for the TSKSEL program, discussed above. If the pulse type, block 1222, was not a WAIT pulse, the byte corresponding to the IY+A register is loaded with a value of 0, block 1226. The timer byte, comprising the IY+B registers, is loaded with a predetermined value, thus setting the timer to a predetermined interrupt interval, block 1228. Thereafter, and after block 1224 where the task select flag is set to a value of FF hex, the next RAM stack address is provided by incrementing the DE register by the offset value of 0100 hex, and reading the next cable pointer for the next cable (1, 2, or 3) into the IY register. Similarly, the B register in CPU 202 is decremented by 1, block 1232. When the B register becomes equal to 0, the test at block 1234 causes the program L register to decrement the loop count at step 1236. If the B register is not equal to 0, the program loops to test block 1214, where the IY register tests for a completed action. After the loop register L is decremented, it is tested for a value of 0, block 1238. If the loop register value is not equal to 0, the output action register contents with the quad cable data is transferred (shifted) to driver A by loading a value of 2 into the B register, block 1240, and returning the subroutine sequence to block 1210. If the L register value is now equal to 0, test block 1238, the output action register contents are loaded into the quad cable driver B, block 1242. Next, the interrupt counter is incremented by 1, block 1246. If the interrupt counter equals a value of 250, block 1248, the LED data byte is sent to the LED output ports, block 1250, causing the LED indicators to blink. Thereafter, the ½ second counter is incremented, block 1252. If the ½ second counter equals 2, which corresponds to an interval of 1 second, block 1254, the second counter (SECCNT, CFF2 hex) is incremented by 1, block 1256. Thereafter, the time change TIMCHG flag is set, block 1258. This flag TIMCHG invokes the time change block 1102 of FIG. 19 in the TSKSEL program, discussed above. Next, at step 1260, it is determined whether 60 seconds have passed, block 1260. If 60 seconds have passed, the minute counter is incremented, block 1262; thereafter, the time change flag is set, block 1264. Since different bits are set for each unit of time change, the time change flag must be set for each incremental change. Next, it is determined whether 60 minutes have elapsed, block 1266. If 60 minutes has elapsed, the hour counter is incremented, block 1268; thereafter, the time change flag is set, block 1270. Thereafter, the value for the hour counter is compared to the value 24, block 1272. If it is equal to 24, the day counter is incremented, block 1274; thereafter, the time change flag is set, block 1276, for operation as described above. If the tests, blocks 1248, 1254, 1260, 1272, and 1266, show that the particular counters have not exceeded their respective limits, or after the TIMCHG flag has been set, block 1276, the INTRTN program 1200 prepares to return to the calling program by popping all registers, block 1278. In this step, all interrupt conditions are reset. Finally, the interrupt enables are reset, thereby allowing the hardware interrupt routine INTRTN to be reactivated on the occurrence of the next interrupt period, block 1280.

FIG. 21 describes the address plus ADRPLS subroutine 1300 as called by MAIN SCAN subroutine, block 1012 of FIG. 19, discussed above. The subroutine 1300 provides a specified duration signal pulse to the PID signal (S)lead. The A register contains a value corresponding to the pulse type to be produced by the system. An address pulse is a type 1 pulse, and a 1 is therefore loaded into the address register, block 1302. Next, the B register, corresponding to the incremental time interval over which the pulse is generated, receives a predetermined value, as shown in block 1304. The period is provided by the hardware clock 270A, shown in FIG. 3, above. Next, the PULSE subroutine 1780 is called to generate the desired pulse, block 1306. The PULSE subroutine 1780 is explained below in FIG. 25. Next, the system determines whether the current address counter has a value equal to the maximum allowable PID address for the current cable, block 1308. If it is not equal to the maximum value, the IX status pointer register receives an update so as to point to the status RAM for the current point, IX→IX+8, block 1310. The point counter is incremented by 1 to service the next PID, block 1312. Thereafter, or if the address counter is equal to maximum value, block 1308 above, the data counter register is reset to 0, block 1314; the address pulse automatically resets the PID.

The address reset subroutine shown as ADRRES, 1320, first loads 1 into the A register, corresponding to the address pulse type, block 1322. The pulse timer receives a value of multiple units of the interrupt pulse period, in block 1324. Thereafter, the PULSE subroutine 1780 is called, block 1326. When the PULSE subroutine is complete, the address counter RAM byte is reset to 0, block 1328. Next, the data counter byte is set to 0, block 1330. Thereafter, the status RAM pointer is reset to the 0th cable and the point 000, block 1332. The IX register receives the offset (corresponding to the number of PIDs per cable times the cable number) so as to point to the 0 PID for the next cable, block 1334. The IX register points to the data status RAM for the correct point, block 1336. Thereafter, the subroutine ADRRESS 1320 returns to the program from which it was called.

The data pulse subroutine DATPLS 1340 provides the program control of the negative going pulses used by the system to increment the data counters of the PID devices. First, the A register is loaded with a value corresponding to the data pulse type, block 1342. Next, the pulse timer is set to a value corresponding to the interrupt time interval, block 1344. Thereafter, the PULSE subroutine 1780 is called, block 1346. After the program returns from the PULSE subroutine 1780, the system determines whether the PID data was enabled, in block 1348. If the PID data enable was not enabled, the data bit count in the cable's RAM location is incremented, block 1350. If the increment data, block 1346, was enabled, the data bit count byte is reset to 0. The count byte is also manually reset, if desired, block 1352. Thereafter, the RAM location corresponding to the current cable receives and stores the new enabled PID data, block 1354. Thereafter, the subroutine DATPLS 1840 returns to the calling program.

Figure 24:
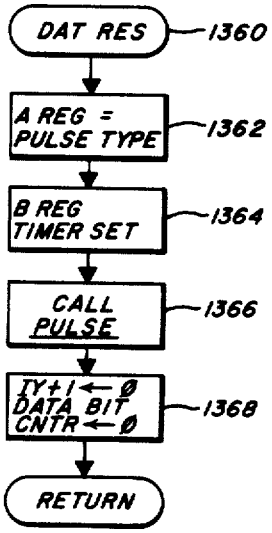
FIG. 24 is a flow chart of the data reset (DATRES) subroutine.

The data reset subroutine DATRES 1360 is shown in FIG. 24. The data reset subroutine performs a function analogous to the address reset, ADRRES, of FIG. 22; however, the pulse type is the appropriate negative going signal as required to reset the data counter of the PID device 100. The A register receives a value corresponding to the pulse type of the negative going data pulse, block 1362. Thetimer receives a value corresponding to multiple units of timer intervals, block 1364. Thereafter, the PULSE subroutine is called, block 1366. After the program returns from the PULSE subroutine, the enabled data bit counter receives a value of 0, block 1368. Thereafter, the DATRES subroutine 1860 returns to the calling program.

The read status or RDSTAT subroutine 1400 is shown in FIG. 27. At the onset the system loads the AF and BC registers onto the stack location relative to each of the particular tasks the process is performing, according to the map of FIG. 16, block 1402. Next, the DATPLS program shown in FIG. 23 and discussed above is called for execution, block 1404. This subroutine sends the data counter increment pulse down the quad cable signal S-lead, thereby incrementing the address counters on all of the PID devices connected thereto. The RDBIT program is then called, block 1404. This program reads the PID data bit from each of the quad cable drivers. The value of the PID data bit thereby received from the RDBIT subroutine 1730 is multiplied by 4 by shifting the value left 2 times, block 1408. The value thereby produced is stored in the RAM location IY+4, as shown on the map of FIG. 15, block 1410. Thereafter, the DATPLS subroutine 1340 of FIG. 23 is again called to provide a data increment pulse on the quad cable, block 1412. Next, the RDBIT program 1730 of FIG. 30, discussed below, is called to read a second (new) data bit (labelled as data bit number 1, the first being data bit number 0) from the quad cable driver, block 1414. The bit value is tested for a value of 0, block 1416. If it is equal to 0, the program skips to block 1424, discussed below, indicating that there is no trouble alarm of the particular PID addressed therein. The program will move to clock 1418 if the bit is not equal to 0, that is, if it is equal to 1. The bit value is multiplied by 4 by shifting the digital word left by two positions, block 1418. Next, the resulting number is arithmetically ORed with the value of the RAM location of IY+4, block 1420. The result is stored in that location, IY+4, block 1422. The particular position of the data bit indicates whether a trouble alarm has occurred on the PID addressed. Next the DATPLS subroutine 1340 of FIG. 23 is called to send a data increment pulse on the quad cable; thereafter, that particular data bit is read by calling the RDBIT subroutine of FIG. 30, block 1426. The received data bit is arithmetically ORed with the value at the IY+4 location, block 1428. The IY+4 location stores the indicated tamper alarm in the appropriate RAM location, block 1430. Finally, the program restores the AF and BC registers from the RAM stack and returns the program to the operating program from which this subroutine was called, block 1432.

The read bit subroutine RDBIT 1440 is shown in FIG. 30. The fist step is to read the current cable value from the RAM location (CURCBL), block 1442. The value of the current cable number is tested first for the third cable, block 1444. If the number is equal to the third cable, the system is directed to align the outgoing data to the cable driver B and to assign the bit number variable a value of 1, block 1446. Thereafter, the program reads the bit number value from the quad cable driver, block 1448, and returns to the calling program. If the current cable number at block 1444 is not equal to 3, the current cable number value is tested for a value of 2, block 1450. If the number value is equal to 2, the data is assigned to cable driver B, and the bit number is given a value of 0, block 1452; thereafter, the program advances to block 1448, as discussed above. If the current cable number is neither 3 nor 2 according to tests of blocks 1444 and 1450, the current cable value is tested for a value of 1, block 1454. If it is equal to a value of 1, the data is assigned to cable driver A, and the bit number is given a value of 1. Thereafter, the program advances to block 1448. If the current cable is not equal to 1 at block 1454 and has failed the previous tests of blocks 1444 and 1450, the remaining cable number, 0, is assumed, thereby assigning the data to the cable driver A and a value of 0 to the bit number. Thereafter, the bit number is read from the quad cable driver, block 1448, and the program returns to that which called it.

Figure 31:
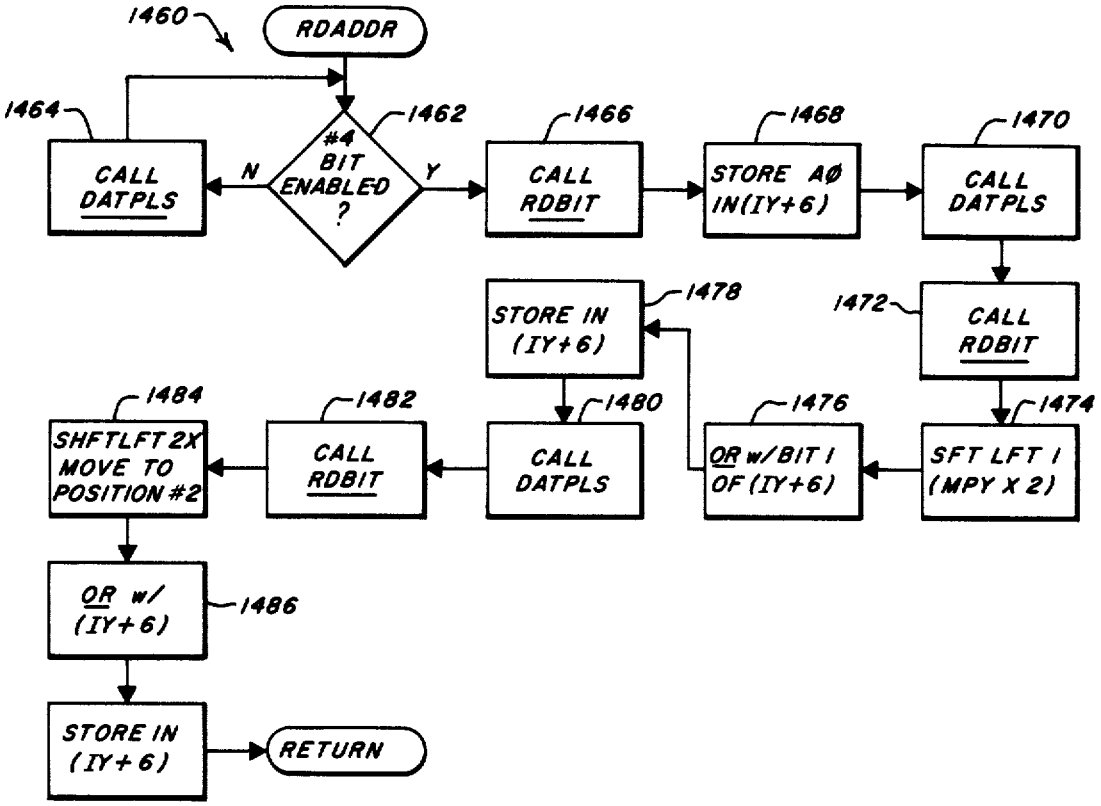
FIG. 31 is a flow chart of the read address (RDADDR) subroutine.

The read address subroutine RDADDR 1460 is shown in FIG. 31. The system first checks to see if the fourth data bit is enabled, block 1462. If the fourth bit is not enabled, the DATPLS subroutine 1340 of FIG. 23 is called, block 1464, to increment the data counter within the enabled PID until the fourth bit is enabled. When it is enabled, the RDBIT program 1440 of FIG. 30 is called to read the data bit from the quad cable driver, block 1466. Next, the data bit is stored in the RAM location of IY30 6 at step 1468. Thereafter, the DATPLS subroutine 1340 is called to increment the data counters of each PID to the next data bit location, block 1470. Next, the RDBIT program 1340 is called to read the next PID data bit, block 1472. Next, the value for the $A_1$ bit is shifted left one location, multiplying the value by 2, block 1474; the result is then ORed with the first bit read (block 1466) above, block 1476. The result is stored in the RAM at locations IY+6, block 1478. Thereafter, the DATPLS subroutine is called in to increment data counters to the next data bit, block 1480, by calling the RDBIT program of FIG. 30, block 1482. The resulting data bit is shifted left twice to move into the number 2 position, block 1482, so as to be ORed with the current IY+6 register value, block 1486, and is stored in the IY+6 register, block 1488. Finally, the program returns to the program that called it.

Figure 32:
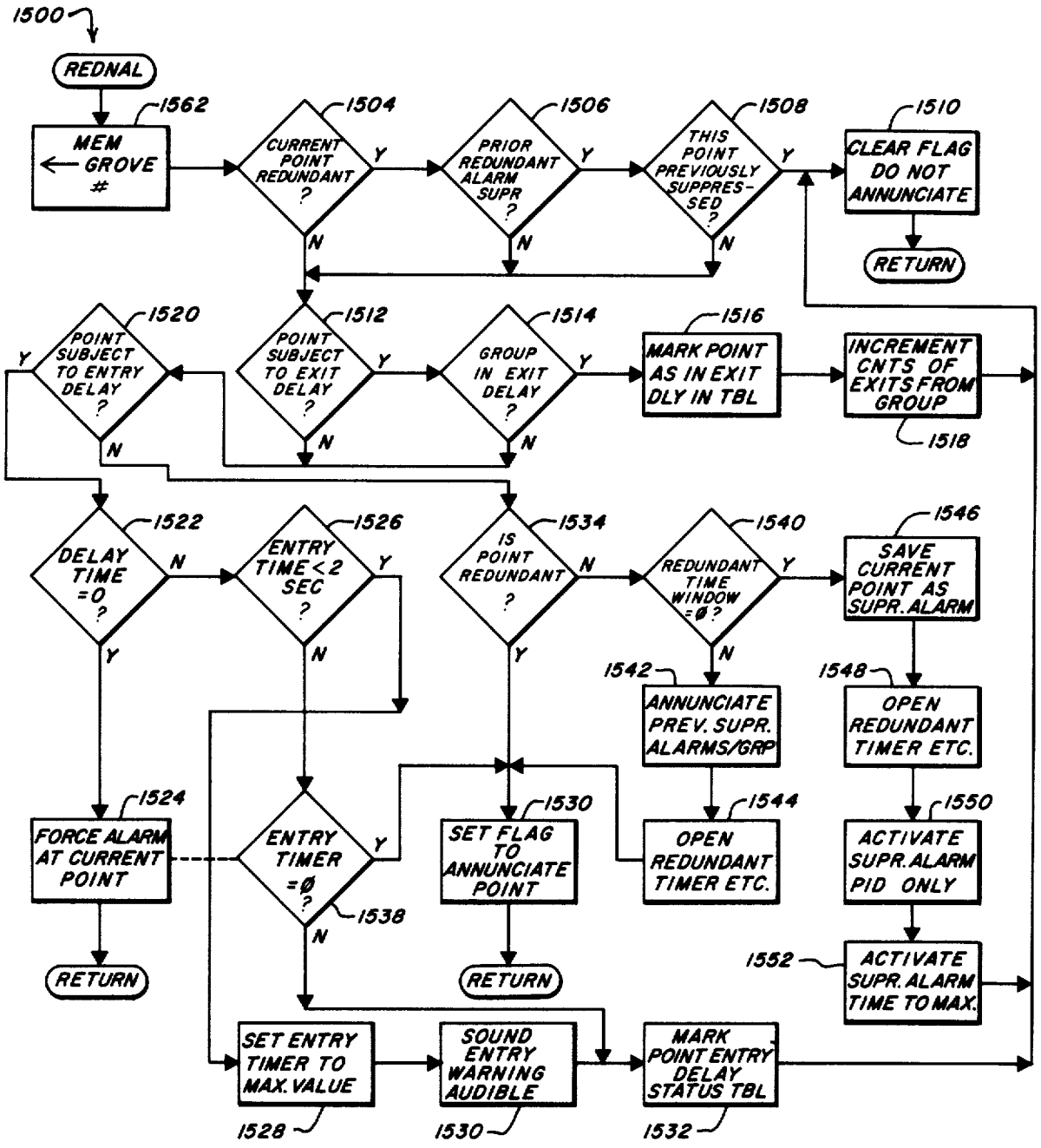
FIG. 32 is a flow chart of the redundancy checking subroutine (REDNAL)

The integrated security system redundancy, entry, exit delay check on new alarms is shown in FIG. 32. The current point or PID group number is saved in a memory location at the current group number subroutine REDNAL, block 1502. The system checks whether the current point or PID is redundant, block 1504. If the PID addressed is redundant, the system next checks to see whether a previous redundant alarm has been suppressed, block 1506. If it has been, the system further checks whether this point has been previously suppressed, block 1508, and clears the annunciate flag, block 1510, clearly indicating that this current point is not to be annunciated. The system then returns to the calling program. If the tests of blocks 1504–1508 are all negative, the system next checks to see whether the point currently being read is subject to an exit delay, block 1512. If the point is subject to an exit delay, the system checks to see whether the group which contains the current PID is in exit delay, block 1514. If there is an exit delay, the current point is marked as in-exit-delay in the status table, IX register+bit number, block 1516. Next, the software increments counts the exits from the current group, block 1518. The program thereafter returns to block 1510 so as to clear the annunciate flag and not annunciate the alarm. If the tests of blocks 1512 and 1514, relating to delay times, both result in a negative response, the program next determines whether the point is subject to an entry delay, block 1520. If there is an entry delay for that point, the program determines whether the current value for the entry delay group time is equal to 0, and the PID is in entry delay (IX+bit number), block 1522. If the delay time equals 0, the alarm is forced at the current point, block 1524, and the program returns to the subroutine from which it was called. If the delay time is not equal to 0, block 1522, the system determines whether or not the entry time is greater than 2 seconds, bloc, 1526. If the entry time is greater than 2 seconds, nothing happens, i.e., no annunciation occurs. The audible alarm is sounded, block 1530, and the point is marked for entry delay status at the status cable, block 1532. The program then returns to block 1510, so as to clear the annunciate flag and not annunciate the status change. If the entry timer is not greater than 2 seconds as determined by block 1526, the system determines whether or not the entry timer is equal to a value of 0, block 1538. If the entry timer is greater than 0, the annunicate flag is set, and the point alarm is annunciated, block 1536; the program thereafter returns to that program which called it. A user option sets delay time to a maximum value when the entry timer equals zero. If the point is not subject to an exit delay, block 1520, the test at block 1534 next determines whether the point is redundant. If the point is not redundant, the program sets the flag, block 1536, which, in turn, causes the point to be annunciated, block 1536. If the point is redundant, as per block 1534, the value for the redundant time window for the group is determined, block 1540. If the time window value is not equal to 0, the system will annunciate any previously suppressed alarm for the current group, block 1542. Thereafter, the system will open [reset] the redundant timer for all groups redundant with this one, to a second window maximum value, block 1544. Window number 1 defines how long to look for a second alarm; window number 2 is how long subsequent alarms are reported immediately following the first two alarms. Thereafter, the program moves to block 1536, discussed above. If the redundant time window is equal to 0, the current point number is saved as the suppressed alarm for groups redundant within the current group, block 1546. Next, the redundant timer is open for all groups (redundant with this one) to the first window maximum value at step 1548. Thereafter, the suppressed alarm indicator is set for the addressed PID device only, block 1550. The suppressed alarm timer is set to the maximum value, block 1552, and the system thereafter returns to block 1510 so as to clear the flag and not annunciate the current point change of state. The program finally returns to the calling program.

Figure 33:
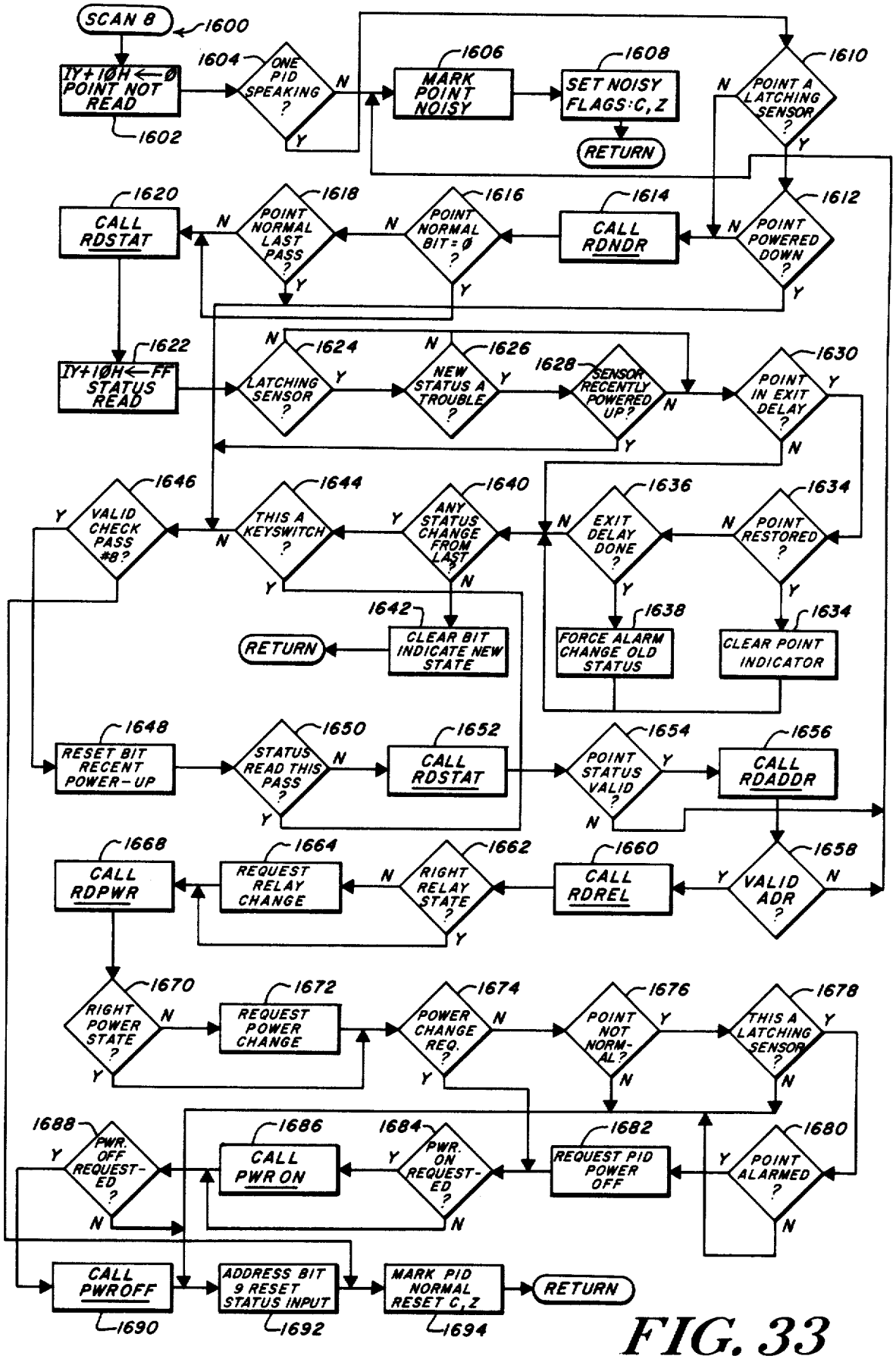
FIG. 33 is a flow chart of the validity checking subroutine (SCAN8)

The integrated security system SCAN8 subroutine 1600, shown in FIG. 33, routinely scans the PIDs and calls to recognize changes of state; also, once every eight passes, SCAN8 1600 checks the integrity of each PID device. First, the system marks whether a point status has not been read by storing 0 in the RAM location IY+10 (hex), block 1602. Next, the system checks to see whether only one PID device is currently answering back on the line, block 1604. This also has the significance of detecting attempts to bridge (defeat) the PID device by providing an excessive return current indicator signal, SHHTST, as detected in the quad cable driver of FIG. 13, discussed above. If the current on the signal S-lead of the PID is excessive according to this test at 1604, the point is marked "noisy" at step 1606, and the noisy flags are set. These flages comprise the C-bit and Z-bit, within the CPU 202. The program then returns to the program from which this one was called. If only one PID device was speaking according to the test at block 1604, the system determines whether or not the point is a latching sensor (according to custom information stored at 8000–9FFF). If the point includes a latching sensor, the system determines whether or not the point is currently powered down, block 1612. If neither the tests at blocks 1610 or 1612 are positive, the system calls the RDNOR subroutine 1730 of FIG. 28, (not yet discussed) block 1614; this subroutine reads the first bit from the PID device called. Next, the program determines whether or not the point is normal, by the value of the first bit read from the PID, block 1616. If it is not normal (equal to Ø), the system determines whether or not the point was normal during the last pass of PID device interrogation, block 1618. If the first bit was not normal, corresponding to a bit having a value of 1 during the last pass and also a bit value of 1 during this pass, the RDSTAT program 1400 shown in FIG. 27, discussed above, is called, block 1620. Thereafter, the program marks whether the status has been read by loading a hex value of FF in the location IY+10 hex, block 1622. Thereafter, the system again determines whether or not the sensor is a latching sensor, block 1624. If the sensor is a latching sensor, the system determines whether or not the new status signifies a trouble signal at the sensor, block 1626. If the response is positive, the system determines whether or not the sensor was recently powered up, block 1628. If it was not, or if the tests of blocks 1624 and 1626 were both negative, the next test determines whether or not the point is in an exit delay period, block 1630. If the point is in an exit delay, the next determination is ether the point has been restored, block 1632. If the point has been restored, the exit delay indicator for that point is cleared, block 1634. If that point has not been restored at block 1632, the system determines whether the exit delay is completed, block 1636. If the delay has been completed, the alarm is forced at that point by changing the old alarm status bit, block 1638. Thereafter, or after block 1634, or if the test, block 1630, is negative, or if the exit delay has not been completed, block 1636, the program next determines whether there has been any status change since the last scan of the PID devices, block 1640. If there has been a change, the bit in IX+Ø is cleared to indicate the new state. Thereafter, the program returns to the calling subroutine. If the test of block 1640 reveals no change of state since the last scan, the system determines whether or not a keyswitch has been activated, block 1644. If a keyswitch has not been activated, or if the tests at blocks 1612, 1618, and 1628 are all affirmative, the system next determines whether the current pass of scanning the PID devices is the one during which the validity is to be checked; that is, whether it is the eighth sequential scan, block 1646. If it is that scan, the system resets the recent power-up bit at step 1648. If the current scan is not the scan during which to check the validity of the PID devices, the program directly marks the PID as normal and resets the C and Z noisy flag bits, block 1694; thereafter, the program returns to the calling program. After the power-up bit is reset, block 1648, the system determines whether or not the status has been read for the present point, block 1650. If it has not been read, the system calls the RDSTAT subroutine 1400 of FIG. 27, block 1652. Thereafter, or if the status has been read for this current point doing this current task, or if a keyswitch is being read at block 1644, the program next checks to see whether the point has a valid status, block 1654. If the program does not have a valid status, the subroutine returns to block 1606 and marks the PID as noisy and sets the appropriate flags to return it to the calling subroutine, block 1608. If the point status is valid, block 1654, the RDADDR subroutine of FIG. 31 is called to read the address of that PID, block 1656. The system determines the validity of the address by comparing the reported address bits from the PID to the last three bits provided by counting the address pulses since the last address reset, block 1658. Thereafter, the relay state is read by calling the RDREL subroutine 1740 of FIG. 29 (not yet discussed), block 1660. The relay state is now compared to its proper relay state, block 1662. If the state does not correspond to the desired relay state, the system requests a relay change of state, block 1664. Thereafter, or if the relay currently is in the proper state at block 1662, the system determines the status of the power signal by calling the RDPWR subroutine, identical to the RDREL subroutine of FIG. 29, except for a different PID data value block 1668. Thereafter, the system determines whether or not the power state is in the correct mode, block 1670. If not, the system requests a power change of state, block 1672. Afterwards, or if the power state is in the proper status, the system determines whether or not a power change of state has been requested, block 1674. If no change of state has been requested, the system determines whether the point is normal according to the first bit read, block 1676. If the point (PID) is not-normal the system determines whether or nor the sensor is a latching sensor, block 1678. If the sensor is a latching sensor according to data stored in user customized PROM, the system determines whether or not the point is alarmed (disturbed), block 1680. If the point is alarmed, the system determines whether a request for power-off has been made, block 1682. The system determines whether or not a power-on request has been created, block 1684. If a power-on request does exist, the system turns on the power-on lead of the PID, by calling the PWRON subroutine, which is the same as the ONPLS subroutine, FIG. 35, except that PID data counter is set to different corresponding value block 1686. Thereafter, or if no power-on request has been provided, the system determines whether or not a power-off request has been generated, block 1688. If a power-off request does exist, the system turns off the power signal of the PID sensor, block 1690, by calling the PWROFF subroutine, which is the same as the OFFPLS subroutine of FIG. 37, except that the PID data counter is set to a different corresponding value. Thereafter, or if the power-off request does not exist, block 1688, or if the tests of blocks 1676, 1678, or 1680 are negative, the system addresses and resets the PID, in block 1692. Thereafter, the PID is marked as normal, and the C and Z bits are reset. Finally, the program returns to the calling subroutine.

Figure 34:
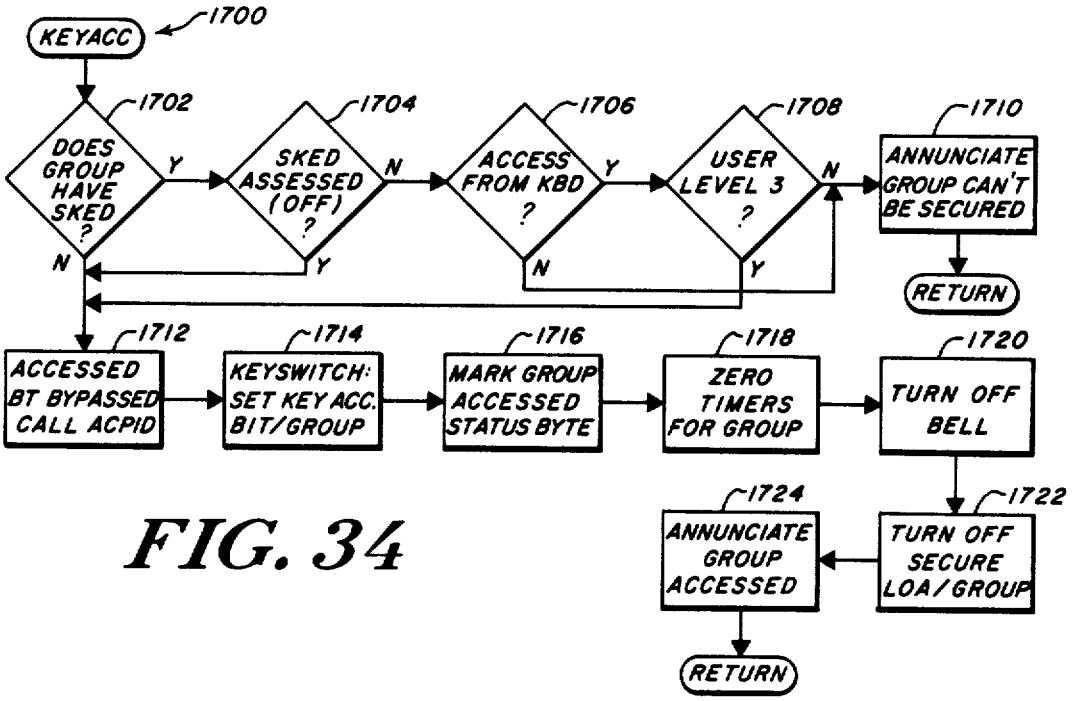
FIG. 34 is a flow chart of the key access (KEYACC) subroutine.

The subroutine controlling the keyswitch open group action, KEYACC, 1700, is shown in FIG. 34. The system determines whether or not the group has a schedule, (whether an option time schedule is stored in user customized PROM), block 1702. Next, the system determines whether or not the schedule is being accessed (off), block 1704. If it is not, the system determines whether or not the access originates from the keyboard, block 1706. If the access originates from the keyboard, the system determines whether or not the current program relates to a "level 3" user, such as an equipment service man. If the access is not from the keyboard, or if the level is not 3 according to blocks 1706 and 1708, respectively, the annunciate group cannot be secured, block 1710. Thereafter, the subroutine returns to the calling program. If the schedule is accessed, or if the group does not have a schedule, blocks 1704 and 1702, respectively, or if the user is level 3, block 1708, the system sets accessed bit for all points in the current group, and clears the bypassed bit indicator, block 1712. The program therein calls the ACPID subroutine 1950 of FIG. 44 (not yet discussed). Thereafter, the key accessed bit is set for the group if the access was from a keyswitch, block 1714. The group is marked as accessed in the group status byte, block 1716. Thereafter, the entry and exit delay timers are zeroed, block 1718. The alarm bell is turned off, block 1720; the secure command only PID (a relay PID with relay output only) COP is turned off for that group, block 1722. The COP is activated whenever the group is "closed". The group accessed is annunciated, block 1724. Finally, the subroutine returns to the program from which this subroutine was called.

Figure 28:
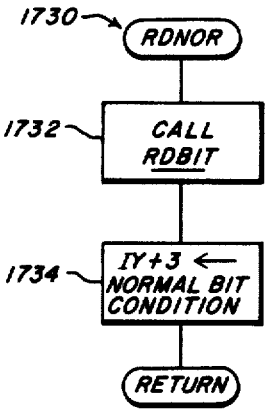
FIG. 28 is a flow chart of the read normal bit (RDNOR) subroutine.

The integrated security system software checks the normal bit of the data provided by the PID devices by the read normal bit subroutine, RDNOR, 1730, as shown in FIG. 28. The subroutine RDBIT 1440 shown in FIG. 30 is called, block 1732. After the data bit is read from the quad cable driver corresponding to the cable and PID addressed, the normal bit condition is stored in the RAM location corresponding to that cable at the location of IY+3, block 1734. Thereafter, the program returns to the calling program.

Figure 29:
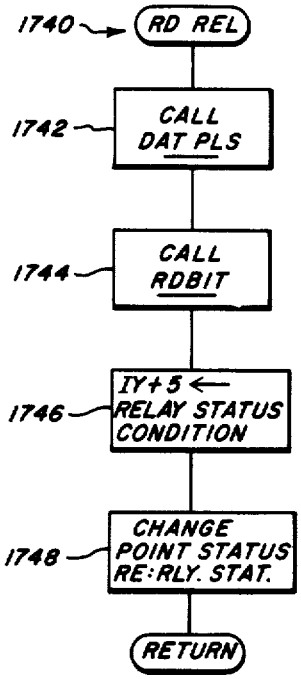
FIG. 29 is a flow chart of the read relay subroutine (RDREL)

The status of the relay residing at the particular PID addressed is monitored by the RDREL subroutine 1740, as shown in FIG. 29. The program first calls the DATPLS subroutine 1340 shown in FIG. 23 and discussed above. The data pulse is sent on the current cable to increment the PID data counter to the next data bit. Next, the subroutine calls the RDBIT subroutine of FIG. 30 in order to read the data bit from the quad cable driver, block 1744. The data bit read is the newly addressed data bit. The relay status (bit) is stored at the RAM location IY+5, block 1746. A change in relay status is reflected as a change in point status, block 1748. Thereafter, the subroutine returns to the calling program.

Figure 36:
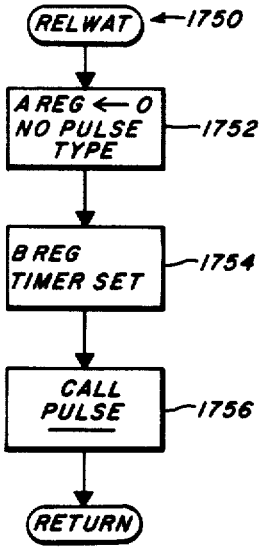
FIG. 36 is a flow chart of the relay pulse delay subroutine (RELWAT)

The relay wait RELWAT subroutine 1750, shown in FIG. 36, provides a specified delay time between signal pulse events which minimizes erroneous information derived from cross talk between the S-lead and the C-lead signaling of the quad cables. The subroutine loads a zero value into the A register, indicating that no pulse is to be transmitted, block 1752. A predetermined silent period is created by loading a corresponding number into the B register, which controls the pulse timer, block 1754. Finally, the subroutine PULSE 1780 of FIG. 25 is called to transmit the pulse if a non-null pulse is specified over the respective quad cable, block 1756.

Figure 25:
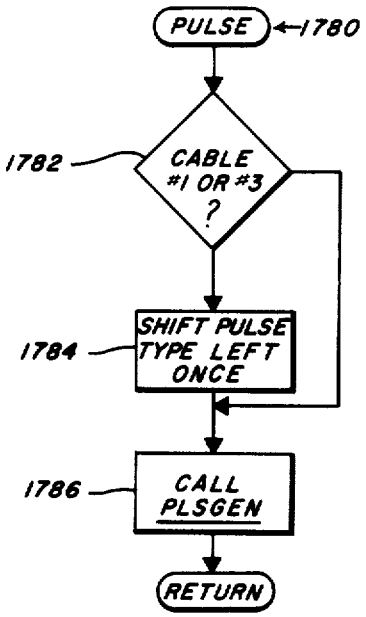
FIG. 25 is a flow chart of the pulse (PULSE) subroutine.
Figure 26:
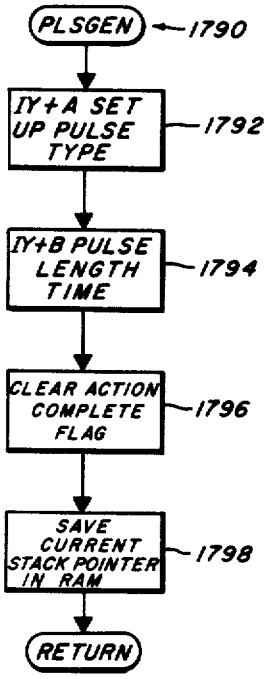
FIG. 26 is a flow chart of the pulse generating (PLSGEN) subroutine.

The subroutine which provides the specified signal pulse over each of the respective quad cables is provided by the PULSE subroutine, 1780, of FIG. 25. The system determines whether cable 1 or cable 3 (instead of cable 2 or 4) is to receive the desired pulse, block 1782. If the cable is either 1 or 3, the pulse type loaded into the A register is shifted left by one position, block 1784. The PLSGEN subroutine 1790 of FIG. 26 is called to transmit the pulse, block 1786. Finally, the subroutine returns to the calling program.

The transmitting pulse subroutine PLSGEN 1790 is shown in FIG. 26. The pulse length is determined at block 1792. The length of pulse time is established at the block 1794 according to pulse type (e.g. count, reset, etc.) specified. Thereafter, the action complete flag is cleared, block 1796, and the current stack pointer is saved in the relative cable RAM location, block 1798. Finally, the subroutine returns to the calling program.

Figure 35:
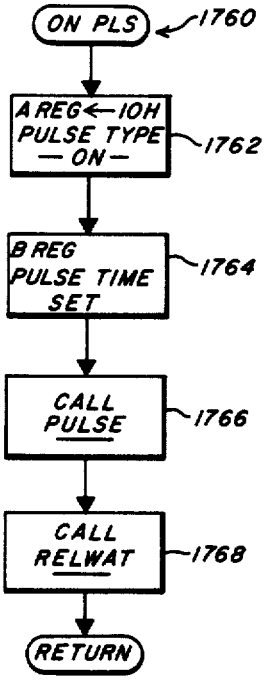
FIG. 35 is a flow chart of the ON pulse (ONPLS) subroutine.

The subroutine turning the remotely controlled relays or power switches on at each of the PID devices is the ONPLS program 1760 shown in FIG. 35. The A register is loaded with a value of 10 hex, which establishes an on pulse type, block 1762. Next, the pulse duration is defined by loading a number into the B register to define a long time interval, block 1764. The PULSE subroutine 1780 of FIG. 25 is called, block 1766, to request that a pulse be generated by the quad cable driver. Thereafter, the subroutine generates a quiet period where no pulsing on the quad cable is initiated, to allow the carrier lead to settle and the relay to activate, as provided by the RELWAT subroutine of FIG. 36, block 1768. Finally, the subroutine returns to the program from which it was called.

Figure 37:
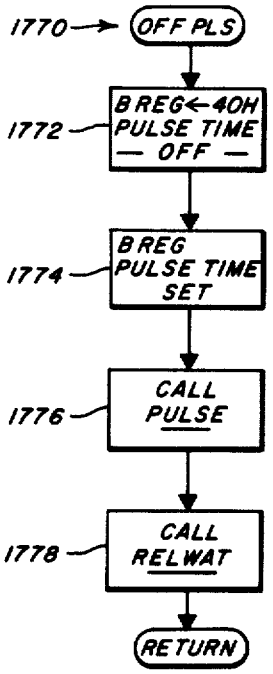
FIG. 37 is a flow chart of the OFF pulse (OFFPLS) subroutine.

The program to deactivate the remotely controlled relays is provided by the OFFPLS subroutine, 1770, of FIG. 37. The pulse type is defined as "off" by loading a value of 40 hex into the A register, block 1772. The duration of the long pulse time is defined by loading a corresponding number into the B register, block 1774. The PULSE subroutine of FIG. 25 is called to request that a pulse by generated by the quad cable driver, block 1776. Thereafter, a waiting period is generated following the relay action to allow the signal changes to subdue, block 1778. The program then returns to the calling subroutine.

Figure 41:
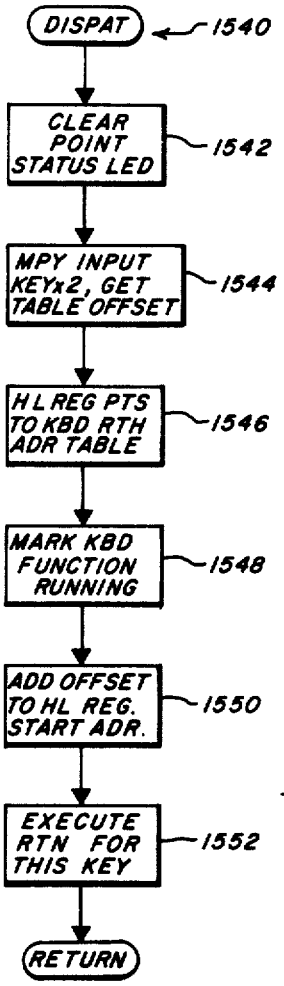
FIG. 41 is a flow chart of the dispatch subroutine (DISPAT)

The keyboard input dispatch routine DISPAT 1540 is shown at FIG. 41. The bits corresponding to the point status light emitting diode (LED) are cleared, block 1542. Next, the subroutine gets the input key number and multiplies it by 2 to get the table offset value, (or number of bytes in the address), block 1544. The HL register points to the start of the keyboard routine address table, block 1546. Next, the system marks that the keyboard function is running, block 1548. The computer offset is added to the HL register value to produce the start address of the routine corresponding to the key hit on the keyboard, block 1550. The subroutine executes this routine for the particular key activated by the user, block 1552. If the key stroke is improper, or if other errors in use of the keyboard arise, the subroutine determines that an input error has occurred, and the message "KEYBOARD ERROR" appears on the LCD.

Printing of the messages is considered a task similar, but lower, in status to the PID devices on quad cables. The print handling routine, PRHNDL, 1800, is shown in FIG. 39. This subroutine first checks whether or not message printing is now enabled, block 1802. If it is enabled, the system marks a high priority print message as in progress, block 1804. Next, the system checks the control inputs for changes of state and annunciates those changes, block 1806. The break-in alarm messages are annunciated, block 1808. Cable troubles are also annunciated, block 1810. Next, the system determines whether the point change of state condition requires annunciation, block 1812; if not, the system will annunciate the hourly message, block 1814. Thereafter, or if the printing is not enabled according to the decision block 1802, the subroutine moves to block 1820, discussed below. If the point change of state of block 1812 requires annunciation, it is annunciated, block 1816. Thereafter, the point is removed from the print queue, block 1818. The program then moves to block 1820, where the stack pointer is moved to indicate the bottom of the stack, block 1820. Thereafter, the subroutine pushes the beginning address of this subroutine, PRHNDL, block 1822. All registers are pushed from the stacks, block 1824; also, the new stack pointer for the print routine stack pointer, is stored in RAM memory locations $PRSP_H$ ad $PRSP_L$, block 1826. Finally, the high priority print flag is cleared, block 1828, and the subroutine returns to the calling program.

Figure 38:
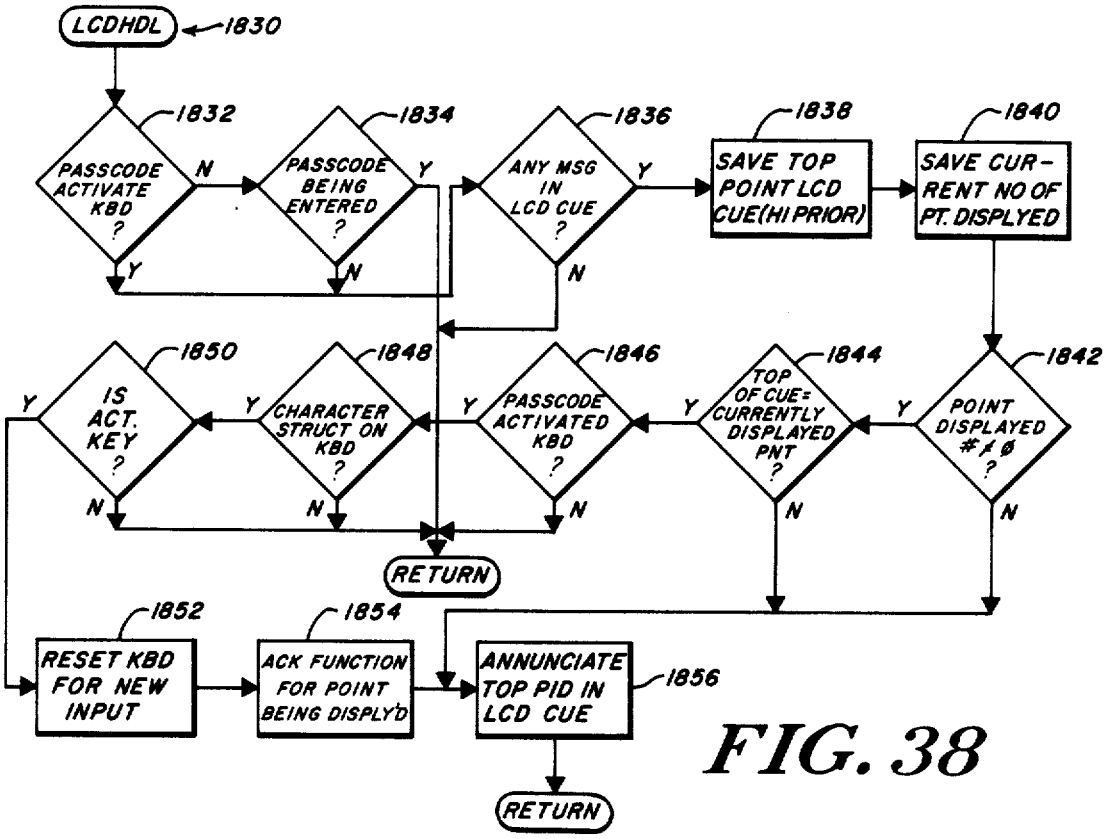
FIG. 38 is a flow chart of the liquid crystal display subroutine (LCDHDL)

The subroutine to control the display of messages on the liquid crystal display (LCD) is the LCDHDL subroutine, 1830, described in FIG. 38. The first step is to determine whether the passcode has activated the keyboard, block 1832. If the keyboard has not been activated, the system inquires whether the passcode is currently being entered, block 1834. If the passcode has activated the keyboard, block 1832. or if the passcode is not currently being entered, block 1834, the system determines whether or not there is currently any message in the LCD queue, block 1836. If there is, the subroutine will save the top point number in the LCD queue, relating to the highest priority message, block 1838. Next, the current number of the point will be saved, at the LCDHAS location in RAM, block 1840. At block 1842, the system determines whether or not the number of the point being displayed is equal to 0. If it is not equal to 0, the number at the top of the print queue is compared to the current point displayed on the LCD, block 1844; if equal, the system next determines whether the passcode has activated the keyboard, block 1846. If the passcode has activated the keyboard, the subroutine determines whether or not a character has been struck on the keyboard, block 1848. If a character has been struck, the system determines whether it was the acknowledge key, block 1850. It is was the acknowledge key, the keyboard is reset to await a new key function input, block 1852. The acknowledge function for the point being displayed is next performed, block 1854. Thereafter, or if the comparisons of blocks 1844 and 1842 are both negative, the top PID number in the LCD message queue values will be annunciated, block 1856. Finally, this subroutine returns to the calling program. If the passcode is currently being entered, block 1834, or if the decisions at blocks 1836, 1846, 1858, and 1850 were all negative, the subroutine will return to the program from which it was called without performing any action in the LCD display.

Figure 40:
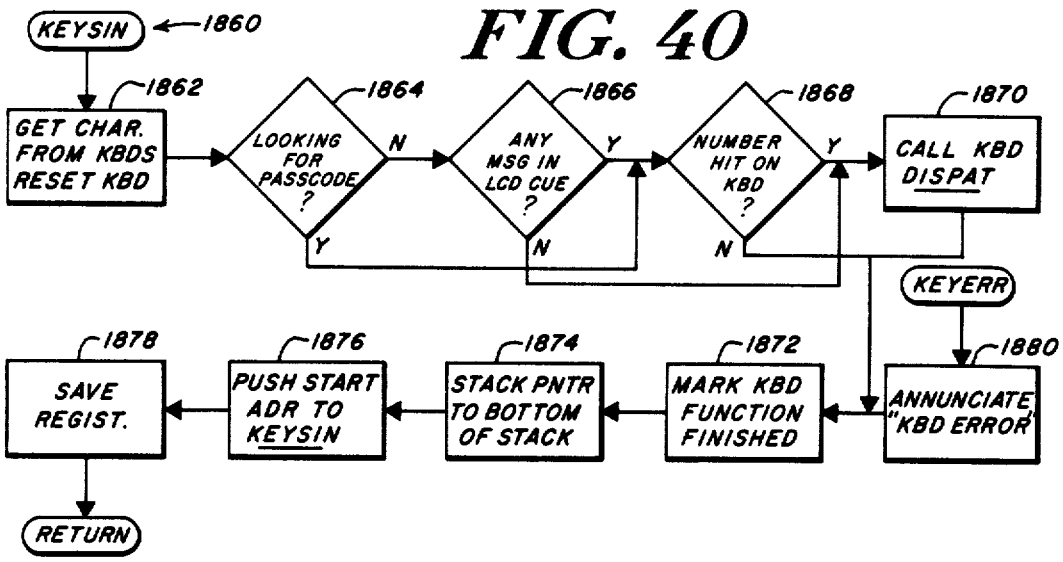
FIG. 40 is a flow chart of the keyboard input (KEYSIN) subroutine.

The subroutine for receiving the information provided by the keystroke input is described in the subroutine KEYSIN, 1860, described in FIG. 40. The first step is to get the character from the keyboard and reset the keyboard thereafter, block 1862. Next, the subroutine determines whether it is in the mode for looking for a passcode at the keyboard input, block 1864. If it is looking for a passcode, as determined by the history of keystroke inputs, the subroutine will move directly to block 1868, discussed below. If the system is not looking for a passcode, the system determines whether or not a message exists in the LCD queue, block 1866. If a message does exist, the system determines whether or not a number has been struck on the keyboard, block 1868. If a number has been struck, the system advances, block 1872, to mark the keyboard function as running. If there is no message in the LCD queue, block 1866, or if a number has been hit on the keyboard, block 1868, the system calls the DISPAT program 1540 of FIG. 41. Thereafter, the program returns to block 1872, described above. A keyboard error may result if the improper keystroke is entered; if an error results, the KEYERR subroutine (not shown) may be entered, block 1880, to annunciate the keyboard error. Thereafter, the subroutine marks the keyboard function as completed, block 1872. The stack pointer is moved to the bottom of the data stack, block 1874, and the start address of the KEYSIN subroutine is pushed, block 1876. Finally, all registers are saved, block 1878, and the subroutine returns to the program that called it.

Figure 42:
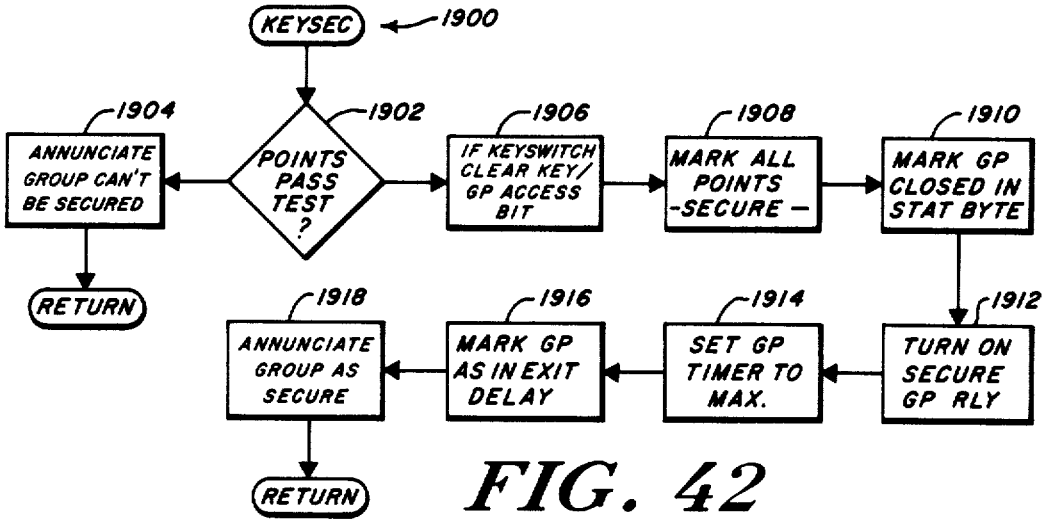
FIG. 42 is a flow chart of the keyswitch closing subroutine.

The subroutine indicating whether or not a group can be secured, and securing them if possible, the KEYSEC subroutine, 1900, is shown in FIG. 42. The first function of this subroutine, block 1902, determines whether or not the particular PIDs addressed pass the security check test of the CHKSEC subroutine 1920 of FIG. 43, discussed below. If the particular bit corresponding to the security status of that point indicates that the point cannot be secured, the subroutine 1900 indicates that that group cannot be secured, block 1904, and returns to the calling program. However, if the point indicates that it can be secured from the CHKSEC subroutine shown in FIG. 43, the key access bit for that group is cleared if the entry is from a keyswitch, block 1906. Next, all points in that group are marked as secure, block 1908. The group status byte marks the group as closed, block 1910. Thereafter, the subroutine turns on the secure group relay, (connected to any display desired, typically a red LED), block 1912. Next, the group timer is set to a maximum value, block 1914. The group is marked as being in the exit delay mode, block 1916. Finally, the group is annunciated as secure, block 1981, and the subroutine returns to the calling program.

Figure 43:
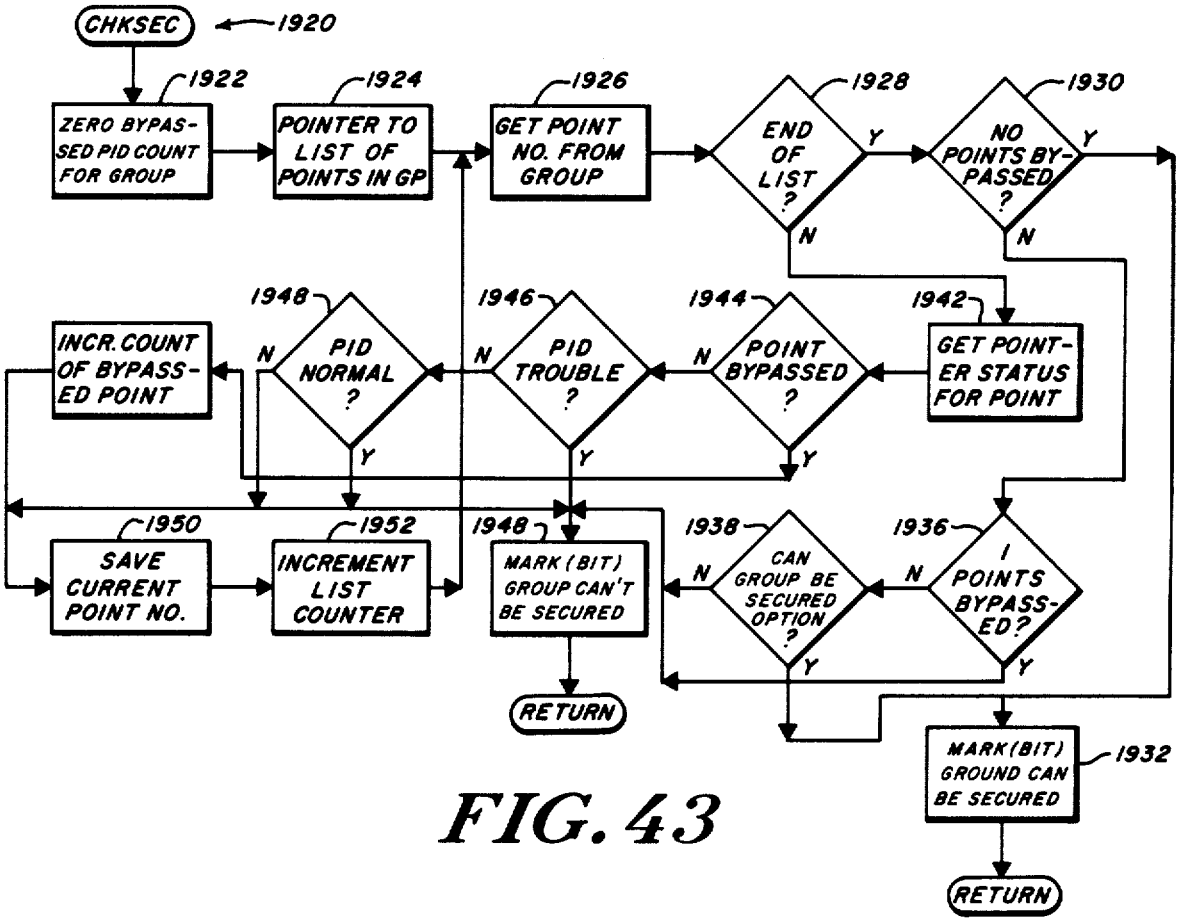
FIG. 43 is a flow chart of the security check (CHKSEC) subroutine.

The subroutine checking the security status of the individual points, or PID devices, is the CHKSEC subroutine, 1920, shown in FIG. 43. The first step is to zero the bypassed PID count number for the particular group in question, block 1922. The pointer moves to the list of points in the group, block 1924. Thereafter, the point number for that group is retrieved, block 1926. A determination is made whether or not the pointer is pointing to the end of the list by determining whether or not the current point was the same as the last point, block 1928. If the current point is the end of the list (last point), the subroutine also determines whether there were any points bypassed in this group, block 1930. If there were no point bypassed, block 1930, the bit indicating secure position is marked as such, block 1932, and the subroutine returns to the calling program. If, in fact, there were points bypassed, block 1930, it is next determined whether or not there was more than one point bypassed, block 1936. If there was not more than one point bypassed, and an option which allows a group to be secured with no more than one point bypassed is invoked, block 1938, the subroutine then moves to block 1932 and marks the group as secure. If, in fact, there is more than one point bypassed, or the option is not allowed according to the decisions of block 1936 and 1938, the bit is marked to indicate that the group cannot be secured, block 1940, and the subroutine returns to the calling program. If it is determined that the end of the list of points has not yet occurred, block 1928, the pointer status for that particular point is retrieved, block 1942, at IX+Ø, IX+1 RAM locations for current PID. Next, the system determines whether or not the point was bypassed, block 1944. If the point was not bypassed, the system determines whether or not the PID has trouble, block 1946. If the PID does not have trouble (the PID is normal) according to a determination at block 1948, the current point number is saved, block 1950. Thereafter, the list pointer is incremented, block 1952, and the program then returns to block 1926 and repeats the program alternatives as described. If the point has been bypassed according to the determination of block 1944, the program increments a count of bypassed points, block 1954. Thereafter, the program enters the block 1950 as described above to provide the appropriate program functions. Also, if the PID has trouble according to the determination at block 1946 or the PID is not normal, block 1948, the program enters block 1940, thus indicating that the group cannot be secured, thereafter returning to the calling program.

Figure 44:
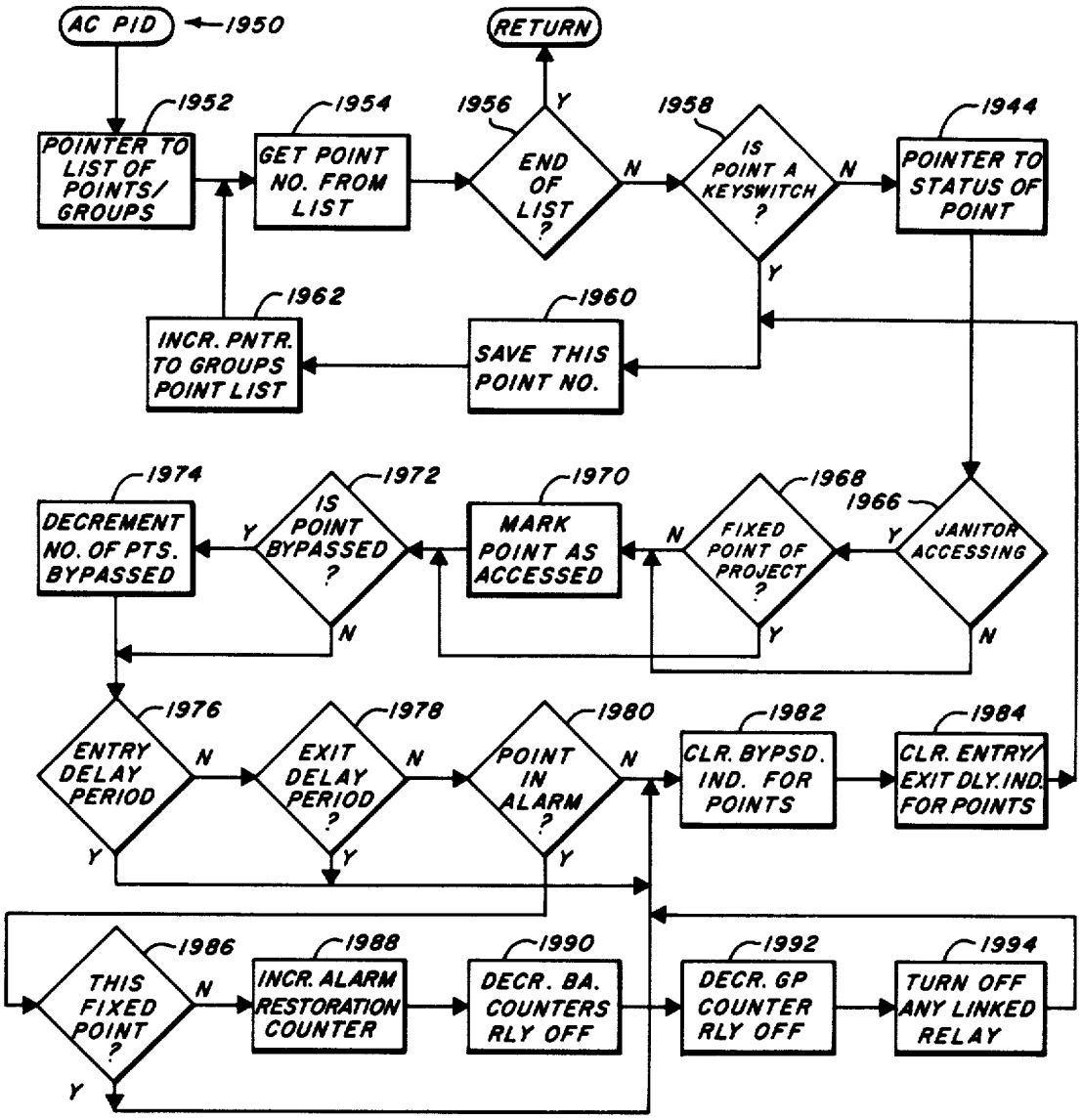
FIG. 44 is a flow chart of the PID access subroutine (ACPID)

The subroutine to access each particular PID device is the ACPID subroutine 1950, shown in FIG. 44. The first step points to the list of points for the particular group serviced, block 1952. Next, the point number is retrieved from the list, block 1954. If the point is at the end of the list, determined by its being identical to the last point retrieved, block 1956, the subroutine returns to the program which called it. If the list is not at the end, block 1958 determines whether a point is a keyswitch point. If it is, the point number is saved at block 1960, and the pointer is incremented to point to the group point list, block 1962. Thereafter, the program returns to block 1954 to perform the functions described. If the point is not a keyswitch, block 1958, the pointer moves to the status of the point, block 1964. Next, a determination is made whether or not the janitor is accessing the group, block 1966. If it is the janitor (identified by a previously entered passcode), block 1968 determines whether this is a fixed point of protection. If it is not a fixed point of protection, or the janitor is not accessing, block 1966, the point is marked as accessed, block 1970. Thereafter, or if the point is a fixed point of protection, block 1968, the subroutine determines whether the point is bypassed, block 1972. If the point is bypassed, the counter corresponding to the number of points bypassed is decremented by a value of 1, block 1974. Thereafter, or if the point is not bypassed according to the determination of block 1972, the system determines whether or not an entry delay period is allowed for the particular point, block 1976. If there is no entry delay period to be allowed, then the system determines whether an exit delay period is allowed, block 1978. If there is no exit delay period allowed, the system determines whether the point is in alarm condition, block 1980. Then the bypass indicator for the particular point is cleared, block 1982. Thereafter, the entry and exit delay indicators for that particular point are cleared, block 1984. Thereafter, the system returns to block 1960 to perform the operations thusly described. If the point is in alarm condition, block 1980, the system determines whether it is a "fixed" point, block 1986. If the point is a fixed point, or if the tests at blocks 1976 and 1978 are both affirmative, the program then returns to block 1982 for the function described. If the point is not fixed according to the test at block 1986, the alarm restoration counter is incremented by a value of 1, block 1988. Thereafter, the break-in alarm counter is decremented by a value of 1, block 1990. Also, if the value of the counter is 0, the relay (indicating the BA-type alarm) is turned off. Thereafter, the group counter is decremented, block 1992. Similarly, if the count equals 0, the group alarm relay is also turned off. Finally, any linked relays are turned off, block 1994. Thereafter, the program returns to block 1982 for functions thusly described. Any point can have a relay linked to it by program control. For instance, if a relay is linked to a PID, it is activated whenever the point is secure and alarmed. The +12 and +5 volt power supply signals to the communication card 289 are controlled by the relay 448. The relay is powered by transistor 447. The transistor 447 receives its base drive through resistors 445 and 446 from the disable signal 438.

The interaction between the security system control unit 200 and communication card within it, 289, is shown in the software programs of FIG. 45. The polling of up to four transmission cards 289 by the system is done by calling the subroutine CCCMLP 2100, during the hardware interrupt. Each time the subroutine CCCMLP is called, it services one communication card, sequentially covering all four. The subroutine CCCMLP 2100 is the main routine responsible for identifying the card being serviced, and for positioning all relevant data pointers to the proper RAM and ROM data fields for that transmission card. After the card is identified, block 2102, the number of the communication card (03) is computed and checked by using the current state of the interface counter. The I/O port to be used is also identified among those shown in Table II above, at block 2104. The subroutine COMCRD 2110 is called, block 2106; thereafter, the program CCCMLP returns to the calling program.

The subroutine COMCRD, 2110, called in the subroutine CCCMLP 2100, performs actions according to the information received from the transmission card to which it has been directed by the program CCCMLP. The program COMCRD expects to receive at least one, typically two, bytes of data from the communication card, the first of which being a status byte which gives information about the communication card's status, block 2112. The data returned from the card indicates whether or not a card exists in that position, at block 2114. If a card does exist, the subroutine requests the card status at block 2116. These requests include requests such as sonalart (audible) alarm indication and other signals. If these signals include a read flag, the block 2120 determines if the read flag is set. If it is set, the memory is read, and the information is sent to the communication card. The data is requested from either the ROM or RAM memory areas and is accessed by the second byte from the communication card data port. If the read flag is not set, the subroutine stores the data from the communication card in the RAM memory, according to the block 2124, wherein the subroutine WRTRAM is called. If there is no data from the card specified, or after the program RDMEM and WRTRAM are completed, the COMCRD program returns to the CCCMLP program.

The RDMEM program called in step 2122 is shown at 2130. The subroutine determines if a ROM read flag has been set at block 2132. If it has not been set, the subroutine determines if an address offset is set to a value of zero, at block 2134. If it has not been set to zero, the RAM address is added to the offset, and the passcard code is computed, if necessary, at block 2136. Thereafter, the address is sent to the communication card at block 2138. If the ROM flag is not set at block 2132, the ROM address is retrieved for the card currently enabled, and added to the offset from the particular card, block 2140. Next, the program moves to block 2138, discussed above.

If the card offset is equal to zero according to step 2134, the card identification address is retrieved at step 2142. Thereafter, the program proceeds to step 2138, as discussed above.

The WRTRAM subroutine 2145, called in step 2124, first determines if the write flag has been set, block 2146. If it has not been set, the data is loaded into the RAM area specified by the communication byte number plus the RAM offset number. Thereafter, the program returns to the subroutine COMCRD. If the write flag has been set, block 2146, the data received is written into the command byte of the communication card RAM, block 2147. Thereafter, the program WRTRAM returns to the COMCRD subroutine, which in turn returns to the CCCMLP subroutine 2100, discussed above.

The invention is not to be limited by what has been particularly shown and described except as indicated in the appended claims.

What is claimed is:

1. A security system comprising:

a control unit;

a plurality of cables, each connected to the control unit and each having a respective address;

a plurality of point interface devices each having a respective address, and at least one point interface device being connected to each of said cables;

each of the point interface devices being operative to provide a signal in response to and representative of a sensed condition;

said control unit including:

means for simultaneously addressing point interface device on different cables;

means for simultaneously receiving signals from the addressed point interface devices on different cables; and processing means for sequentially processing the signals received from the point interface devices.

2. The security system of claim 1 wherein said means for addressing is operative during a first time interval which occurs on a cyclical basis and wherein said processing means are operative during said first time interval.

3. The security system of claim 2 wherein each point interface device further comprises means to provide a signal representative of at least part of the respective address of that point interface device.

4. The security system of claim 1 wherein said control unit further comprises means to produce a command signal on said cables, said point interface device further comprising a control device selectively operative in response to said command signal.

5. The security system of claim 4 wherein the sensed conditions from which the point interface device provides signals in response to and representative of, includes a sensor alarm condition, a tamper alarm condition and a control device status.

6. The security system of claim 1 wherein a plurality of said point interface devices are connected in parallel on at least one of said cables, each said point interface device being sequentially addressed to report sensed conditions and selectively operate control devices associated therewith.

7. The security system of claim 1 further comprising means for selectively connecting both ends of each said cable to said control unit; and means of sensing a break in cable continuity to cause said means for selectively connecting to provide an alternate path for addressing the point interface devices on that cable and for receiving signals from the point interface devices on that cable.

8. The security system of claim 1 wherein said control unit further comprises:

message priority means operative to store an assigned priority associated with each point interface device; and message display means providing an indication corresponding to a point interface device signal in accordance with said assigned priority.

9. The security system of claim 1 wherein said control unit further comprises:

keyboard means for entry of system codes;

storage means for storing the entered system codes;

the system codes including passcodes, system commands, and system acknowledge signals; and the control unit being continuously operative while the system codes are being entered.

10. The security system of claim 8 further comprising a printer connected to said control unit to provide printed copy of selected message information.

11. The security system of claim 8 further comprising a matrix display comprising a plurality of indicators connected to said control unit, wherein said indicators denote the status of each location monitored by the point interface devices.

12. The security system of claim 1 further comprising communication means connected to said control unit, and operative to transmit data to and receive data from one or more devices external to the security system.

13. The security system of claim 12 wherein said one or more external devices include an audible alarm.

14. The security system of claim 12 wherein said one or more external devices include a central office.

15. The security system of claim 14 wherein said transmitted data comprises status and alarm signals and said received data comprises central office responses thereto.

16. The security system of claim 1 wherein said point interface device includes redundant sense means providing a verified indication of the sensed condition.

17. The security system of claim 1 wherein the control unit includes redundant communication means for addressing the point interface devices and for receiving signals therefrom.

18. A security system comprising:

a control unit;

input means receiving system codes, the operation of said control unit being alterable according to said system codes;

a cable connected to the control unit;

a plurality of point interface devices each having a respective address, and each being connected to said cable;

each of the point interface devices being operative to provide a signal in response to and representative of a sensed condition;

said control unit including:

means for addressing each point interface device;

means for receiving signals from the addressed point interface devices and simultaneously receiving signals from said input means;

processing means for sequentially processing the signals received from the point interface devices and from said input means; and means for incrementing the address of the point interface devices connected to said point interface devices.

19. The security system of claim 18 wherein said input means includes keyboard means for entry of operating data and communication means for entry of operating data from a device external to the system.

20. A security system comprising:

a plurality of remote point interface devices;

a status indicator;

operator control means;

a controller connected to said point interface devices, status indicator and operator control means, the controller including:

means to communicate with said remote point interface devices, status indicator and operator control means; and task selection means connected to said plurality of remote interface devices and operator control means for performing a plurality of tasks in a predetermined stack order in accordance with the priority of the tasks and an interrupt routine to transfer data between the controller and said means to communicate with said remote point interface devices.

21. The security system of claim 20 wherein the controller includes:

means for providing a recurring interrupt interval signal connected to said task selection means;

means for storing a data indication of I/O operations to be performed connected to said means to communicate with said remote point interface devices;

means operative during each interrupt interval to perform the I/O operations connected to said means to communicate with said remote point interface devices; and the task selection means being operative in the time between the interrupt interval signals.

22. The security system of claim 21 wherein the task selection means is operative to sequentialy perform the tasks according to the priority of the task.

23. The security system of claim 22 wherein the task selection means is operative to perform each task until an I/O operation associated with that task is requested, as denoted by data in the I/O storage means; and the task selection means being operative to perform the next task in priority after request of the I/O operation for the previous task.

24. The security system of claim 1 including:

a primary power source;

a standby power supply;

means to automatically connect said controller to said stand by power supply when said primary power source fails; and means to sense a low power condition of said standby power supply and operative to cause said control unit to selectively reduce power consumption to conserve the remaining standby power supply energy.

25. The security system of claim 1, wherein said means for simultaneously receiving signals further comprises:

means for detecting improper signals from point interface device; and means to alert the operator of improper signals.

26. The security system of claim 1, further comprising:

means to alert the security system operator of a system alarm condition;

means to acknowledge said alarm condition operable by the security system operator;

means to detect a failure to acknowledge said alarm condition alert; and means to provide a secondary alert indication upon failure of the security system operator to respond to said alarm condition alert.

27. The security system of claim 1 wherein said control unit further comprises:

means to detect a noisy point interface device providing a corresponding noise indicator signal; and means to selectively disable from said security system said noisy point interface device according to said noise indicator signal.

* * * * *

UNITED STATES PATENT AND TRADEMARK OFFICE

CERTIFICATE OF CORRECTION

PATENT NO. : 4,538,138

DATED : August 27, 1985

INVENTOR(S) : Roy L. Harvey; Kevin J. Griffin; Aaron J. Galvin; Louis H. Auerbach It is certified that error appears in the above—identified patent and that said Letters Patent is hereby corrected as shown below:

| | | |
|---|---|---|
| Column 1, | line 40, | "capacity," should read --capability,-- |
| Column 5, | line 36, | "213-237," should read --231-237,-- |
| Column 6, | line 39, | "may indicated" should read --may indicate-- |
| | line 57 (Table I) | "0000-5FFFF" should read --0000-5FFF-- |
| Column 8, | line 53, | "leads 276" should read --lead 276-- |
| Column 9, | lines 8-9, | "not shown)" should read --(not shown)-- |
| | line 20, | "PIDS" should read --PIDs-- |
| | line 40, | "matrix display of" should read --matrix display 262 of-- |
| | line 40, | "shownnow" should read --shown now-- |
| Column 10, | lines 24-25, | "4 bit input control bits" should read --4 input control bits-- |
| Column 12, | line 23, (Table II, line 4) | "Keboard Reset (Clear)" should read --Keyboard Reset (Clear)-- |
| | line 30, | "Read Control Regisler" should read --Read Control Register-- |
| | line 39, | "to Parallel Chip)" should read --(to Parallel Chip)-- |
| | line 43, | "Quad Driver Conrtol Word" should read --Quad Driver Control Word-- |
| | line 66, | "QUAD DR1EN" should read --QUAD DR 1 EN-- |
| Column 16, | line 57, | "cables 704s and 706s" should read --cables 704a and 706a |

UNITED STATES PATENT AND TRADEMARK OFFICE

CERTIFICATE OF CORRECTION

PATENT NO. : 4,538,138

DATED : August 27, 1985

INVENTOR(S) : Roy L. Harvey; Kevin J. Griffin; Aaron A. Galvin; Louis H. Auerbach It is certified that error appears in the above—identified patent and that said Letters Patent is hereby corrected as shown below:

Column 20, line 50, (Subheading) "Software System Implementation" should read --SOFTWARE SYSTEM IMPLEMENTATION--

Column 21, line 56, "the 8 list" should read --the 8 lists--
line 58, "non-exiting" should read --non-existing--
line 63, "Schedule exits" should read --Schedule exists--

Column 22, lines 20-21, "all security groups." should read --all 8 security groups.--

Column 26, line 18, "CEOO" should read --CEØØ--

Column 27, Table V, (continued) "Tests & Power Byte" should read --Test & Power Byte--

Column 28, Table V, (continued) (about line 50) "BIT: Ø - State of A/C control" should read --BIT: Ø - State of AC/DC control--

Table V, (continued) (about line 56) "6 - printer select..." should read --6 - Printer select...--

Column 30, line 19, "continue remain" should read --continue to remain--
line 37, "MAINSCAN" should read --MAIN SCAN--
line 38, "analogus" should read --analogous--

Column 31, line 36, "discribed" should read --described--

Column 33, line 49, "caled" should read --called--

Column 34, lines 25-26, "cable was #0." should read --cable address was #0.--

UNITED STATES PATENT AND TRADEMARK OFFICE

CERTIFICATE OF CORRECTION

PATENT NO. : 4,538,138

DATED : August 27, 1985

INVENTOR(S) : Roy L. Harvey; Kevin J. Griffin; Aaron A. Galvin; Louis H. Auerbach It is certified that error appears in the above—identified patent and that said Letters Patent is hereby corrected as shown below:

| | | |
|---|---|---|
| Column 34, | line 48, | "current pulse" should read --current point-- |
| Column 35, | line 38, | "of if" should read --or if-- |
| Column 36, | line 18, | "FIG. 6" should read --FIG. 16-- |
| Column 37, | line 24, | "the IT register" should read --the IY register-- |
| | line 36, | "relating to the stack" should read --relating the stack-- |
| Column 38, | line 7, | "IF the keyboard" should read --If the keyboard-- |
| | line 67, | "rubroutine" should read --subroutine-- |
| Column 39, | lines 48-49, | "the the IY" should read --to the IY-- |
| Column 40, | line 34, | "has elapsed," should read --have elapsed,-- |
| | line 50, | "plus" should read --pulse-- |
| | line 54, | "(S)lead." should read --(s) lead.-- |
| Column 41, | lines 23-24, | "ADRRESS" should read --ADRRES-- |
| | line 51, | "Thetimer" should read --The timer-- |
| Column 42, | line 17, | "clock 1418" should read --block 1418-- |
| | line 38, | "fist step" should read --first step-- |
| Column 43, | line 6, | "IY30 6" should read --IY+6-- |
| | line 59, | "bloc, 1526." should read --block 1526.-- |
| Column 45, | line 15, | "is ether" should read --is whether-- |

UNITED STATES PATENT AND TRADEMARK OFFICE

CERTIFICATE OF CORRECTION

PATENT NO. : 4,538,138

DATED : August 27, 1985

INVENTOR(S) : Roy L. Harvey; Kevin J. Griffin; Aaron J. Galvin; Louis H. Auerbach It is certified that error appears in the above—identified patent and that said Letters Patent is hereby corrected as shown below:

| | | |
|---|---|---|
| Column 46, | line 13, | "whether or nor" should read --whether or not-- |
| Column 48, | line 12, | "pulse by generated" should read --pulse be generated-- |
| | line 61, | "$PRSP_H$ ad $PRSP_L$," should read --$PRSP_H$ and $PRSP_L$,-- |
| Column 49, | line 21, | "It is was" should read --If it was-- |
| Column 50, | line 17, | "block 1981," should read --block 1918,-- |
| Column 54, | line 55, | "the address of" should read --the addresses of-- |
| Column 55, | line 26, | "sequentialy" should read --sequentially-- |
| Column 56, | line 4, | "stand by" should read --standby-- |

Signed and Sealed this

Thirteenth Day of October, 1987

*Attest:*

*Attesting Officer*

DONALD J. QUIGG

*Commissioner of Patents and Trademarks*